US010265970B2

(12) United States Patent
Sumikawa et al.

(10) Patent No.: US 10,265,970 B2
(45) **Date of Patent: *Apr. 23, 2019**

(54) RECORDED MATTER

(71) Applicant: CANON FINETECH NISCA INC., Misato-shi, Saitama (JP)

(72) Inventors: Yusuke Sumikawa, Kashiwa (JP); Takahiro Tsutsui, Matsudo (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/042,295

(22) Filed: Jul. 23, 2018

(65) Prior Publication Data

US 2018/0345685 A1 Dec. 6, 2018

Related U.S. Application Data

(62) Division of application No. 15/077,083, filed on Mar. 22, 2016, now Pat. No. 10,071,566.

(30) Foreign Application Priority Data

Apr. 3, 2015 (JP) ..... 2015-076846
Dec. 8, 2015 (JP) ..... 2015-239720
Feb. 4, 2016 (JP) ..... 2016-020177

(51) Int. Cl.

| | |
|---|---|
| ***B41M 5/50*** | (2006.01) |
| ***B41J 11/00*** | (2006.01) |
| ***B41M 5/42*** | (2006.01) |
| ***B41M 5/40*** | (2006.01) |
| ***B41M 5/41*** | (2006.01) |
| ***B41M 5/025*** | (2006.01) |
| ***B41M 5/52*** | (2006.01) |

(52) U.S. Cl.

CPC ..... *B41J 11/0015* (2013.01); *B41M 5/025* (2013.01); *B41M 5/40* (2013.01); *B41M 5/41* (2013.01); *B41M 5/423* (2013.01); *B41M 5/52* (2013.01); *B41M 5/0256* (2013.01); *B41M 5/506* (2013.01); *B41M 5/508* (2013.01); *B41M 5/5218* (2013.01); *B41M 5/5236* (2013.01); *B41M 5/5245* (2013.01); *B41M 5/5254* (2013.01); *Y10T 428/24934* (2015.01); *Y10T 428/249953* (2015.04); *Y10T 428/31993* (2015.04)

(58) Field of Classification Search

CPC ..... B41M 5/40; B41M 5/41; B41M 5/423; Y10T 428/31993; Y10T 428/249953; Y10T 428/24934

See application file for complete search history.

(56) References Cited

U.S. PATENT DOCUMENTS

| | | | |
|---|---|---|---|
| 4,923,848 | A | 5/1990 | Akada et al. |
| 5,451,560 | A | 9/1995 | Akada et al. |
| 5,629,259 | A | 5/1997 | Akada et al. |
| 5,707,925 | A | 1/1998 | Akada et al. |
| 5,766,398 | A | 6/1998 | Cahill et al. |
| 5,940,111 | A | 8/1999 | Akada et al. |
| 6,284,708 | B1 | 9/2001 | Oshima et al. |
| 6,392,680 | B2 | 5/2002 | Akada et al. |
| 6,638,388 | B2 | 10/2003 | Nagata et al. |
| 6,696,390 | B1 | 2/2004 | Hatada et al. |
| 6,917,375 | B2 | 7/2005 | Akada et al. |
| 6,979,141 | B2 | 12/2005 | Karst et al. |
| 7,037,013 | B2 | 5/2006 | Klinefelter et al. |
| 8,795,798 | B2 | 8/2014 | Oguri et al. |
| 9,902,139 | B2 | 2/2018 | Tsutsui et al. |
| 10,071,566 | B2 * | 9/2018 | Sumikawa ..... B41J 11/0015 |
| 2001/0034303 | A1 | 10/2001 | Ueno et al. |
| 2002/0127042 | A1 | 9/2002 | Klinefelter et al. |
| 2003/0162660 | A1 | 8/2003 | Sakamoto et al. |
| 2004/0146329 | A1 | 7/2004 | Klinefelter et al. |
| 2007/0020474 | A1 | 1/2007 | Tosaki et al. |
| 2009/0242114 | A1 | 10/2009 | Nishimura |
| 2013/0323479 | A1 | 12/2013 | Kobayashi et al. |
| 2015/0042737 | A1 | 2/2015 | Tsutsui et al. |
| 2016/0114609 | A1 | 4/2016 | Tsutsui et al. |
| 2016/0288468 | A1 | 10/2016 | Tsutsui et al. |

FOREIGN PATENT DOCUMENTS

| | | | |
|---|---|---|---|
| CN | 101316717 | A | 12/2008 |
| CN | 103454868 | A | 12/2013 |
| EP | 0 820 874 | A1 | 1/1998 |
| JP | 56-120508 | A | 9/1981 |
| JP | 62-238791 | A | 10/1987 |
| JP | 8-207450 | A | 8/1996 |
| JP | 2000-238439 | A | 9/2000 |
| JP | 2002-121515 | A | 4/2002 |
| JP | 2003-080823 | A | 3/2003 |
| JP | 2003-211593 | A | 7/2003 |
| JP | 2003-211761 | A | 7/2003 |
| JP | 2004-174965 | A | 6/2004 |
| JP | 2004-284310 | A | 10/2004 |
| JP | 2006-517871 | A | 8/2006 |
| JP | 2007-51271 | A | 3/2007 |
| JP | 2008-44130 | A | 2/2008 |
| JP | 4956917 | B2 | 6/2012 |
| JP | 2015-110321 | A | 6/2015 |
| WO | 2004/062917 | A2 | 7/2004 |

OTHER PUBLICATIONS

Esin Gulari et al., "Photon Correlation Spectroscopy of Particle Distributions," 70(8) J. Chem. Phys. 3965-3972 (Apr. 15, 1979).

(Continued)

*Primary Examiner* — Betelhem Shewareged
(74) *Attorney, Agent, or Firm* — Venable LLP

(57) ABSTRACT

The transfer material has a laminated structure in which a base material sheet, a transparent sheet, and a coloring material-receiving layer are laminated in the stated order, in which: the coloring material-receiving layer contains inorganic fine particles and a water-soluble resin; the transparent sheet contains at least two kinds of emulsions including an emulsion E1 and an emulsion E2; and the emulsion E1 has a glass transition temperature Tg1 of more than 50° C. and less than 90° C., the emulsion E2 has a glass transition temperature Tg2 of 90° C. or more and 120° C. or less, and at least the emulsion E2 remains in a particle state in the transparent sheet.

7 Claims, 17 Drawing Sheets

(56) References Cited

OTHER PUBLICATIONS

Polymer Structure (2); Scattering Experiments and Morphological Observation; the First Chapter: Light Scattering (Kyoritsu Shuppan, edited by the Society of Polymer Science, Japan), pp. 126-127 (ND).
Robert F. Fedors, "A method for Estimating Both the Solubility Parameters and Molar Volumes of Liquids," 14(2) Polym. Eng. Sci. 147-154 (Feb. 1974).
Extended European Search Report in European Application No. 16162543.9 (dated Oct. 12, 2016).
First Office Action in Chinese Application No. 201610202560.4 (dated May 2, 2018).

* cited by examiner

RECORDED MATTER

CROSS-REFERENCE TO RELATED APPLICATIONS

This application is a divisional application of U.S. patent application Ser. No. 15/077,083, filed Mar. 22, 2016, which claims the benefit of Japanese Patent Application No. 2015-076846, filed Apr. 3, 2015, Japanese Patent Application No. 2015-239720, filed Dec. 8, 2015, and Japanese Patent Application No. 2016-020177, filed Feb. 4, 2016. All of these prior applications are hereby incorporated by reference herein in their entirety.

BACKGROUND OF THE INVENTION

Field of the Invention

The present invention relates to a transfer material, a recorded matter, a method of manufacturing a recorded matter, an image-recording apparatus, and an apparatus for manufacturing a recorded matter, and more specifically, to a transfer material having a laminated structure in which a base material sheet, a transparent sheet, and a coloring material-receiving layer are laminated in the stated order, a recorded matter using the transfer material and a method of manufacturing the recorded matter, and an image-recording apparatus to be used in manufacture of a recorded matter and an apparatus for manufacturing a recorded matter using the image-recording apparatus.

Description of the Related Art

Various thermal transfer recording methods have heretofore been known. Of those, a general thermal transfer method is a thermal transfer method using a thermal transfer sheet having formed on its base material sheet a colored transfer layer, the thermal transfer method involving forming an image by heating the thermal transfer sheet from its back surface with a thermal head or the like according to the shape of the image to be formed to thermally transfer the colored transfer layer onto the surface of a thermal transfer image-receiving sheet (Japanese Patent Application Laid-Open No. S62-238791). The thermal transfer method has been expanding the market of a full-color hard copy system for various images typified by computer graphics, still images provided by satellite communications, digital images recorded on CD-ROMs or the like, and analog images, such as a video, because of the development of various kinds of hardware and software related to multimedia.

When recorded matters are obtained by forming images on objects formed of various kinds of materials, such as paper, a resin product, and a metal, the images have heretofore been formed on the objects by thermal transfer systems. The thermal transfer systems are roughly classified into a thermal fusion transfer type and a sublimation transfer type depending on the construction of the colored transfer layer. Each of both the systems can form a full-color image, and involves: preparing thermal transfer sheets for three or four colors, such as yellow, magenta, and cyan colors, and as required, a black color; and then superimposing and thermally transferring respective color images onto the surface of one thermal transfer image-receiving sheet to form the full-color image.

As a method of manufacturing a recorded matter by a thermal fusion transfer-type thermal transfer system, for example, there has been proposed a method of manufacturing a recorded matter using a transfer material in which a receiving layer is provided on a base material in a peelable manner, and a thermal transfer sheet having a dye layer, the method involving forming an image on the transfer material by transferring the dye of the dye layer onto the receiving layer, and then heating the transfer material under a state of being brought into abutment with an object to transfer the receiving layer onto the object (Japanese Patent Application Laid-Open No. 2000-238439).

In addition, as a method of manufacturing a recorded matter by a sublimation transfer-type thermal transfer system, there has been proposed a method of manufacturing a recorded matter involving forming an image with a sublimation transfer-type thermal transfer sheet (Japanese Patent Application Laid-Open No. 2003-211761).

The sublimation transfer-type thermal transfer sheet enables precise formation of a gray-scale image, such as a face photograph. On the other hand, the image has the following inconvenience unlike an image formed by using an ordinary recording ink. The image is deficient in durability, such as weatherability, abrasion resistance, or chemical resistance. As a solution to the inconvenience, there has been known a method of superimposing a protective layer thermal transfer film having a thermally transferable resin layer on a thermal transfer image, the method involving transferring the thermally transferable resin layer having transparency with a thermal head, a heating roll, or the like to form a protective layer on the image (Japanese Patent Application Laid-Open No. 2008-44130).

In addition, a method involving forming an image on an object by an inkjet system instead of forming the image by the thermal transfer system has been proposed. For example, there has been proposed a technology for printing an image on the receiving layer of a transfer material by the inkjet system, the technology involving heating the transfer material and a transfer body, while superimposing the material and the body, to transfer the receiving layer onto the transfer body (Japanese Patent Translation Publication No. 2006-517871 and Japanese Patent Application Laid-Open No. H08-207450).

As a technology for protecting the receiving layer, for example, there has been proposed a method involving incorporating two or more kinds of emulsions into the surface layer of a laminated film obtained by laminating at least the surface layer and an adhesion layer on a base material (Japanese Patent Application Laid-Open No. 2002-121515).

SUMMARY OF THE INVENTION

In order to form a protective layer and a coloring material-receiving layer on an image support through transfer, cutting (a foil-cutting property) between the protective layer and an end portion of the coloring material-receiving layer needs to be improved to prevent the occurrence of a burr or the like in the end portion at the time of peeling in a peeling step. Simultaneously, an adhesive property between the protective layer and the coloring material-receiving layer needs to be improved to prevent the occurrence of peeling between the protective layer and the coloring material-receiving layer in a test, such as tape peeling. Further, a recorded matter to be used over a long time period, such as an IC card, is required to have a high degree of durability (chemical resistance and scratch resistance). In addition, the recorded matter is required to have a good texture of its protective layer, such as no stickiness of the surface of the protective layer.

In Japanese Patent Translation Publication No. 2006-517871 and Japanese Patent Application Laid-Open No.

H08-207450, however, the cutting property of the end portion, the chemical resistance, and the stickiness have not been sufficiently described. In addition, the protective layer is a film using a resin, and is hence insufficient in terms of the cutting property of the end portion, and for example, a burr occurs in the end portion at the time of the peeling.

Meanwhile, in Japanese Patent Application Laid-Open No. 2002-121515, an emulsion having a Tg of 30° C. or less and an emulsion having a Tg of 80° C. or more have been used. However, the use of, in particular, the low-Tg emulsion having a Tg of 30° C. or less involves the following problems. The surface of the protective layer becomes sticky and hence its texture reduces, and when the layer is turned into a roll shape, blocking is liable to occur.

The present invention has been made to solve the problems, and an object of the present invention is to provide a transfer material, a recorded matter, a method of manufacturing a recorded matter, an image-recording apparatus, and an apparatus for manufacturing a recorded matter that can achieve an improvement in cutting property of an end portion, an improvement in adhesive property between a coloring material-receiving layer and a transparent sheet, an improvement in chemical resistance, and the prevention of stickiness.

To achieve the object, according to the present invention, there are provided a transfer material, a recorded matter, a method of manufacturing a recorded matter, an image-recording apparatus, and an apparatus for manufacturing a recorded matter described below.

[1] Transfer Material:

According to one embodiment of the present invention, there is provided a transfer material having a laminated structure in which a base material sheet, a transparent sheet, and a coloring material-receiving layer are laminated in the stated order, wherein: the coloring material-receiving layer contains inorganic fine particles and a water-soluble resin; the transparent sheet contains at least two kinds of emulsions including an emulsion E1 and an emulsion E2; and the emulsion E1 has a glass transition temperature Tg1 of more than 50° C. and less than 90° C., the emulsion E2 has a glass transition temperature Tg2 of 90° C. or more and 120° C. or less, and at least the emulsion E2 remains in a particle state in the transparent sheet.

[2] Recorded Matter:

According to one embodiment of the present invention, there is provided a recorded matter, comprising: an image support, a coloring material-receiving layer having an image recorded thereon, and a transparent sheet which are laminated, wherein the coloring material-receiving layer and the transparent sheet are transferred from the transfer material of the above-mentioned item [1].

[3] Method of Manufacturing Recorded Matter:

According to one embodiment of the present invention, there is provided a method of manufacturing a recorded matter in which an image support, a coloring material-receiving layer having an image recorded thereon, and a transparent sheet are laminated, the method comprising: a step 1 of recording an image on a coloring material-receiving layer of a transfer material having a laminated structure in which a base material sheet, a transparent sheet, and the coloring material-receiving layer are laminated in the stated order, the coloring material-receiving layer containing inorganic fine particles and a water-soluble resin, the transparent sheet containing at least two kinds of emulsions including an emulsion E1 and an emulsion E2; a step 2 of thermally pressure-bonding the transfer material, in which the image has been recorded on the coloring material-receiving layer, onto the image support from a side closer to the coloring material-receiving layer; and a step 3 of peeling the base material sheet from the transfer material to obtain the recorded matter in which the coloring material-receiving layer having the image recorded thereon and the transparent sheet are laminated in the stated order.

[4] Image-Recording Apparatus:

According to one embodiment of the present invention, there is provided an image-recording apparatus, comprising: a supplying portion configured to feed the transfer material of the above-mentioned item [1] to a conveying path; and a recording portion configured to apply a coloring material to the coloring material-receiving layer of the transfer material, which is fed to the conveying path, to record an image.

[5] Apparatus for Manufacturing Recorded Matter:

According to one embodiment of the present invention, there is provided an apparatus for manufacturing the recorded matter of the above-mentioned item [2], the apparatus comprising: the image-recording apparatus of the above-mentioned item [4]; an image support-supplying portion configured to feed the image support to the conveying path; an adhering portion configured to allow the transfer material to adhere to the image support fed to the conveying path; and a peeling portion configured to peel the base material sheet from the transfer material.

According to the present invention, the transfer material that can achieve an improvement in cutting property of an end portion, an improvement in adhesive property between a coloring material-receiving layer and a transparent sheet, an improvement in blocking resistance through a reduction in stickiness of the transparent sheet, and an improvement in chemical resistance of a recorded matter, the recorded matter, the method of manufacturing a recorded matter, the image-recording apparatus, and the apparatus for manufacturing a recorded matter are provided.

Further features of the present invention will become apparent from the following description of exemplary embodiments with reference to the attached drawings.

DESCRIPTION OF THE EMBODIMENTS

Figure 1:
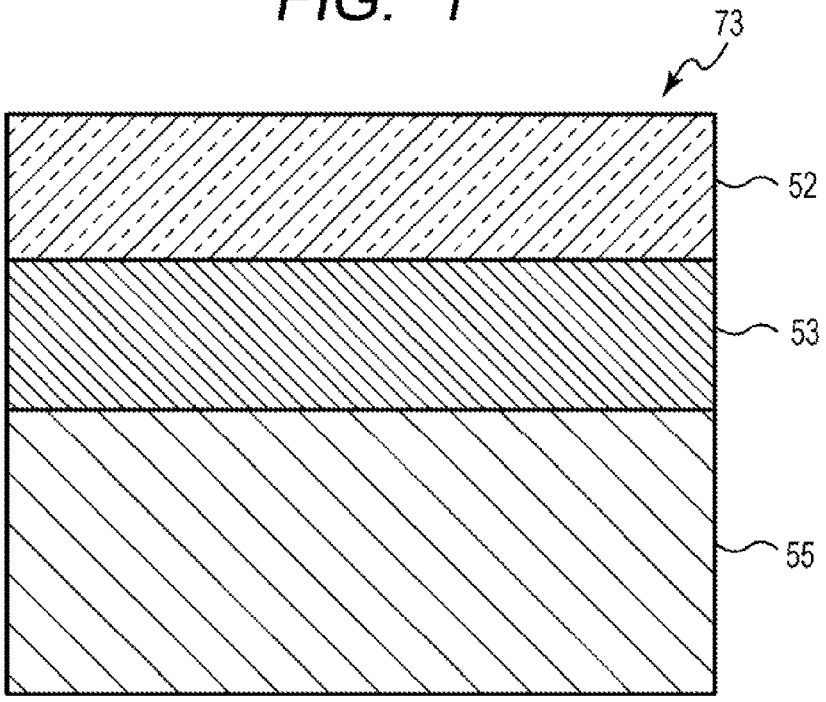
FIG. 1 is a sectional view for schematically illustrating one embodiment of a recorded matter of the present invention.

The present invention is hereinafter described in detail with reference to the drawings. However, the present invention is not limited to the following embodiments and comprehends all objects having matters to define the invention. It should be noted that members of the same structure are denoted by the same reference symbol in the drawings and description thereof can be omitted.

The inventors of the present invention have made extensive investigations on the problems, and as a result, have been able to realize a transfer material that is excellent in cutting property of an end portion, has a satisfactory adhesive property between a transparent sheet and a coloring material-receiving layer, improves blocking resistance through a reduction in stickiness of the transparent sheet, and can improve the chemical resistance of a recorded matter.

The transfer material has a laminated structure in which a base material sheet, a transparent sheet, and a coloring material-receiving layer are laminated in the stated order. The coloring material-receiving layer contains inorganic fine particles and a water-soluble resin. The transparent sheet contains at least an emulsion E1 and an emulsion E2. The emulsion E1 has a glass transition temperature Tg1 of more than 50° C. and less than 90° C., the emulsion E2 has a glass transition temperature Tg2 of 90° C. or more and 120° C. or less, and at least the emulsion E2 is in a state of remaining as particles.

The use of the two kinds of emulsions enables the formation of a transparent sheet in which emulsion particles are uniformly dispersed while maintaining the protecting performance of the transparent sheet.

When the two kinds of emulsions are used in the transparent sheet, their glass transition temperatures are controlled, the emulsion E1 is brought into a film state, and the emulsion E2 is brought into a particle state, the following effects can be obtained:

(1) an adhesive property between the transparent sheet and the coloring material-receiving layer improves, and hence a transfer failure can be suppressed;

(2) the foil-cutting property of the transparent sheet at the time of peeling improves;

(3) the chemical resistance of the transparent sheet improves and hence its durability can be improved; and (4) the stickiness of the transparent sheet is eliminated and hence the texture of the transparent sheet improves.

First, the effect (1) is described. The two kinds of emulsions are used in the transparent sheet, the glass transition temperatures of the two kinds of emulsions are controlled, the emulsion E1 is brought into the film state, and the emulsion E2 is brought into the particle state. Then, the emulsion E1 acts as a binder for the emulsion E2 present in the particle state. When the emulsion E1 is brought into the film state, the emulsion comes into close contact with the water-soluble resin of the coloring material-receiving layer, and hence the adhesive property between the transparent sheet and the coloring material-receiving layer improves. The improvement of the adhesive property can prevent such a peeling failure that peeling occurs at an interface between the transparent sheet and the coloring material-receiving layer at the time of the peeling of the base material sheet in a peeling step.

Figure 23A:
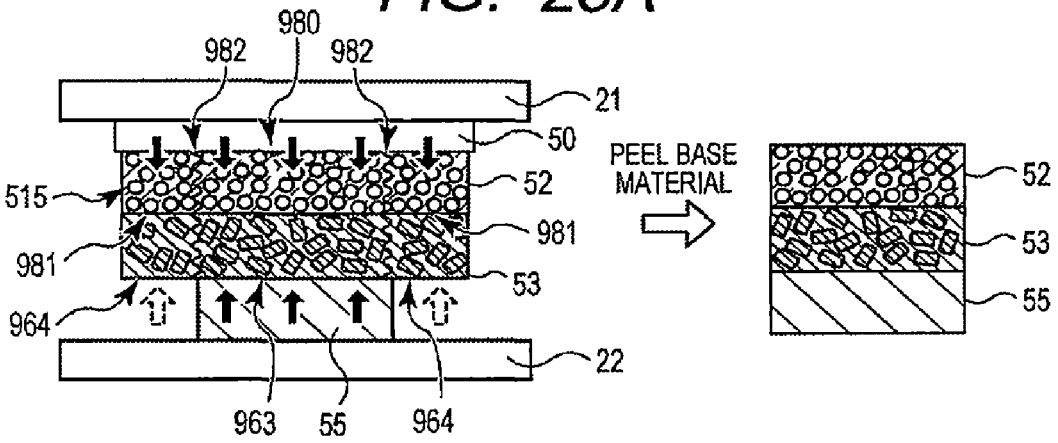
FIGS. 23A, 23B, and 23C are each an explanatory view for illustrating a state in which the transfer material is thermally pressure-bonded onto the image support.
Figure 23B:
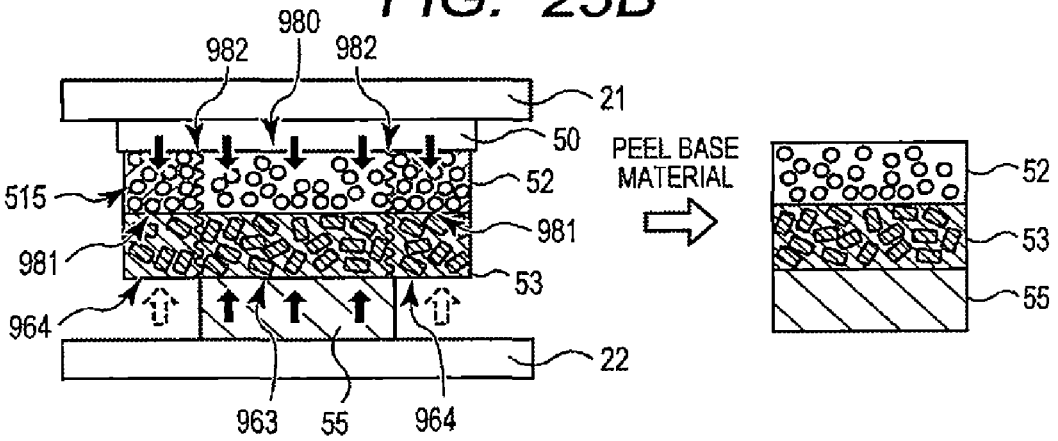
Figure 23C:
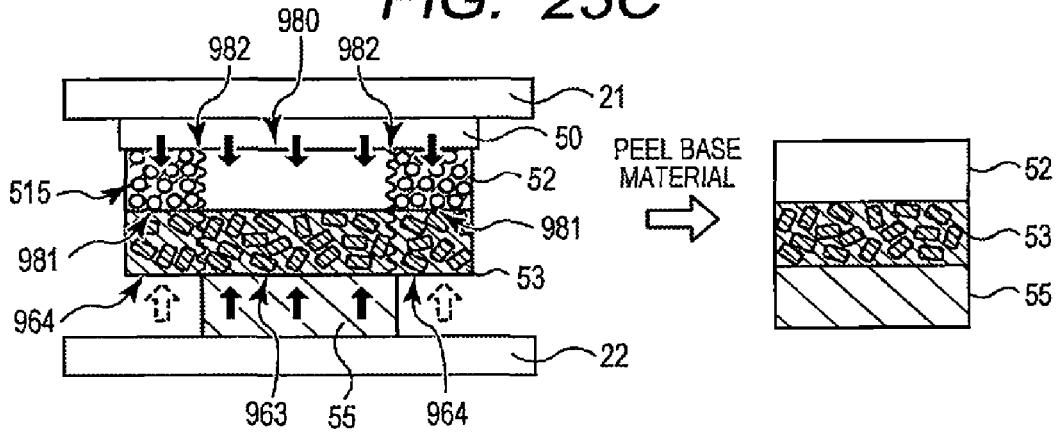

Next, the effect (2) is described. When the emulsion E2 is brought into the particle state, as illustrated in FIGS. 23A to 23C, the film states of a transparent sheet portion 980 of a portion 963 where an image support 55 and the coloring material-receiving layer are bonded to each other, and a transparent sheet portion 981 of a portion 964 where the image support and the coloring material-receiving layer are not bonded to each other can be controlled to differ from each other at the time of thermal pressure bonding. That is, at the time of the thermal pressure bonding, the heat of a heat roll is easily transferred to the transparent sheet portion 980, and hence a state in which part of the emulsion E2 turns into a film and part of its particles remain (FIG. 23B), or a state in which the emulsion E2 of the transparent sheet completely turns into a film (FIG. 23C) is established. At this time, a bonding force between the emulsion E2 that has partially or completely turned into a film and the emulsion E1 that has turned into a film in advance is strengthened, and hence the film strength of the transparent sheet can be strengthened. On the other hand, the heat of the heat roll is not transferred to the transparent sheet portion 981, and hence the emulsion E2 can be kept in the particle state. The film states of the transparent sheet portion 980 and the transparent sheet portion 981 differ from each other, and hence in the peeling step, a crack easily occurs with a boundary portion 982 as a starting point. As can be seen from the foregoing, the foil-cutting property can be improved by using the two kinds of emulsions and changing the film state of the emulsion E2 through the utilization of a temperature at the time of the thermal pressure bonding. On the other hand, when the entirety of the transparent sheet is brought into a film state with no boundary between a transfer portion and a non-transfer portion, a crack hardly occurs and hence the foil-cutting property reduces.

In addition, with regard to the effect (3), in general, as the Tg of an emulsion increases, a force acting between the molecular chains of an emulsion resin strengthens, and hence the emulsion becomes hardly soluble in a solvent, such as an alcohol, and the chemical resistance improves. In addition, the emulsion becomes a hard resin and hence the durability, such as scratch resistance, also improves. Accordingly, an emulsion having a glass transition temperature of more than 50° C. is used. At this time, when the emulsion E1 having a high hardness is in the film state, the film strength of the transparent sheet increases and its scratch resistance improves, and hence even when the transparent sheet is immersed in an alcohol, such a failure that the transparent sheet peels from the coloring material-receiving layer can be prevented.

Further, the effect (4) is described. When the glass transition temperature Tg1 of the emulsion E1 is set to be more than 50° C. and the Tg2 of the emulsion E2 is set to be 90° C. or more, each of the resins becomes hard to stretch, and becomes hard to adapt to the oils and fats or sweat of a hand, and hence the stickiness of the transparent sheet can be prevented. In particular, when the Tg1 is more than 50° C., the emulsion E1 that has a high hardness and is hence hard to stretch can maintain the property even when turned into a film, and hence stickiness at the time of a touch to the transparent sheet can be suppressed and its texture can be improved.

In view of the four effects, in the transfer material of this embodiment, the glass transition temperature Tg1 of the emulsion E1 is set to be more than 50° C. and less than 90° C., the glass transition temperature Tg2 of the emulsion E2 is set to be 90° C. or more and 120° C. or less, at least the emulsion E1 is brought into a film state, and at least the emulsion E2 is brought into a state of remaining as particles. Thus, all of the improvement of the chemical resistance, the improvement of the adhesive property, the improvement of the cutting property of the end portion, and the prevention of the stickiness have been established.

However, when two kinds of emulsions whose glass transition temperatures are sufficiently higher than room temperature are incorporated into the transparent sheet like the transfer material of this embodiment, a heat drying temperature at the time of the formation of the transparent sheet or at the time of the formation of the coloring material-receiving layer needs to be precisely controlled. That is, the film state or particle state of an emulsion changes with its glass transition temperature as a boundary, and hence the state of presence of the emulsion may change when temperature control at the time of its application becomes insufficient.

In view of the foregoing, the drying temperature at the time of the formation of the transparent sheet or at the time of the formation of the coloring material-receiving layer is preferably controlled to be equal to or more than the glass transition temperature Tg1 and less than the glass transition temperature Tg2. An emulsion can be turned into a film by being heated at its glass transition temperature or more, and remains as particles when a temperature equal to or more than the glass transition temperature is not applied. When the emulsions E1 and E2 whose glass transition temperatures are sufficiently higher than room temperature are used in the transparent sheet, a sufficient effect is not obtained unless a drying temperature at the time of their application is considered. That is, when drying is performed at the glass transition temperature Tg1 or less after the application of the emulsions, both the emulsions E1 and E2 are in particle states, and hence the peeling or dusting of an emulsion of the transparent sheet may occur at the time of the formation of the coloring material-receiving layer, and the coloring material-receiving layer cannot be uniformly formed. On the other hand, when the drying temperature after the application of the emulsions is set to the glass transition temperature Tg2 or more, both the emulsions E1 and E2 are in film states, and hence the foil-cutting property is not obtained.

Precise control of the ratio of the emulsion E1 to the emulsion E2 can additionally improve the effects. That is, the ratio E1/E2 preferably satisfies the following expression (1), more preferably satisfies a relationship of $5.0 \leq E1/E2 \leq 50.0$, and still more preferably satisfies a relationship of $10.0 \leq E1/E2 \leq 35.0$. Setting the ratio E1/E2 to preferably 65.0 or less, more preferably 50.0 or less, still more preferably 35.0 or less increases the amount of the emulsion E2. As the amount of a particle component increases, a difference in film strength between the emulsion that is incorporated into the transparent sheet portion 980 of the portion 963 where the image support 55 and the coloring material-receiving layer are bonded to each other, and that melts and softens with heat at the time of heat transfer to be brought into the film state, and the emulsion in the particle state incorporated into the transparent sheet portion 981 of the portion 964 where the image support and the coloring material-receiving layer are not bonded to each other enlarges. Thus, a crack easily occurs in the boundary portion 982, and hence no burr occurs in the end portion and its foil-cutting property can be improved. Meanwhile, setting the ratio E1/E2 to preferably 3.0 or more, more preferably 5.0 or more, still more preferably 10.0 or more increases the amount of the emulsion E1. As the amount of a film-forming component increases, the film strength increases, and hence it can be made difficult for a crack to occur owing even to shrinkage at the time of the application of the coloring material-receiving layer. Further, as the amount of the film-forming component increases, an area of contact with the coloring material-receiving layer increases to exhibit an improving effect on the adhesive property between the coloring material-receiving layer and the transparent sheet. In particular, setting the ratio E1/E2 within the range of from 10.0 to 35.0 can achieve all of the adhesive property, the cutting property of the end portion, and the prevention of cracking at high levels. When the ratio E1/E2 becomes more than 65.0, the amount of the particle component reduces and the state is brought close to a film state, and hence a crack hardly occurs in the boundary portion 982 and the foil-cutting property is not obtained. In addition, when the ratio E1/E2 becomes less than 3.0, the amount of the emulsion E1 serving as a binder for the emulsion E2 reduces. Accordingly, the peeling or dusting of an emulsion of the transparent sheet may occur at the time of the formation of the coloring material-receiving layer, and the coloring material-receiving layer cannot be uniformly formed. Further, the amount of the film-forming component reduces, and hence the adhesive property with the coloring material-receiving layer reduces and the peeling of the transparent sheet is liable to occur.

$$3.0 \leq E1/E2 \leq 65.0 \quad (1)$$

Figure 20:
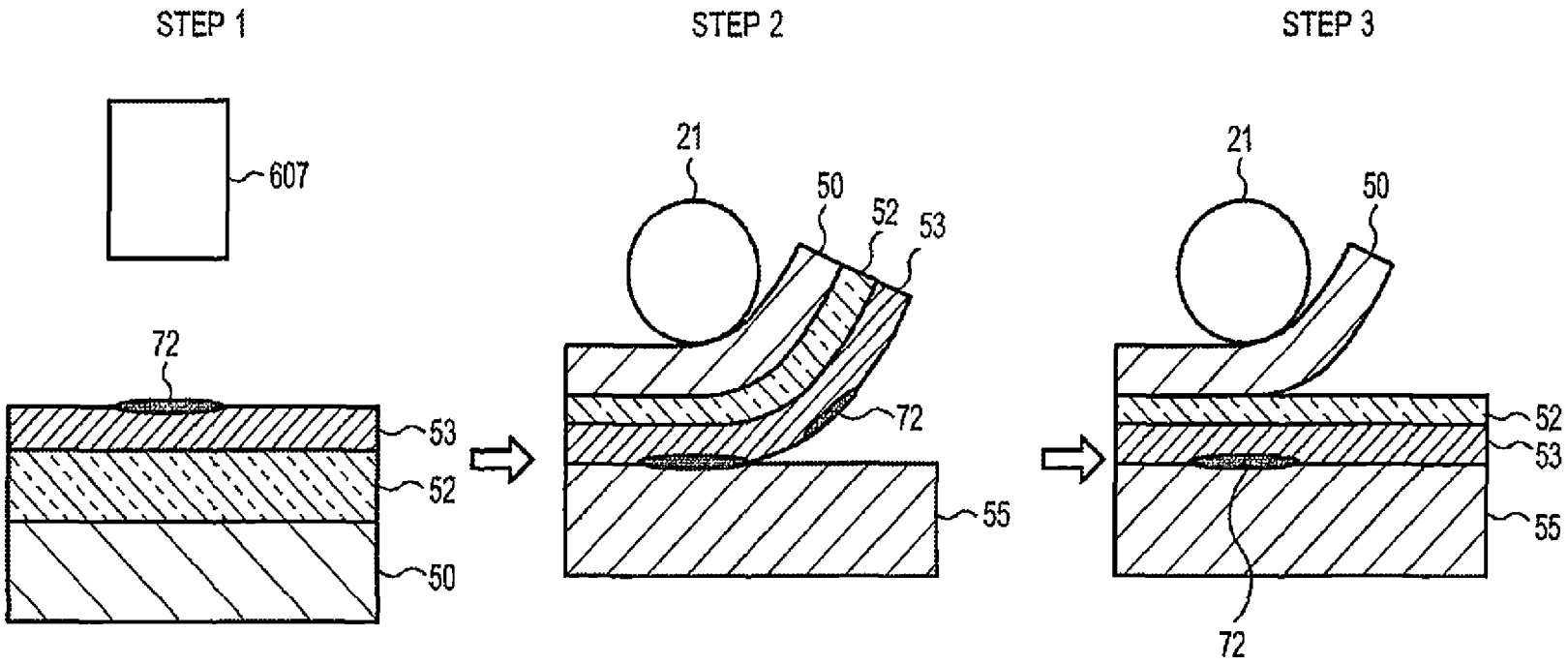
FIG. 20 is a step view for illustrating the steps of a method of manufacturing a recorded matter.

In this embodiment, as illustrated in FIG. 20, first, a reverse image 72 is recorded on a coloring material-receiving layer 53 of a transfer material with a recording head 607

(step 1). Next, the coloring material-receiving layer 53 is transferred onto an image support 55 by thermally pressure-bonding the transfer material and the image support with a heat roll 21 (step 2). Finally, a base material sheet 50 is peeled with a peeling roll 88 (step 3). Thus, a recorded matter can be obtained.

The recorded matter of this embodiment is a recorded matter in which an image support, a coloring material-receiving layer having recorded thereon an image, and a transparent sheet are laminated, and the coloring material-receiving layer and the transparent sheet are transferred from a transfer material to be described later.

Controlling the thermal pressure bonding temperature of the step 2 of the section [3] to be described later can change the emulsion E2 in the transparent sheet of the recorded matter into a particle state or a film state. That is, setting the transfer temperature to the glass transition temperature of the water-soluble resin in the coloring material-receiving layer or more and the Tg2 or more can produce a recorded matter in a state in which part of the emulsion E2 in the transparent sheet forms a film or the entirety thereof forms a film. Meanwhile, setting the transfer temperature to the glass transition temperature of the water-soluble resin in the coloring material-receiving layer or more, and the Tg1 or more and less than the Tg2 can produce a recorded matter in which the emulsion E2 of the transparent sheet remains as particles. The recorded matter in which part or the entirety of the emulsion E2 of the transparent sheet forms a film is more preferred, and forming the emulsion E2 of the recorded matter into a film strengthens its bonding force with the emulsion E1 that has turned into a film in advance, and hence can strengthen the film strength of the transparent sheet.

A method of manufacturing the recorded matter is preferably as follows: at the time of the thermal pressure bonding of the step 2, part or the entirety of the emulsion E2 in the transparent sheet portion 980 of the portion 963 where the image support 55 and the coloring material-receiving layer are bonded to each other is formed into a film, and the emulsion E2 in the transparent sheet portion 981 of the portion 964 where the image support and the coloring material-receiving layer are not bonded to each other is caused to remain as particles, and in the step 3, the recorded matter is obtained by peeling the base material sheet from the transfer material while maintaining a state in which part or the entirety of the emulsion E2 in the transparent sheet portion 980 is formed into the film, and the emulsion E2 in the transparent sheet portion 981 is caused to remain as the particles.

The transparent sheet portion 980 of the portion 963 where the image support 55 and the coloring material-receiving layer are bonded to each other is in a state in which the transfer material is sandwiched between the roll and the image support, and hence a pressure is applied thereto. Accordingly, the efficiency with which heat is transferred to the transfer material improves, and hence when the transfer temperature is set to the Tg2 or more, the emulsion E2 is heated to the Tg2 or more to be brought into a film state. On the other hand, the transparent sheet portion 981 of the portion 964 where the image support and the coloring material-receiving layer are not bonded to each other is in a state in which no pressure is applied to the transfer material. Accordingly, the heat transfer efficiency significantly reduces, and hence even when the transfer temperature is set to the Tg2 or more, the emulsion E2 is not heated to the Tg2 or more and remains as particles.

As described above, at the time of the thermal pressure bonding, part or the entirety of the emulsion E2 in the transparent sheet portion 980 of the portion 963 where the image support 55 and the coloring material-receiving layer are bonded to each other is formed into a film, and the emulsion E2 in the transparent sheet portion 981 of the portion 964 where the image support and the coloring material-receiving layer are not bonded to each other is caused to remain as particles, and in the step 3, the base material sheet is peeled from the transfer material while a state in which part or the entirety of the emulsion E2 in the transparent sheet portion 980 is formed into the film, and the emulsion in the transparent sheet portion 981 is caused to remain as the particles is maintained. Then, with regard to the transparent sheet portion 980, the emulsion E2 of the recorded matter is formed into the film and hence its bonding force with the emulsion E1 that has turned into a film in advance is strengthened. In the transparent sheet portion 981, the emulsion E2 remains as the particles, and hence the bonding force is in a weak state. Making such a difference in bonding force between a bonding portion and a non-bonding portion facilitates the occurrence of a crack in the boundary portion to enable additionally beautiful transfer along the end portion, and hence additionally improves the foil-cutting property.

[1] Transfer Material:

A transfer material of this embodiment is a transfer material having a laminated structure in which a base material sheet, a transparent sheet, and a coloring material-receiving layer are laminated in the stated order, in which: the coloring material-receiving layer contains inorganic fine particles and a water-soluble resin; the transparent sheet contains the emulsion E1 and the emulsion E2; and the emulsion E1 has a glass transition temperature Tg1 of more than 50° C. and less than 90° C., the emulsion E2 has a glass transition temperature Tg2 of 90° C. or more and 120° C. or less, and at least the emulsion E2 is in a state of remaining as particles.

Figure 2:
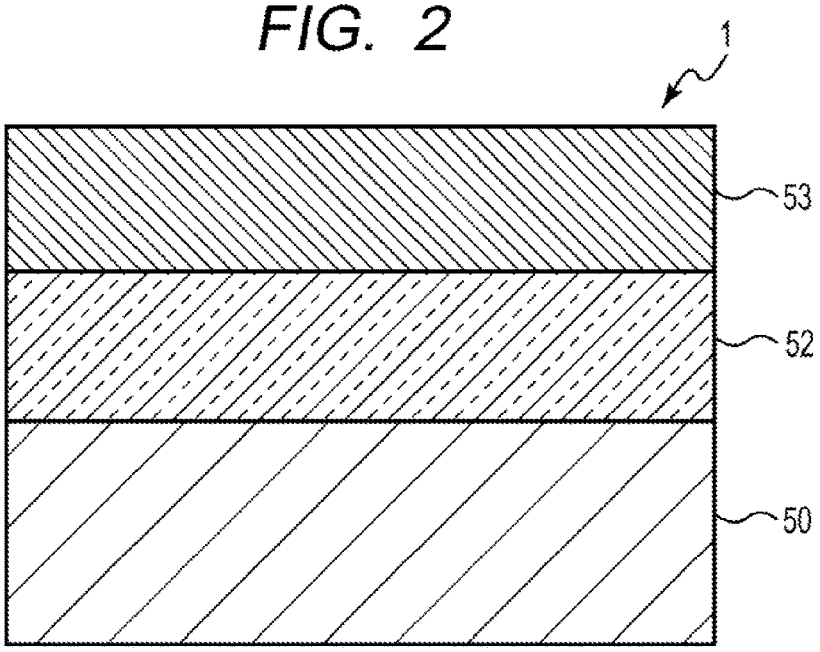
FIG. 2 is a sectional view for schematically illustrating one embodiment of a transfer material of the present invention.

Specifically, as illustrated in FIG. 2, a transfer material 1 of this embodiment includes the coloring material-receiving layer 53 configured to receive a coloring material, a transparent sheet 52, and the base material sheet 50 configured to support the coloring material-receiving layer 53 and the transparent sheet 52. The transfer material includes the coloring material-receiving layer on the base material sheet, and serves as an intermediate sheet upon arrangement of the coloring material-receiving layer on an image support by transfer after the printing of an image on the transfer material. The transfer of the coloring material-receiving layer of the transfer material onto the image support enables the formation of the image on the coloring material-receiving layer of the image support. FIG. 2 is an illustration of one embodiment of the transfer material of this embodiment, and is a sectional view for illustrating the case where the transfer material 1 is cut in its thickness direction. The transfer material of this embodiment is a transfer material including the base material sheet 50, the transparent sheet 52, and the coloring material-receiving layer 53 like the transfer material 1 illustrated in FIG. 2.

[1-1] Coloring Material-Receiving Layer:

The coloring material-receiving layer is a layer configured to receive the coloring material. In addition, the coloring material-receiving layer contains at least the inorganic fine particles and the water-soluble resin. The following forms are present as preferred forms of the coloring material-receiving layer: a swelling absorption-type coloring material-receiving layer configured to receive the coloring material (such as an ink) in the network structure of a water-soluble polymer; and a gap absorption-type coloring material-receiving layer configured to receive the coloring material in gaps formed by the inorganic fine particles. The transfer material of this embodiment includes the gap absorption-type coloring material-receiving layer formed of a composition containing at least the inorganic fine particles and the water-soluble resin. The gap absorption-type coloring material-receiving layer can quickly absorb the coloring material with the gaps formed by the inorganic fine particles. Therefore, upon thermal pressure bonding of the transfer material onto the image support, abrupt bumping of the coloring material is reduced, and hence such an inconvenience that the transfer material and the image support are not completely bonded to each other (adhesive property failure), and such an inconvenience that air bubbles remain in a space between the transfer material and the image support (remaining of the air bubbles) can be suppressed. In addition, the incorporation of the inorganic fine particles into the coloring material-receiving layer facilitates the occurrence of a crack in a gap between the inorganic fine particles as illustrated in FIGS. 23A to 23C, and hence can suppress the remaining of a burr in the end portion.

Upon formation of the coloring material-receiving layer, it is preferred to precisely control the average particle diameter of the inorganic fine particles, and the weight-average polymerization degree and saponification degree of the water-soluble resin. Thus, the transparency (permeability) of the coloring material-receiving layer, and an adhesive strength between the coloring material-receiving layer and the transparent sheet can be improved. Thus, the visibility of an image from a side closer to the transparent sheet can be improved. Therefore, even when a pigment ink that hardly permeates the coloring material-receiving layer is used as the coloring material, there is no need to increase the thickness of the coloring material-receiving layer for increasing an ink density or for causing the layer to receive a large amount of the ink. Accordingly, the thickness of the transfer material, and by extension, the entire thickness of a recorded matter can be reduced.

[1-1-1] Inorganic Fine Particles:

The inorganic fine particles are fine particles formed of an inorganic material. The inorganic fine particles have a function of forming a gap configured to receive a coloring material in the coloring material-receiving layer.

The kind of the inorganic material forming the inorganic fine particles is not particularly limited. However, an inorganic material that has a high ink-absorbing ability, is excellent in color developability, and is capable of forming a high-quality image is preferred. Examples thereof can include calcium carbonate, magnesium carbonate, kaolin, clay, talc, hydrotalcite, aluminum silicate, calcium silicate, magnesium silicate, diatomaceous earth, alumina, colloidal alumina, aluminum hydroxide, a hydrated alumina having a boehmite structure, a hydrated alumina having a pseudoboehmite structure, lithopone (a mixture of barium sulfate and zinc sulfate), and zeolite.

Of the inorganic fine particles formed of those inorganic materials, alumina fine particles formed of at least one kind of substance selected from the group consisting of alumina and a hydrated alumina are preferred. Examples of the hydrated alumina can include a hydrated alumina having a boehmite structure and a hydrated alumina having a pseudoboehmite structure. Alumina, the hydrated alumina having a boehmite structure, or the hydrated alumina having a pseudoboehmite structure is preferred because any such material can improve the transparency of the coloring material-receiving layer and the recording density of an image.

The hydrated alumina having a boehmite structure can be obtained by adding an acid to a long-chain aluminum alkoxide to perform hydrolysis and peptization (see Japanese Patent Application Laid-Open No. S56-120508). Any one of an organic acid and an inorganic acid may be used in the peptization. However, nitric acid is preferably used. The use of nitric acid can improve the reaction efficiency of the hydrolysis, can provide a hydrated alumina having a controlled shape, and can provide a dispersion liquid having good dispersibility.

The average particle diameter of the inorganic fine particles is preferably from 120 nm to 200 nm. Setting the average particle diameter to preferably 120 nm or more, more preferably 140 nm or more can improve the ink absorbability of the coloring material-receiving layer, and hence can suppress the bleeding and beading of the ink in an image after its recording. Meanwhile, setting the average particle diameter to preferably 200 nm or less, more preferably 170 nm or less can suppress light scattering due to the inorganic fine particles, and hence can improve the glossiness and transparency of the coloring material-receiving layer. In addition, the setting can increase the number of the inorganic fine particles per unit area of the coloring material-receiving layer, and hence can improve the ink absorbability. Therefore, the setting can increase the recording density of the image and can suppress the lack of luster of the image after the recording.

As the inorganic fine particles, known inorganic fine particles may be used as they are, or the known inorganic fine particles whose average particle diameter and polydispersity index have been adjusted with a pulverization dispersing machine or the like may be used. The kind of the pulverization dispersing machine is not particularly limited. For example, a conventionally known pulverization dispersing machine, such as a high-pressure homogenizer, an ultrasonic homogenizer, a wet media-type pulverizer (a sand mill or a ball mill), a continuous high-speed stirring-type dispersing machine, or an ultrasonic dispersing machine, can be used.

More specific examples of the pulverization dispersing machine can include: Manton-Gaulin homogenizer and Sonolator (each of which is manufactured by Doyei Shoji Co., Ltd.); Microfluidizer (manufactured by MIZUHO INDUSTRIAL Co., Ltd.); Nanomizer (manufactured by Tsukishima Kikai Co., Ltd.); Ultimaizer (manufactured by ITOCHU MACHINE-TECHNOS CORPORATION); PEARL MILL, GRAIN MILL, and TORNADO (each of which is manufactured by ASADA IRON WORKS Co., Ltd.); Visco Mill (manufactured by AIMEX Co., Ltd.); MIGHTY MILL, RS MILL, and SΓ MILL (each of which is manufactured by INOUE MFG., INC.); Ebara Milder (manufactured by EBARA CORPORATION); and FINE FLOW MILL and CAVITRON (each of which is manufactured by Pacific Machinery & Engineering Co., Ltd.), all of which are trade names.

In addition, the inorganic fine particles preferably satisfy the range of the average particle diameter and have a polydispersity index ($\mu/\langle\Gamma\rangle^2$) of from 0.01 to 0.20, and the inorganic fine particles more preferably have a polydispersity index of from 0.01 to 0.18. Setting the index within the range can keep the sizes of the particles constant, and hence can improve the glossiness and transparency of the coloring material-receiving layer. Therefore, the setting can increase the recording density of an image and can suppress the lack of luster of the image after its recording.

The average particle diameter and polydispersity index as used herein can be determined by analyzing values measured by a dynamic light scattering method by a cumulant method described in the "Structure of Polymer (2) Scattering Experiment and Morphological Observation Chapter 1 Light Scattering" (KYORITSU SHUPPAN Co., Ltd., edited by The Society of Polymer Science, Japan) or J. Chem. Phys., 70(B), 15 Apl., 3965 (1979). According to the theory of dynamic light scattering, when fine particles having different particle diameters are mixed, the attenuation of a time correlation function from scattered light has a distribution. The average ($<\Gamma>$) and variance ($\mu$) of an attenuation rate are determined by analyzing the time correlation function by the cumulant method. The attenuation rate ($\Gamma$) is represented by a function of the diffusion coefficients and scattering vectors of the particles, and hence their hydrodynamic average particle diameter can be determined by using Stokes-Einstein's equation. Therefore, the polydispersity index ($\mu/<\Gamma>^2$) obtained by dividing the variance ($\mu$) of the attenuation rate by the square of its average ($<\Gamma>^2$) represents the extent to which the particle diameters vary, and means that the distribution of the particle diameters narrows as a value for the index approaches 0. The average particle diameter and polydispersity index defined in the present invention can be easily measured with, for example, a laser particle diameter analyzer PARIII (manufactured by Otsuka Electronics Co., Ltd.).

One kind of the inorganic fine particles can be used alone, or two or more kinds thereof can be used as a mixture. The term "two or more kinds" comprehends inorganic fine particles different from each other in material itself, and inorganic fine particles different from each other in characteristics, such as an average particle diameter and a polydispersity index.

[1-1-2] Water-Soluble Resin:

The water-soluble resin is a resin that completely mixes with water, or has a solubility in water of 1 (g/100 g) or more, at 25° C. The water-soluble resin functions as a binder for binding the inorganic fine particles.

The water-soluble resin is not particularly limited as long as the water-soluble resin satisfies the following expression (2). A $|\Delta SP|$ of 0.6 or more is not preferred because of the following reason: an intermolecular force between the water-soluble resin and the emulsion E1 weakens to reduce the adhesive property between the coloring material-receiving layer and the transparent sheet, and hence peeling occurs between the transparent sheet and the coloring material-receiving layer in a test, such as tape peeling. Setting the $|\Delta SP|$ within the range can strongly bond the transparent sheet and the coloring material-receiving layer with the intermolecular force between the water-soluble resin and the emulsion E1, and hence can improve the adhesive property between the transparent sheet and the coloring material-receiving layer.

$$0 \leq |\Delta SP| \leq 0.6 \quad (2)$$

Examples of the water-soluble resin can include: starch, gelatin, casein, and modified products thereof; a cellulose derivative, such as methylcellulose, carboxymethylcellulose, or hydroxyethylcellulose; polyvinyl alcohol (e.g., completely saponified, partially saponified, or low saponified polyvinyl alcohol) or modified products thereof (e.g., a cationically modified product, an anionically modified product, and a silanol-modified product); and resins, such as a urea-based resin, a melamine-based resin, an epoxy-based resin, an epichlorohydrin-based resin, a polyurethane-based resin, a polyethylene imine-based resin, a polyamide-based resin, a polyvinylpyrrolidone-based resin, a polyvinyl butyral-based resin, poly(meth)acrylic acid or a copolymer resin thereof, an acrylamide-based resin, a maleic anhydride-based copolymer resin, and a polyester-based resin.

Of the water-soluble resins, polyvinyl alcohol, in particular, saponified polyvinyl alcohol obtained by hydrolyzing (saponifying) polyvinyl acetate is preferred. The SP value of the polyvinyl alcohol is close to the SP values of PVC and PET-G. Therefore, when the water-soluble resin and the image support melt with heat at the time of the transfer, compatibility between the water-soluble resin and the image support improves, and hence the water-soluble resin is strongly bonded to the image support. The polyvinyl alcohol is particularly preferably used because when the PVC or the PET-G is used as the image support, the polyvinyl alcohol can improve the adhesive property (transfer performance) between the image support and the coloring material-receiving layer.

The coloring material-receiving layer is preferably formed of a composition containing polyvinyl alcohol having a saponification degree of from 70 mol % to 100 mol %. The saponification degree means the percentage of the number of moles of the hydroxyl groups of the polyvinyl alcohol with respect to the total number of moles of the acetic acid groups and hydroxyl groups thereof.

Setting the saponification degree to preferably 70 mol % or more, more preferably 86 mol % or more prevents the coloring material-receiving layer from becoming excessively hard and can impart moderate flexibility to the coloring material-receiving layer. Therefore, the foil-cutting property of the coloring material-receiving layer improves in the peeling step, and hence the occurrence of a burr in the end portion can be suppressed. In addition, the viscosity of a coating liquid containing the inorganic fine particles and the polyvinyl alcohol can be reduced. Therefore, the coating liquid is easily applied to the transparent sheet and hence the productivity of the transfer material can be improved. Meanwhile, setting the saponification degree to preferably 100 mol % or less, more preferably 90 mol % or less can impart a moderate hardness to the coloring material-receiving layer. Thus, the adhesive strength between the transparent sheet and the coloring material-receiving layer is improved, and hence the peeling of the coloring material-receiving layer from the transparent sheet due to an insufficient adhesive strength therebetween can be suppressed. In addition, the setting can impart moderate hydrophilicity to the coloring material-receiving layer and hence improves the absorbability of the ink. Therefore, a high-quality image can be recorded on the coloring material-receiving layer.

As the saponified polyvinyl alcohol that satisfies the range of the saponification degree, there can be given, for example, completely saponified polyvinyl alcohol (saponification degree: from 98 mol % to 99 mol %), partially saponified polyvinyl alcohol (saponification degree: from 87 mol % to 89 mol %), and low saponified polyvinyl alcohol (saponification degree: from 78 mol % to 82 mol %). Of those, partially saponified polyvinyl alcohol is preferred.

The coloring material-receiving layer is preferably formed of a composition containing polyvinyl alcohol having a weight-average polymerization degree of from 2,000 to 5,000.

Setting the weight-average polymerization degree to preferably 2,000 or more, more preferably 3,000 or more can impart moderate flexibility to the coloring material-receiving layer. Therefore, the foil-cutting property of the coloring material-receiving layer improves in the peeling step, and hence the occurrence of a burr in the end portion can be suppressed. Meanwhile, setting the weight-average polymerization degree to preferably 5,000 or less, more preferably 4,500 or less can impart a moderate hardness to the coloring material-receiving layer. Thus, the adhesive strength between the transparent sheet and the coloring material-receiving layer is improved, and hence the peeling of the coloring material-receiving layer from the transparent sheet due to an insufficient adhesive strength therebetween can be suppressed. In addition, the setting can reduce the viscosity of the coating liquid containing the inorganic fine particles and the polyvinyl alcohol. Therefore, the coating liquid can be easily applied to the transparent sheet and hence the productivity of the transfer material can be improved. In addition, the pores of the coloring material-receiving layer are prevented from being filled, and hence the opening states of the pores can be satisfactorily maintained and the absorbability of the ink improves. Therefore, a high-quality image can be recorded on the coloring material-receiving layer.

A value for the weight-average polymerization degree is calculated in conformity with a method described in JIS-K-6726.

One kind of the water-soluble resins can be used alone, or two or more kinds thereof can be used as a mixture. The term "two or more kinds" comprehends water-soluble resins different from each other in characteristics, such as a saponification degree and a weight-average polymerization degree.

The amount of the water-soluble resin is preferably set to from 3.3 parts by mass to 20 parts by mass with respect to 100 parts by mass of the inorganic fine particles. Setting the amount of the water-soluble resin to preferably 3.3 parts by mass or more, more preferably 5 parts by mass or more inhibits the occurrence of the cracking or dusting of the coloring material-receiving layer. Meanwhile, setting the amount of the water-soluble resin to preferably 20 parts by mass or less, more preferably 15 parts by mass or less improves the absorbability of the ink.

[1-1-3] Cationic Resin:

The cationic resin to be used has a cationic atomic group (such as a quaternary ammonium) in a molecule thereof. In addition, the weight-average molecular weight of the cationic resin is 15,000 or less. In addition, the cationic resin to be used not only has a SP value close to the SP value of a resin constituting the image support but also easily melts with heat upon thermal pressure bonding of the transfer material onto the image support, and accelerates electrostatic bonding therebetween. Accordingly, the adhesive property between the image support and the coloring material-receiving layer is additionally strengthened, and hence the adhesive property (transfer performance) between the image support and the coloring material-receiving layer can be improved. That is, the cationic resin electrostatically bonds to an ink that is in general negatively charged, and hence can fix the ink in the coloring material-receiving layer. However, in addition to the function, the cationic resin having a weight-average molecular weight of 15,000 or less (1) is selected to have a SP value close to that of the image support, and hence has a high affinity for the image support, and can improve the adhesive property between the image support and the coloring material-receiving layer at the time of the transfer. In addition, the cationic resin to be used (2) has a low melting point and easily melts with heat at the time of the transfer, and hence additionally strengthens the adhesive property between the image support and the coloring material-receiving layer. Further, the cationic resin to be used (3) has a small molecular weight, and hence many molecules of the resin can be added to the coloring material-receiving layer even when its addition amount to the coloring material-receiving layer is small. Accordingly, a cationic group capable of electrostatically bonding to the image support that is in general negatively charged can be caused to exist on the surface of the coloring material-receiving layer, and as a result, the adhesive property between the image support and the coloring material-receiving layer can be improved. Further, the resin (4) can improve the adhesive property of the coloring material-receiving layer with a resin dispersion pigment. That is, the SP value of the dispersing resin of the resin dispersion pigment is close to the SP value of the cationic resin to be used. Accordingly, when the cationic resin and the dispersing resin melt with the heat at the time of the transfer, compatibility between both the resins improves and hence the resin dispersion pigment is strongly bonded to the coloring material-receiving layer. (5) The cationic resin melts with the heat at the time of the transfer to be electrostatically bonded to an emulsion of the transparent sheet in a state of being compatible therewith. Then, the cationic resin is strongly bonded to the particulate emulsion E2 having a low adhesive force as well, and hence the adhesive property between the coloring material-receiving layer and the transparent sheet can be additionally improved. Thus, the transfer performance of the coloring material-receiving layer onto the image support improves. Therefore, the cationic resin to be used serves to improve the transfer performance of the coloring material-receiving layer onto the image support by virtue of the five effects.

For example, at least one kind of polymer selected from a polyallylamine (such as an allylamine-based polymer or a diallylamine-based polymer) and a urethane-based polymer is preferably used as such cationic resin. Of those, in particular, a low-molecular polyallylamine can be particularly preferably used because of, for example, the following reasons: (1) the polyallylamine has a melting point as low as around 80° C. and hence easily melts upon thermal pressure bonding of the transfer material onto the image support; and (2) the polyallylamine has a small molecular structure, and hence can cause many cationic groups to be present per unit area of the surface of the coloring material-receiving layer and can accelerate its electrostatic bonding to the image support.

It should be noted that the polyallylamine is preferably at least one kind of polyallylamine represented by the following general formula (3).

General Formula (3)

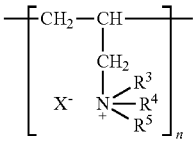

(In the formula: $R^3$, $R^4$, and $R^5$ each represent a hydrogen atom, an alkyl group, an alkenyl group, an alkanol group, an allylalkyl group, or an allylalkenyl group that may have a substituent, provided that $R^3$, $R^4$, and $R^5$ may be identical to or different from each other; $X^-$ represents an inorganic or organic anion; and n represents an integer, which indicates a polymerization degree.)

The weight-average molecular weight of the cationic resin is preferably from 1,000 to 15,000, more preferably from 1,000 to 10,000, particularly preferably from 1,000 to 5,000. Setting the average molecular weight within the range can improve the stability of the coating liquid. In addition, the number of the gaps of the coloring material-receiving layer hardly reduces and hence the absorbability of the coloring material can be maintained. Further, setting the average molecular weight of the cationic resin to 5,000 or less can distribute a larger number of cationic groups (that is, adsorption sites for performing the electrostatic bonding) on the surface of the coloring material-receiving layer to be brought into contact with the image support. Accordingly, the adhesive property (transfer performance) between the image support and the coloring material-receiving layer can be additionally improved. It should be noted that when the average molecular weight becomes larger than 15,000, the number of the cationic groups (that is, the adsorption sites for performing the electrostatic bonding) on the surface of the coloring material-receiving layer to be brought into contact with the image support reduces. Accordingly, the adhesive property (transfer performance) of the image support with the coloring material-receiving layer reduces. On the other hand, a weight-average molecular weight of less than 1,000 is not preferred because the cationic resin moves toward the inside of the coloring material-receiving layer together with the solvent of the ink at the time of printing, and hence the amount of the cationic groups distributed in the surface of the coloring material-receiving layer reduces.

The usage amount of the cationic resin is set to preferably 0.01 mass % or more and 5 mass % or less, more preferably 0.01 mass % or more and 3 mass % or less with respect to the inorganic fine particles (such as a hydrated alumina). When the usage amount of the cationic resin deviates from the range, the viscosity of the dispersion liquid of the inorganic fine particles or of the coating liquid obtained by adding the binder to the dispersion liquid increases, and hence the storage stability and applicability of the dispersion liquid or the coating liquid reduce in some cases.

The melting point of the cationic resin is preferably 60° C. or more and 160° C. or less. Setting the melting point of the cationic resin within the range can melt the cationic resin upon thermal pressure bonding of the transfer material onto the image support, and hence can improve the adhesive property (transfer performance) between the image support and the coloring material-receiving layer.

[1-1-4] Thickness:

The thickness of the coloring material-receiving layer is not particularly limited. However, the thickness of the coloring material-receiving layer is preferably from 5 μm to 40 μm. Setting the thickness of the coloring material-receiving layer to preferably 10 μm or more, more preferably 15 μm or more can secure the absorbability of the ink and the transparency of the coloring material-receiving layer. In addition, the setting improves the absorbability of the ink and the fixability of the ink. Meanwhile, setting the thickness of the coloring material-receiving layer to preferably 40 μm or less, more preferably 20 μm or less can improve the transparency of the coloring material-receiving layer. Further, the setting can improve heat conduction when thermal pressure bonding onto the image support, and hence can improve the adhesive property (transfer performance) between the image support and the coloring material-receiving layer. In addition, when a plastic card is used as the image support, the setting facilitates the reduction of the thickness of the entirety of the recorded matter to a total thickness of 0.84 mm, which is described in JIS 6301, or less.

[1-2] Transparent Sheet:

The transfer material of this embodiment includes the transparent sheet 52 like the transfer material 1 illustrated in FIG. 2.

[1-2-1] Emulsion:

The transparent sheet 52 of this embodiment contains the emulsion E1 and the emulsion E2. The emulsion E1 and the emulsion E2 are described in more detail below.

[1-2-2] State of Emulsion:

This embodiment is a state in which the emulsion E1 forms a film and at least the emulsion E2 remains as particles. In this embodiment, the "film-forming state" of an emulsion means a state in which the emulsion is subjected to a heat treatment at a temperature equal to or more than its glass transition temperature. Meanwhile, the "particle state" of an emulsion means a state in which the emulsion is not subjected to any heat treatment at a temperature equal to or more than its glass transition temperature. A drying temperature after the application of the emulsions is set to the glass transition temperature Tg1 of the emulsion E1 or more and less than the glass transition temperature Tg2 of the emulsion E2. Thus, a transparent sheet in which the emulsion E1 forms a film and at least the emulsion E2 remains as particles can be manufactured.

Thus, as illustrated in FIGS. 23A to 23C, the film states of the transparent sheet portion 980 of the portion 963 where the image support 55 and the coloring material-receiving layer are bonded to each other, and the transparent sheet portion 981 of the portion 964 where the image support and the coloring material-receiving layer are not bonded to each other can be controlled to differ from each other at the time of thermal pressure bonding. That is, at the time of the thermal pressure bonding, the heat of a heat roll is easily transferred to the transparent sheet portion 980, and hence a state in which part of the emulsion E2 turns into a film and part of its particles remain (FIG. 23B), or a state in which the emulsion E2 of the transparent sheet completely turns into a film (FIG. 23C) is established. At this time, a bonding force between the emulsion E2 that has partially or completely turned into a film and the emulsion E1 that has turned into a film in advance is strengthened, and hence the film strength of the transparent sheet can be strengthened. On the other hand, the heat of the heat roll is not transferred to the transparent sheet portion 981, and hence the emulsion E2 can be kept in a particle state. The film states of the transparent sheet portion 980 and the transparent sheet portion 981 differ from each other, and hence in the peeling step, a crack easily occurs with the boundary portion 982 as a starting point. As can be seen from the foregoing, the foil-cutting property can be improved by using the two kinds of emulsions and changing the film state of the emulsion E2 through the utilization of a temperature at the time of the thermal pressure bonding. It should be noted that when a heat treatment is performed at a temperature equal to or more than the Tg2 in a manufacturing process, both the emulsion E1 and the emulsion E2 are brought into states of turning into films to make it difficult for a crack to occur in the boundary portion 982 of transfer, and hence a sufficient cutting property of the end portion is not obtained. On the other hand, when a heat treatment is performed at a temperature equal to or less than the Tg1, both the emulsion E1 and the emulsion E2 are brought into particle states, and hence the transparent sheet cannot be formed.

[1-2-3] Glass Transition Temperature of Emulsion:

In this embodiment, a glass transition temperature (Tg) is such a temperature that when an amorphous solid is heated, the solid that is as hard as a crystal (has a large modulus of rigidity) and does not have flowability (its viscosity is too large to be measured) at low temperature is rapidly reduced in rigidity and viscosity in a certain narrow temperature range to be increased in flowability. The glass transition temperature Tg refers to a value calculated from Fox's equation based on the glass transition temperature (Tg) of a homopolymer of each monomer and the mass fraction (copolymerization ratio on a mass basis) of the monomer.

It should be noted that in this embodiment, the unit of a numerical value representing a glass transition temperature is "° C." unless otherwise stated. For example, the glass transition temperature of a copolymer formed of three kinds of monomers a, b, and c is determined as represented by the following expression (4).

$$1/Tg=Wa/Tga+Wb/Tgb+Wc/Tgc \quad (4)$$

Tga, Tgb, and Tgc: the glass transition temperatures of homopolymers of the respective monomers a, b, and c
W: the weight of each monomer
Tg: the glass transition temperature of the copolymer Values described in known materials are adopted as the Tg of homopolymers. In the technology disclosed herein, the following values are specifically used as the Tg of the homopolymers.

| | |
|---|---|
| 2-Ethylhexyl acrylate | −70° C. |
| n-Butyl acrylate | −55° C. |
| Ethyl acrylate | −22° C. |
| Methyl acrylate | 8° C. |
| Methyl methacrylate | 105° C. |
| Isobornyl acrylate | 94° C. |
| Isobornyl methacrylate | 180° C. |
| Vinyl acetate | 32° C. |
| 2-Hydroxyethyl acrylate | −15° C. |
| Styrene | 100° C. |
| Acrylic acid | 106° C. |
| Methacrylic acid | 130° C. |

A numerical value described in "Polymer Handbook" (third edition, John Wiley & Sons, Inc, 1989) is used as the Tg of each homopolymer except the ones listed above. When there is no description of Tg in "Polymer Handbook" (third edition, John Wiley & Sons, Inc, 1989), a value obtained by a measurement method described in Japanese Patent Application Laid-Open No. 2007-51271 is used.

[1-2-4] Emulsion E1:

In this embodiment, the emulsion E1 is in a film-forming state at the time of the formation of the transparent sheet. The film-forming state can be established by subjecting the emulsion E1 to a heat treatment at a temperature equal to or more than the glass transition temperature Tg1. Causing the emulsion E1 to form a film can increase an area of contact with the coloring material-receiving layer, improves the adhesive property between the transparent sheet and the coloring material-receiving layer, and can perform such control that peeling does not occur between the protective layer and the coloring material-receiving layer in a test, such as tape peeling.

[1-2-5] Tg of Emulsion E1:

The glass transition temperature Tg1 of the emulsion E1 is preferably more than 50° C. and less than 90° C. The Tg1 is more preferably more than 55° C. and less than 80° C., still more preferably more than 55° C. and less than 70° C. Setting the Tg1 to preferably more than 50° C., more preferably more than 55° C. increases the glass transition temperature of the emulsion E1 to harden the film portion of the transparent sheet, thereby making the portion hard to stretch. Thus, the film is suppressed in stretching at the time of the cutting of the end portion and the end portion can be kept beautiful, and hence the cutting property of the end portion improves. In addition, controlling the Tg1 within the range makes it hard for the resin to adapt to the oils and fats or sweat of a hand, and suppresses the stretching property of the film, thereby exhibiting the following effect: even when the hand is in contact with the transparent sheet, the transparent sheet is hardly brought into close contact with the hand and hence the stickiness of the transparent sheet is suppressed. Further, increasing the Tg1 strengthens a force acting between the molecular chains of the emulsion resin to make the emulsion hardly soluble in a chemical, such as an alcohol, and hence can significantly improve the chemical resistance of a recorded matter. Meanwhile, setting the Tg1 to preferably less than 90° C., more preferably less than 80° C., still more preferably less than 70° C. facilitates the performance of the film formation at the time of the formation of the transparent sheet, and hence can improve the adhesive property between the transparent sheet and the coloring material-receiving layer. Further, the setting alleviates the brittleness of the film and hence can prevent, for example, the peeling of the transparent sheet in a water resistance test. In addition, it is difficult to completely keep a drying temperature constant in terms of an actual manufacturing process, and hence the drying temperature varies to some extent. In the case where the drying temperature varies, when values for the Tg1 and the Tg2 are close to each other, excessive heat is applied at the time of an attempt to turn the emulsion E1 into a film, and hence the drying temperature may exceed the Tg2 to make it difficult to maintain the film state of the emulsion E1 and the particle state of the emulsion E2. Therefore, it is preferred that the Tg1 and the Tg2 satisfy a relationship represented by the following expression (5), and hence the Tg2 and the Tg1 differ from each other by about 10° C. because even when the drying temperature varies, no excessive heat is applied, and hence the film state of the emulsion E1 and the particle state of the emulsion E2 are easily maintained. When the Tg1 becomes 50° C. or less, the resin adapts to the oils and fats or sweat of the hand, and hence the stickiness occurs. In addition, when the transfer material is turned into a roll shape, blocking is liable to occur. When the Tg1 becomes 90° C. or more, it becomes difficult for the emulsion E1 to form a film, and hence the adhesive property between the transparent sheet and the coloring material-receiving layer reduces, and the peeling of the transparent sheet is liable to occur. Further, the film becomes brittle and hence the peeling of the transparent sheet in the water resistance test is liable to occur.

$$Tg2-Tg1\geq 10 \quad (5)$$

[1-2-6] SP Value of Emulsion E1:

In addition, in this embodiment, the absolute value of a difference ΔSP between the SP value of the emulsion E1 of the transparent sheet and the SP value of the water-soluble resin of the coloring material-receiving layer preferably satisfies the following expression (2). As their SP values become closer to each other, their compatibility improves, and hence the sheet and the layer show a higher adhesive property. Setting the absolute value within the range improves the compatibility of the emulsion E1 with the water-soluble resin, and shortens an intermolecular distance between the emulsion E1 that has turned into a film and the water-soluble resin. Accordingly, the setting increases an intermolecular force therebetween, improves the adhesive property between the transparent sheet and the coloring material-receiving layer, and can make it additionally difficult for peeling to occur between the protective layer and the coloring material-receiving layer in a test, such as tape peeling. A ASP of more than 0.6 is not preferred because of the following reason: the compatibility reduces, the intermolecular distance between the emulsion E1 that has turned into a film and the water-soluble resin lengthens, and the intermolecular force reduces, and hence a reduction in adhesive force occurs.

$$0\leq|\Delta SP|\leq 0.6 \quad (2)$$

A SP value is described. The SP value represents a solubility parameter and is also referred to as "Hildebrand parameter." The solubility parameter is used as a measure representing an intermolecular force because in a regular solution theory, it is hypothesized that a force acting between a solvent and a solute is the intermolecular force alone. An actual solution is not necessarily a regular solution, but it has been empirically known that as a difference in SP value between the two components becomes smaller, a solubility becomes larger.

In the regular solution theory, the following modeling has been performed: a force acting between a solvent and a solute is an intermolecular force alone. Accordingly, it can be assumed that an interaction for agglomerating liquid molecules is the intermolecular force alone. A cohesive energy ΔE of a liquid has a relationship of ΔH=ΔE+PΔV with its enthalpy of vaporization, and hence the solubility parameter is defined by the following expression (6) with its molar heat of vaporization ΔH and molar volume V. That is, the parameter is calculated from the square root $(cal/cm^3)^{1/2}$ of heat of vaporization required for 1 $cm^3$ of the liquid to vaporize.

$$\delta=\sqrt{(\Delta H-RT)/V} \quad (6)$$

It is rare that an actual solution is a regular solution. However, a force except an intermolecular force, such as a hydrogen bond, also acts between solvent and solute molecules, and hence whether the two components mix with each other or undergo phase separation is thermodynamically determined by a difference between the mixing enthalpy and mixing entropy of the components. Empirically, however, substances having close solubility parameters tend to easily mix with each other. Accordingly, the SP value also serves as a guideline on the judgment of the ease with which the solute and the solvent mix with each other. However, in the case of a plastic base material like this embodiment, compatibility depends on the polarity of each material to be used. As the polarity becomes higher, the compatibility becomes higher, and as the SP values each represented by the square root of a cohesive energy density (CED) representing a molecular bonding force become closer to each other, the compatibility becomes higher.

It should be noted that in this embodiment, the SP value is represented by the following general expression (7). Typical SP values are shown in Table 1. The SP values shown in Table 1 are transcribed from the SP values of various plastics described in "Plastic Processing Technology Handbook", Jun. 12, 1995, edited by The Society of Polymer Science, Japan, published by Nikkan Kogyo Shimbun, Ltd., p. 1474, Table 3.20.

$$(SP)^2=CEO=\Delta E/V=(\Delta H-RT)/V=d(CE)/M \quad (7)$$

[ΔE: vaporization energy (kcal/mol), V: molar volume ($cm^2$/mol), ΔH: vaporization energy (kcal/mol), R: gas constant, M: gram molecular weight (g/mol), T: absolute temperature (K), d: density ($g/cm^3$), CE: cohesive energy (kcal/mol)]

TABLE 1

| Abbreviation | Polymer name | SP (theoretical value) |
|---|---|---|
| PTFE | Polytetrafluoroethylene | 6.2 |
| PE | Polyethylene | 8.1 |
| PP | Polypropylene | 8.1 |
| PS | Polystyrene | 9.12 |
| PMMA | Polymethyl methacrylate | 9.25 |

TABLE 1-continued

| Abbreviation | Polymer name | SP (theoretical value) |
|---|---|---|
| PVAC | Polyvinyl acetate | 9.4 |
| PVC | Polyvinyl chloride | 9.6 |
| PC | Polycarbonate | 9.8 |
| PET | Polyethylene terephthalate | 10.7 |
| EP | Epoxy resin | 11.0 |
| POM | Polyacetal | 11.2 |
| PAN | Polyacrylonitrile | 12.75 |
| PA | Polyamide (nylon 66) | 13.6 |

(Method of Calculating Solubility Parameter (SP Value))

In this embodiment, the solubility parameter (SP value) of an acrylic polymer not described in the table is defined by the following expression (8) and can be determined through calculation based on Fedors' calculation method [see "Polymer Eng. & Sci.", Vol. 14, No. 2 (1974), p. 148-154] (where Δei represents a vaporization energy at 25° C. assigned to an atom or a group and Δvi represents a molar volume at 25° C.)

$$\delta=\left[\frac{\sum_i \Delta ei}{\sum_i \Delta vi}\right]^{1/2} \quad (8)$$

The Δei and the Δvi in the expression (8) show constant numerical values given to i atoms or groups in a main molecule. In addition, typical examples of numerical values for Δe and Δv given to an atom or a group are shown in Table 2 below.

TABLE 2

| Atom or group | Δe (J/mol) | Δv ($cm^3$/mol) |
|---|---|---|
| $CH_3$ | 4,086 | 33.5 |
| C | 1,465 | −19.2 |
| Phenyl | 31,940 | 71.4 |
| Phenylene | 31,940 | 52.4 |
| COOH | 27,628 | 28.5 |
| $CONH_2$ | 41,861 | 17.5 |
| $NH_2$ | 12,558 | 19.2 |
| —N= | 11,721 | 5.0 |
| CN | 25,535 | 24.0 |
| $NO_2$ (fatty acid) | 29,302 | 24.0 |
| $NO_3$ (aromatic) | 15,363 | 32.0 |
| O | 3,349 | 3.8 |
| OH | 29,805 | 10.0 |
| S | 14,149 | 12.0 |
| F | 4,186 | 18.0 |
| Cl | 11,553 | 24.0 |
| Br | 15,488 | 30.0 |

Next, a method of calculating the SP value of a copolymer is described. The SP value of the copolymer is calculated by using such an average method as represented by the following expression (9).

$$\text{Copolymer } \sigma^2=\varphi 1\sigma 1^2+\varphi 2\sigma 2^2 \quad (9)$$

φ: a volume fraction

σ: a solubility parameter

[1-2-7] Material for Emulsion E1:

A material for the emulsion E1 is preferably a resin, such as an acrylic resin, a vinyl acetate-based resin, a vinyl chloride-based resin, an ethylene/vinyl acetate-based resin, a polyamide resin, a polyester resin, a polyurethane resin, or a polyolefin resin, or a copolymer resin thereof. Of those, an acrylic resin is particularly preferably used because of the following reasons: the resin can be formed into a film at relatively low temperature; the transparency of an applied film thereof is high; and the resin has a SP value close to that of the saponified polyvinyl alcohol to be incorporated as the water-soluble resin, and hence can improve the adhesive property. Further, the acrylic resin is a relatively hard resin and exhibits the following effect: the resin suppresses the stretching property of the film to improve the cutting property of the end portion.

A (meth)acrylate alone or a copolymer using the (meth) acrylate can be used as the acrylic resin. Specific examples of the (meth)acrylate can include methyl (meth)acrylate, ethyl (meth)acrylate, isopropyl (meth) acrylate, n-butyl (meth) acrylate, n-hexyl (meth) acrylate, n-octyl (meth) acrylate, 2-ethylhexyl (meth)acrylate, isononyl (meth)acrylate, and lauryl (meth)acrylate. One kind of those (meth) acrylates can be used alone, or two or more kinds thereof can be used in combination. Further, those (meth)acrylates can be used through additional polymerization with a monomer that is copolymerizable therewith. Examples of such monomer, which are described in Japanese Patent Application Laid-Open No. 2002-121515, can include: unsaturated carboxylic acids, such as (meth)acrylic acid, crotonic acid, maleic acid, fumaric acid, and itaconic acid; monomers each having a hydroxyl group, such as hydroxylethyl (meth) acrylate, hydroxylpropyl (meth)acrylate, and hydroxylbutyl (meth)acrylate; monomers each having an alkoxy group, such as methoxyethyl (meth)acrylate and ethoxyethyl (meth)acrylate; monomers each having a glycidyl group, such as glycidyl (meth)acrylate and allyl glycidyl ether; monomers each having a nitrile group, such as (meth) acrylonitrile; monomers each having an aromatic ring, such as styrene, phenyl (meth)acrylate, and benzyl (meth)acrylate; monomers each having an amide group, such as (meth) acrylamide; monomers each having an N-alkoxy group or monomers each having an N-alkoxyalkyl group, such as N-methoxymethyl (meth) acrylamide and N-methoxyethyl (meth)acrylamide; monomers each having an N-alkylol group, such as N-methylol (meth)acrylamide and N-butylol (meth)acrylamide; monomers each having a group to which a halogen atom is bonded, such as vinyl chloride, vinyl bromide, allyl chloride, 2-chloroethyl (meth)acrylate, chloromethylstyrene, and vinyl fluoride; and olefin-based monomers, such as ethylene, propylene, and butadiene. The material described above can also be used through partial crosslinking by utilizing its reactive group.

The emulsion to be used in this embodiment can be synthesized by a generally well-known technology, and a commercial material can be used. The Tg of the resin to be used in the emulsion can be adjusted by changing a monomer component thereof and its ratio.

The emulsion E1 may be one kind of emulsion, or a blend of a plurality of kinds of emulsions may be used.

[1-2-8] Emulsion E2:

In this embodiment, the emulsion E2 is in a particle state at the time of the formation of the transparent sheet. The "particle state" can be established by maintaining the original particle state of the emulsion without applying any heat treatment at the glass transition temperature Tg2 of the emulsion E2 or more. Bringing the emulsion E2 into the particle state improves the cutting property of the end portion at the time of the transfer and hence can suppress the stickiness of the transparent sheet.

[1-2-9] Tg of Emulsion E2:

The glass transition temperature Tg2 of the emulsion E2 is preferably 90° C. or more and 120° C. or less, more preferably from 95° C. to 115° C., still more preferably from 100° C. to 110° C. Setting the glass transition temperature Tg2 of the emulsion E2 to preferably 90° C. or more, more preferably 95° C. or more, still more preferably 100° C. or more enlarges the difference in film strength between the emulsion that is incorporated into the transparent sheet portion 980 of the portion 963 where the image support 55 and the coloring material-receiving layer are bonded to each other, and that melts and softens with heat at the time of the heat transfer to be brought into a film state, and the emulsion in the particle state incorporated into the transparent sheet portion 981 of the portion 964 where the image support and the coloring material-receiving layer are not bonded to each other. Thus, a crack easily occurs in the boundary portion 982, and hence no burr occurs in the end portion and its foil-cutting property can be improved. Further, setting the Tg2 within the range makes it hard for the resin of the emulsion E2 to stretch and to adapt to the oils and fats, and sweat of a hand, and hence can prevent the stickiness of the transparent sheet. In addition, setting the Tg2 within the range reduces the solubility of the emulsion in a chemical, such as an alcohol, and hence improves its chemical resistance. In addition, setting the glass transition temperature Tg2 of the emulsion E2 to preferably 120° C. or less, more preferably 115° C. or less, still more preferably 110° C. or less can efficiently control a thermal energy in the thermal pressure bonding to a low energy, and hence can prevent the heat deformation of the image support due to the application of an excessive thermal energy thereto. In this embodiment, setting the glass transition temperature of the polyvinyl alcohol (PVA) serving as the water-soluble resin of the coloring material-receiving layer to about 90° C. or more can transfer the coloring material-receiving layer onto the image support. Accordingly, when the Tg2 falls within the temperature range, the coloring material-receiving layer is heated to about 90° C. at the time of the thermal pressure bonding of the coloring material-receiving layer onto the image support. In this process, the transparent sheet close to a heat roll side is heated to the Tg2 or more, and hence the emulsion E2 can be turned into a film and transferred without the application of an excessive thermal energy at the time of the transfer. When the Tg2 becomes less than 90° C., the emulsion is liable to adapt to the oils and fats or sweat of the hand, and hence the transparent sheet is liable to be sticky and its blocking is liable to occur. Further, a crack hardly occurs and hence the foil-cutting property reduces. In addition, when the Tg2 becomes less than 90° C., the emulsion is liable to dissolve in a chemical, such as an alcohol, and hence its protective performance against the chemical largely reduces. When the Tg2 becomes more than 120° C., a high energy is required as the thermal energy in the thermal pressure bonding, and hence the heat deformation of the image support due to the application of an excessive thermal energy thereto is liable to occur.

[1-2-10] Material for Emulsion E2:

The same polymer substance as that for the emulsion E1 can be used as a polymer substance constituting the emulsion E2 of this embodiment. However, an acrylic resin and a urethane-based resin are preferably used because a difference SP1 in SP value between the transparent sheet and the base material sheet can be controlled to 1.1 or more, and hence the peelability from the base material sheet improves. The emulsion E2 is particularly preferably the urethane-based resin. The urethane-based resin has moderate softness and hence suppresses the stickiness. Further, the resin alleviates the brittleness of the film and reduces its solubility in a chemical, and hence can improve the chemical resistance, and for example, even when it is immersed in a chemical, such as an alcohol, its cracking and peeling hardly occur. A resin of a kind different from that of the emulsion E1 is preferably used as the emulsion E2, and the use of resins of different kinds makes it difficult for the resins to be compatible with each other, and hence facilitates the maintenance of a state in which the film and particles coexist in a state before the transfer. When the acrylic resin is used as the emulsion E1, the emulsion E2 is particularly preferably the urethane-based resin.

Examples of the urethane-based resin can include urethane-based resins synthesized from various combinations of polyol compounds and diisocyanate compounds listed below by polyaddition reactions. The urethane-based resin is not particularly limited, but is preferably a polyether urethane-based resin synthesized from a polyether-based polyol compound and a diisocyanate compound. The polyether urethane-based resin improves the durability of the recorded matter including water resistance because the resin hardly hydrolyzes.

A diol containing two hydroxyl groups, or a polyol containing three or more hydroxyl groups can be used as the polyol compound without any particular limitation. For example, one kind of the following polyols may be used alone, or two or more kinds thereof may be used in combination: polyols such as polyether-based, polyester-based, polycarbonate-based, acrylic, polybutadiene-based, and polyolefin-based polyols; and polyols such as a caprolactone-modified polyol, a polyester amide polyol, a polyurethane polyol, an epoxy polyol, an epoxy-modified polyol, an alkyd-modified polyol, castor oil, and a fluorine-containing polyol.

Specific examples of the polyether-based polyol include: polyhydric alcohols, such as ethylene glycol, propylene glycol, butylene glycol, tetramethylene glycol, glycerin, trimethylolpropane, pentaerythritol, sorbitol, and sucrose; aliphatic amine compounds, such as ethylenediamine; aromatic amine compounds, such as toluenediamine and diphenylmethane-4,4-diamine; and polyols each obtained by subjecting a compound having at least two or more active hydrogen groups, such as an alkanolamine, e.g., ethanolamine or diethanolamine, which serves as a starting raw material, to addition with an alkylene oxide typified by ethylene oxide, propylene oxide, butylene oxide, or polyoxytetramethylene oxide.

Examples of the polyester-based polyol include: condensation polymers of at least one kind selected from ethylene glycol, propylene glycol, butanediol, pentanediol, hexanediol, glycerin, 1,1,1-trimethylolpropane, and other low-molecular polyols and at least one kind selected from glutaric acid, adipic acid, pimelic acid, suberic acid, sebacic acid, dimeric acid, and other low-molecular aliphatic carboxylic acids and oligomeric acids; and ring-opened polymers, such as propiolactone and valerolactone. As polyols except the polyether-based and polyester-based polyols, there are given, for example: a polymer polyol; a polycarbonate polyol; a polybutadiene polyol; a hydrogenated polybutadiene polyol; an acrylic polyol; and low-molecular polyols, such as ethylene glycol, diethylene glycol, propylene glycol, dipropylene glycol, butanediol, pentanediol, and hexanediol.

The diisocyanate compound can be used without any particular limitation. Examples of the diisocyanate compound may include methylene diisocyanate, ethylene diisocyanate, isophorone diisocyanate, hexamethylene diisocyanate, 1,4-cyclohexane diisocyanate, 2,4-toluene diisocyanate, 2,6-toluene diisocyanate, 1,3-xylylene diisocyanate, 1,5-naphthalene diisocyanate, m-phenylene diisocyanate, p-phenylene diisocyanate, 3,3'-dimethyl-4,4'-diphenylmethane diisocyanate, 3,3'-dimethylbiphenylene diisocyanate, 4,4'-biphenylene diisocyanate, dicyclohexylmethane diisocyanate, and methylenebis(4-cyclohexyl isocyanate).

[1-2-11] Average Particle Diameter of Emulsion E2:

The average particle diameter of the emulsion E2 is not particularly limited, but is preferably from 1 nm to 200 nm, more preferably from 5 nm to 150 nm, still more preferably from 10 nm to 50 nm. Setting the average particle diameter to preferably 1 nm or more, more preferably 5 nm or more, still more preferably 10 nm or more enlarges the difference in film strength between the emulsion that is incorporated into the transparent sheet portion 980 of the portion 963 where the image support 55 and the coloring material-receiving layer are bonded to each other, and that melts and softens with the heat at the time of the heat transfer to be brought into a film state, and the emulsion in the particle state incorporated into the transparent sheet portion 981 of the portion 964 where the image support and the coloring material-receiving layer are not bonded to each other. Thus, a crack easily occurs in the boundary portion 982, and hence no burr occurs in the end portion and its foil-cutting property can be improved. In the transfer material of this embodiment, the emulsion E2 is maintained in the particle state and hence the particle diameter of the emulsion E2 largely affects the transparency of the transparent sheet. Setting the average particle diameter of the emulsion E2 to preferably 200 nm or less, more preferably 150 nm or less, still more preferably 50 nm or less can improve the transparency of the transparent sheet. Further, when the average particle diameter is equal to or less than the foregoing value, a fine crack easily occurs and hence the cutting property of the end portion improves. When the average particle diameter of the emulsion E2 is less than 1 nm, their particles are so small that the transparent sheet is brought into a state close to a film, and hence a crack hardly occurs at the time of the transfer and the foil-cutting property reduces. When the average particle diameter of the emulsion E2 is more than 200 nm, the transparency reduces.

[1-2-12] Mixing Ratio between Emulsions E1 and E2:

The ratio (E1/E2) of the emulsion E1 to the emulsion E2 preferably satisfies the following expression (1), more preferably satisfies a relationship of $5.0 \leq E1/E2 \leq 50.0$, and still more preferably satisfies a relationship of $10.0 \leq E1/E2 \leq 35.0$. Setting the ratio E1/E2 to preferably 65.0 or less, more preferably 50.0 or less, still more preferably 35.0 or less increases the amount of the emulsion E2. As the amount of a particle component increases, the difference in film strength between the emulsion that is incorporated into the transparent sheet portion 980 of the portion 963 where the image support 55 and the coloring material-receiving layer are bonded to each other, and that melts and softens with the heat at the time of the heat transfer to be brought into the film state, and the emulsion in the particle state incorporated into the transparent sheet portion 981 of the portion 964 where the image support and the coloring material-receiving layer are not bonded to each other enlarges. Thus, a crack easily occurs in the boundary portion 982, and hence no burr occurs in the end portion and its foil-cutting property can be improved. Meanwhile, setting the ratio E1/E2 to preferably 3.0 or more, more preferably 5.0 or more, still more preferably 10.0 or more increases the amount of the emulsion E1. As the amount of a film-forming component increases, the film strength increases. Further, an area of contact with the coloring material-receiving layer increases, and hence the adhesive property between the coloring material-receiving layer and the transparent sheet can be improved. In particular, setting the ratio E1/E2 within the range of from 10.0 to 35.0 can achieve all of the adhesive property, the cutting property of the end portion, and the prevention of cracking at high levels. When the ratio E1/E2 becomes more than 65.0, the amount of the particle component reduces and the state is brought close to a film state, and hence a crack hardly occurs and the foil-cutting property is not obtained. In addition, when the ratio E1/E2 becomes less than 3.0, the amount of the emulsion E1 serving as a binder for the emulsion E2 reduces. Accordingly, the peeling or dusting of an emulsion of the transparent sheet may occur at the time of the formation of the coloring material-receiving layer, and the coloring material-receiving layer cannot be uniformly formed. Further, the amount of the film-forming component reduces, and hence the adhesive property with the coloring material-receiving layer reduces and the peeling of the transparent sheet is liable to occur.

$$3.0 \leq E1/E2 \leq 65.0 \quad (1)$$

In the case where the ratio (E1/E2) between the emulsions E1 and E2 becomes less than 10 (the ratio of the emulsion E2 becomes more than 9.1%), when emulsions are used in the transparent sheet of a transfer material including the transparent sheet and a coloring material-receiving layer, part of the emulsions are formed into a film, and the other part of the emulsions are brought into a particle state, the transparent sheet cannot resist shrinkage at the time of the drying of the coloring material-receiving layer upon application of the coloring material-receiving layer onto the transparent sheet, and hence the cracking of the transparent sheet may be liable to occur. The phenomenon is peculiar to the transfer material of a type including the coloring material-receiving layer, and occurs only when an aqueous coating liquid containing a water-soluble compound and inorganic fine particles is applied onto the transparent sheet. The phenomenon does not occur in a transfer material formed only of a base material and a protective layer. Particularly in the case of a transfer material to be preferably used in an inkjet system, its coloring material-receiving layer needs to be caused to absorb a large amount of an ink, and hence the thickness of the coloring material-receiving layer increases, and the coating weight and shrinkage amount at the time of the drying also increase in association with the increase. Accordingly, the cracking at the time of the application is liable to occur. Further, when the emulsion resin E1 having a glass transition temperature Tg1 of more than 50° C. is used as an emulsion that has turned into a film in the transparent sheet in consideration of the adhesive property, the foil-cutting property, the chemical resistance, and the prevention of the stickiness, the emulsion resin hardens and becomes hard to stretch. Thus, the cracking phenomenon tends to be extremely liable to occur owing to the shrinkage. In view of the foregoing, when the base material, the coloring material-receiving layer, and the transparent sheet are sequentially laminated, the transparent sheet contains the emulsions E1 and E2, the glass transition temperature Tg1 of the emulsion E1 that has turned into a film is more than 50° C., and the emulsion E2 is caused to remain as particles, it is important that the ratio between the emulsions E1 and E2 be precisely controlled.

In addition to the emulsion E1 and the emulsion E2, an emulsion may be added to the transparent sheet of this embodiment. For example, an emulsion having a glass transition temperature of more than 120° C. may be added. The addition of an emulsion having a higher glass transition temperature can reliably cause a proper amount of the particles to remain in the transparent sheet of the recorded matter even when transferring at high temperature. Thus, an area of contact between the base material and the transparent sheet reduces to improve its peelability from the base material, and hence its transferability can be improved. The addition of one more kind of emulsion in addition to the emulsions E1 and E2 increases the degree of freedom in selection of an emulsion in a film state or a particle state, and hence can impart any other function to the transparent sheet.

When the transparent sheet 52 of this embodiment is brought into abutment with the base material sheet, such a material that the difference SP1 between the SP value of the base material sheet and the SP value of the transparent sheet satisfies the following expression (10) is preferably selected. Causing the difference SP1 between the SP value of the base material sheet and the SP value of the layer of the transfer material to be brought into abutment with the base material sheet to satisfy the relationship represented by the following expression (10) leads to the lamination of the transparent sheet and the base material sheet in a state in which an adhesive property therebetween is relatively weak. Setting the difference within the range establishes a situation in which the base material sheet is easily peeled from the transparent sheet at the time of the transfer, and meanwhile, can additionally strengthen the adhesive property between the coloring material-receiving layer and the image support, and hence can improve the transferability at the time of the transfer.

$$1.1 \leq SP1 \leq 3 \quad (10)$$

In addition, when the transfer material of this embodiment is thermally pressure-bonded onto the image support and the base material sheet is peeled, the image recorded on the coloring material-receiving layer can be viewed as an original image through the transparent sheet. In addition, when the transfer material is thermally pressure-bonded onto the image support, the transparent sheet functions as a protective layer for the image recorded on the coloring material-receiving layer.

The transparent sheet means a sheet having a total light transmittance measured in conformity with JIS K 7375 of 50% or more, preferably 90% or more. Therefore, in addition to a colorless transparent sheet, for example, a semi-transparent sheet and a colored transparent sheet are included in the transparent sheet.

[1-2-13] Thickness:

The thickness of the transparent sheet is not particularly limited. However, the thickness of the transparent sheet layer is preferably from 1 μm to 40 μm, more preferably from 2 μm to 30 μm, still more preferably from 4 μm to 20 μm. Setting the thickness of the transparent sheet to preferably 1 μm or more, more preferably 2 μm or more, still more preferably 4 μm or more can secure the water resistance and scratch resistance of the transparent sheet. In addition, meanwhile, setting the thickness of the transparent sheet to preferably 40 μm or less, more preferably 30 μm or less, still more preferably pm or less can improve the transparency of the transparent sheet. Further, the setting can improve heat conduction at the time of the thermal pressure bonding, and hence can improve the adhesive property (transfer performance) between the transparent sheet and the coloring material-receiving layer. In addition, the setting is preferred because when a plastic card is used as the image support, the setting facilitates the reduction of the thickness of the entirety of the recorded matter to a total thickness of 0.84 mm, which is described in JIS 6301, or less.

It should be noted that when a dye ink is used as an ink for recording the image on the coloring material-receiving layer, the transparent sheet preferably contains a UV-cutting agent for preventing the decomposition (photodegradation) of a dye due to UV light. Examples of the UV-cutting agent can include: UV absorbers, such as a benzotriazole-based compound and a benzophenone-based compound; and UV-scattering agents, such as titanium oxide and zinc oxide.

[1-3] Base Material Sheet:

The transfer material of this embodiment includes the base material sheet 50 like the transfer material 1 illustrated in FIG. 2. The base material sheet (also referred to as "release liner" or "separator") is a sheet body serving as a support for a releasing layer or the coloring material-receiving layer.

With regard to, for example, a material for, and the shape of, the base material sheet, such a material that the difference SP1 between the SP value of the base material sheet and the SP value of the coloring material-receiving layer satisfies the expression (10) is preferred, and such base material sheet can be, for example, a resin film. For example, a resin film that has been utilized as the base material film of a conventional thermal transfer sheet can be utilized as it is.

Resin films formed of, for example, the following resins are preferred: polyester (such as PET), nylon (aliphatic polyamide), polyimide, cellulose acetate, cellophane, polyethylene, polypropylene, polystyrene, polycarbonate, polyvinyl alcohol, polyvinyl chloride, polyvinylidene chloride, chlorinated rubber, a fluororesin, and an ionomer. Of those, a PET film excellent in heat resistance is preferred. The case where polyvinyl alcohol is used as the water-soluble resin forming the coloring material-receiving layer and the PET film is used as the base material sheet is preferred because a difference between the SP value of the PET and the SP value of the polyvinyl alcohol or the cationic resin is relatively large, and hence a value for the SP1 can be enlarged. One kind of the resin films can be used alone, or two or more kinds thereof can be used as a composite or a laminate.

The thickness of the base material sheet only needs to be appropriately determined in consideration of, for example, its material strength, and is not particularly limited. However, the thickness of the base material sheet is preferably from 5 μm to 200 μm. When the thickness of the base material sheet is set to preferably 5 μm or more, more preferably 10 μm or more, upon lamination of the coloring material-receiving layer, the resultant laminate can be prevented from curling. When the transfer material has a roll shape, the thickness of the transfer material is preferably 15 μm or more in order to improve the conveyability of the transfer material on a manufacturing apparatus. When the transfer material has a cut sheet shape, the thickness of the transfer material is preferably 30 μm or more from the viewpoint of preventing the curling of the cut sheet.

Meanwhile, setting the thickness of the base material sheet to 200 μm or less, preferably 60 μm or less, more preferably 50 μm or less can improve heat transferability in the case of the thermal pressure bonding of the transfer material onto the image support.

Figure 3:
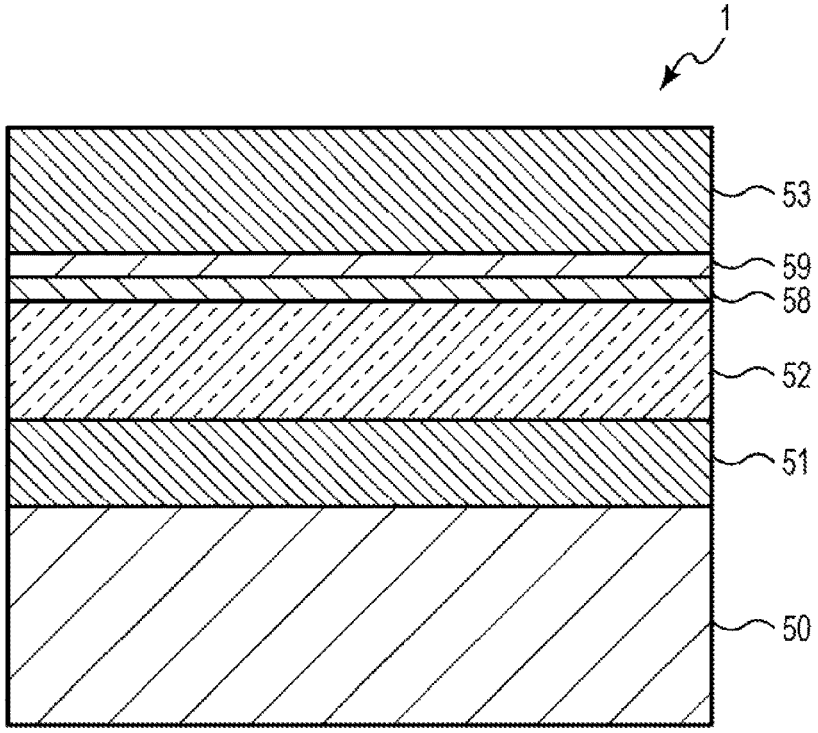
FIG. 3 is a sectional view for schematically illustrating another embodiment of the transfer material of the present invention.

[1-4] Releasing Layer:

The transfer material of this embodiment may include a releasing layer 51 like the transfer material 1 illustrated in FIG. 3. The releasing layer is a layer formed of a composition containing a release agent, and is arranged between the base material sheet 50 and the transparent sheet 52. When the transfer material includes the releasing layer 51, the base material sheet 50 can be easily peeled from the transparent sheet 52. The releasing layer is not particularly limited, but a releasing layer described in Japanese Patent Application Laid-Open No. 2015-110321 can be preferably used.

[1-5] Anchor Layer:

The transfer material of this embodiment may further include an anchor layer 59 like the transfer material 1 illustrated in FIG. 3. The anchor layer 59 is arranged between the transparent sheet 52 and the coloring material-receiving layer 53. When the transfer material includes the anchor layer, the adhesive property and adhesive strength between the transparent sheet and the coloring material-receiving layer can be improved, and hence the following inconvenience can be suppressed: the coloring material-receiving layer peels from the transparent sheet owing to an insufficient adhesive strength therebetween. The anchor layer is not particularly limited, but an anchor layer described in Japanese Patent Application Laid-Open No. 2015-110321 can be preferably used.

[1-6] Hologram Layer:

The transfer material of this embodiment may further include a hologram layer 58 like the transfer material 1 illustrated in FIG. 3. The hologram layer 58 is a layer having recorded thereon a three-dimensional image, and is arranged between the transparent sheet 52 and the coloring material-receiving layer 53. When the transfer material includes the hologram layer, a preventing effect on the forgery of a recorded matter (such as a credit card) is imparted to the transfer material. The hologram layer is not particularly limited and a conventionally known hologram layer can be adopted. For example, a hologram layer described in Japanese Patent Application Laid-Open No. 2015-110321 can be preferably used.

[1-7] Laminated Structure:

The transfer material of this embodiment has a laminated structure in which the base material sheet 50, the transparent sheet 52, and the coloring material-receiving layer 53 are laminated in the stated order like the transfer material 1 illustrated in FIG. 2. The phrase "the base material sheet, the transparent sheet, and the coloring material-receiving layer are laminated in the stated order" means that the base material sheet, the transparent sheet, and the coloring material-receiving layer are laminated in accordance with the stated order irrespective of whether or not any other layer is interposed between the base material sheet and the transparent sheet or between the transparent sheet and the coloring material-receiving layer. That is, a structure in which the anchor layer 59 or the hologram layer 58 is present between the transparent sheet 52 and the coloring material-receiving layer 53 like the transfer material 1 illustrated in FIG. 3 is also included in the laminated structure in which "the base material sheet, the transparent sheet, and the coloring material-receiving layer are laminated in the stated order."

However, the transfer material of this embodiment preferably has a laminated structure in which the base material sheet 50, the transparent sheet 52, and the coloring material-receiving layer 53 are brought into abutment with one another like the transfer material 1 illustrated in FIG. 2. That is, a structure in which no other layers (including sheets) are interposed between the base material sheet 50 and the transparent sheet 52, and between the transparent sheet 52 and the coloring material-receiving layer 53 is preferred. This is because of the following reason. There are strict limitations on the thicknesses of a credit card and the like each serving as an object of the recorded matter. Accordingly, the recorded matter is desirably thinned by reducing the number of layers or sheets to be laminated. In particular, the adhesive strength between the transparent sheet and the coloring material-receiving layer is significantly improved by precisely adjusting the weight-average polymerization degree and saponification degree of the polyvinyl alcohol in the coloring material-receiving layer, and hence there is no need to form the releasing layer or the anchor layer. Such construction has an advantage in that the transfer material, and by extension, the recorded matter can be thinned.

When the transfer material of this embodiment further includes the releasing layer 51, the anchor layer 59, or the hologram layer 58 like the transfer material 1 illustrated in FIG. 3, the transfer material preferably has a laminated structure in which the coloring material-receiving layer 53, the anchor layer 59, the hologram layer 58, the transparent sheet 52, the releasing layer 51, and the base material sheet 50 are laminated in the stated order.

[1-8] Shape and Thickness of Transfer Material:

In this embodiment, the transfer material may have a roll shape or a sheet shape (cut sheet shape) in accordance with the structure of an image-recording apparatus or an apparatus for manufacturing the recorded matter. When the transfer material has a roll shape, the coloring material-receiving layer may be arranged on an outer side or an inner side. However, the transfer material is preferably an outside-front roll-shaped transfer material rolled into a roll shape in which the coloring material-receiving layer is arranged on the outer side and the base material sheet is arranged on the inner side in order that the transfer material may be optimized for the conveying mechanism of the image-recording apparatus. Meanwhile, the transfer material is preferably an inside-front roll-shaped transfer material rolled into a roll shape in which the coloring material-receiving layer is arranged on the inner side and the base material sheet is arranged on the outer side in order that dirt may be prevented from adhering to the coloring material-receiving layer. The outside-front and the inside-front can each be properly used in accordance with applications.

In this embodiment, the thickness of the base material sheet is preferably from 1.5 times to 5 times as large as the thickness of the coloring material-receiving layer. Setting the former thickness to a value 1.5 times or more as large as the latter thickness can prevent the transfer material of a sheet shape (cut sheet shape) from curling, and hence can improve the conveyability of the transfer material in the image-recording apparatus or the apparatus for manufacturing the recorded matter. Meanwhile, setting the former thickness to a value 5 times or less as large as the latter thickness can improve the heat transferability upon thermal pressure bonding of the transfer material onto the image support.

The transfer material of this embodiment may be of a hot peeling type or may be of a cold peeling type. The hot peeling-type transfer material has the following characteristic: after the image support and the transfer material have been thermally pressure-bonded, it is optimum to peel the base material sheet in a state in which the temperature of a laminate of both the members is high. On the other hand, the cold peeling-type transfer material has the following characteristic: after the image support and the transfer material have been thermally pressure-bonded, it is optimum to peel the base material sheet in a state in which the temperature of the laminate of both the members is reduced.

The hot peeling-type transfer material is excellent in terms of productivity because the base material sheet can be peeled immediately after the transfer material has been thermally pressure-bonded onto the image support. For example, the productivity can be improved by using the roll-shaped transfer material and peeling the base material sheet by a roll-to-roll process. On the other hand, in the cold peeling-type transfer material, the base material sheet can be peeled even after the temperature of the laminate of the image support and the transfer material obtained by thermally pressure-bonding both the members has reduced. Therefore, for example, when the transfer material having a sheet shape (cut sheet shape) is used, the transfer material is preferably the cold peeling-type transfer material because handling upon peeling of the base material sheet after the thermal pressure bonding of the image support and the transfer material becomes easy.

[1-9] Manufacturing Method:

The transfer material of this embodiment can be manufactured by, for example, applying a coating liquid for a transparent sheet in which the emulsion E1 and the emulsion E2 mix with each other to the base material sheet, drying (heating) the liquid to produce a laminate in which the transparent sheet is laminated on the base material sheet in a state in which the emulsion E1 in the transparent sheet forms a film and in a state in which the emulsion E2 therein remains as particles, and applying a coating liquid containing the inorganic fine particles, the water-soluble resin, and the cationic resin to the laminate in which the base material sheet and the transparent sheet are laminated in the stated order. It should be noted that in the following description, a matter that has already been described in, for example, the section of the transfer material is omitted, and only a matter intrinsic to the manufacturing method is described.

[1-9-1] Transparent Sheet:

The transparent sheet is obtained by: preparing the coating liquid for a transparent sheet in which the emulsion E1 and the emulsion E2 mix with each other; applying the liquid to the surface of the base material sheet; and drying (heating) the liquid to form the transparent sheet.

An aqueous medium is preferably used as a medium for the coating liquid. Examples of the aqueous medium can include: water; and a mixed solvent of water and a water-soluble organic solvent. Examples of the water-soluble organic solvent can include: alcohols, such as methanol, ethanol, and propanol; lower alkyl ethers of polyhydric alcohols, such as ethylene glycol monomethyl ether and ethylene glycol dimethyl ether; ketones, such as acetone and methyl ethyl ketone; and ethers, such as tetrahydrofuran.

Various additives can each be incorporated into the coating liquid for a transparent sheet to the extent that the effects of the present invention are not impaired.

[1-9-1-1] Application:

The transparent sheet can be formed by applying a coating liquid containing an emulsion by a roll coating method, a rod bar coating method, a spray coating method, an air knife coating method, a slot die coating method, or the like, and drying the liquid.

The coating weight of the coating liquid for a transparent sheet is set to preferably from 1 $g/m^2$ to 40 $g/m^2$, more preferably from 2 $g/m^2$ to 30 $g/m^2$, still more preferably from 4 $g/m^2$ to 20 $g/m^2$ in terms of a solid content. Setting the coating weight to preferably 1 $g/m^2$ or more, more preferably 2 $g/m^2$ or more, still more preferably 4 $g/m^2$ or more can secure the water resistance and scratch resistance of the transparent sheet. Meanwhile, setting the coating weight to preferably 40 $g/m^2$ or less, more preferably 30 $g/m^2$ or less, still more preferably 20 $g/m^2$ or less can improve the transparency of the transparent sheet. Further, the setting can improve heat conduction at the time of the thermal pressure bonding, and hence can improve the adhesive property (transfer performance) between the transparent sheet and the coloring material-receiving layer. In addition, the setting is preferred because when a plastic card is used as the image support, the setting facilitates the reduction of the thickness of the entirety of the recorded matter to a total thickness of 0.84 mm, which is described in JIS 6301, or less.

[1-9-1-2] Drying at Time of Formation of Transparent Sheet:

This embodiment includes, at the time of the formation of the transparent sheet, a drying (heating) step for causing the emulsion E1 to be incorporated into the transparent sheet to form a film and bringing the emulsion E2 to be incorporated into the sheet into a particle state.

Setting a drying temperature at the time of the formation of the transparent sheet to the glass transition temperature Tg1 of the emulsion E1 or more and less than the glass transition temperature Tg2 of the emulsion E2 can produce a transparent sheet in which the emulsion E1 forms a film and the emulsion E2 remains as particles. In a state in which the emulsion E1 forms the film and the emulsion E2 remains as the particles, the difference in film strength between the emulsion that is incorporated into the transparent sheet portion 980 of the portion 963 where the image support 55 and the coloring material-receiving layer are bonded to each other, and that melts and softens with the heat at the time of the heat transfer to be brought into the film state, and the emulsion in the particle state incorporated into the transparent sheet portion 981 of the portion 964 where the image support and the coloring material-receiving layer are not bonded to each other enlarges at the time of transfer and peeling while the film strength is maintained. Thus, a crack easily occurs in the boundary portion 982, and hence the cutting property of the end portion and the adhesive property improve, and the peeling of the transparent sheet at the time of its immersion in an alcohol or the like hardly occurs. Further, when the particles remain, an area of contact at the time of the contact of a finger with the transparent sheet reduces, and hence the stickiness hardly occurs. When heating and drying at a temperature equal to or more than the Tg2 at the time of the formation of the transparent sheet, both the emulsions E1 and E2 are brought into states of forming films, and hence a crack hardly occurs in the end portion at the time of the transfer and a sufficient cutting property is not obtained. In addition, when both the emulsions E1 and E2 are in the states of forming the films, the peelability from the base material sheet deteriorates. On the other hand, when the heating is performed at a temperature less than the Tg1 at the time of the formation of the transparent sheet, both the emulsion E1 and the emulsion E2 are brought into particle states, and hence a film is hardly formed. In addition, even when the film can be formed, its smoothness reduces and hence its sufficient adhesive property with the coloring material-receiving layer is not obtained. Moreover, the strength of the transparent sheet significantly reduces, and hence its peeling or the like at the time of its immersion in a chemical or the like is liable to occur. The drying temperature at the time of the formation of the transparent sheet is preferably as high as possible within the range in terms of productivity because when the drying temperature at the time of the formation of the transparent sheet is high, applying speed can be increased.

[1-9-1-3] Others:

A base material sheet may be subjected to surface modification in advance. The performance of the surface modification for roughening the surface of the base material sheet improves the wettability of the base material sheet, and hence can improve its adhesive property with the transparent sheet in some cases. A method for the surface modification is not particularly limited. Examples thereof can include: a method involving subjecting the surface of the base material sheet to a corona discharge process or a plasma discharge process in advance; and a method involving applying an organic solvent, such as IPA or acetone, to the surface of the base material sheet. Any such surface treatment improves the binding property between the base material sheet and the transparent sheet to improve the strength, and hence can prevent such an inconvenience that the transparent sheet peels from the base material sheet.

In addition, the transparent sheet may be used in the state of a laminate with any other layer or sheet. For example, a laminated sheet in which the anchor layer, the transparent sheet, the releasing layer formed of a composition containing a release agent, and the base material sheet are sequentially laminated may be used.

The releasing layer can be formed by: applying a coating liquid containing a resin or a wax forming the releasing layer to, for example, a resin film forming the base material sheet; and drying the liquid. As an application method, there can be given conventionally known application methods, such as a gravure recording method, a screen recording method, and a reverse roll coating method involving using a gravure plate.

The laminate in which the base material sheet and the transparent sheet are laminated may be subjected to surface modification in advance. The performance of surface modification for roughening the surface of the transparent sheet improves the wettability of the transparent sheet, and hence can improve its adhesive property with the coloring material-receiving layer or the anchor layer in some cases. A method for the surface modification is not particularly limited. Examples thereof can include: a method involving subjecting the surface of the transparent sheet to a corona discharge treatment or a plasma discharge treatment in advance; and a method involving applying an organic solvent, such as IPA or acetone, to the surface of the transparent sheet. Any such surface treatment improves a binding property between the coloring material-receiving layer and the transparent sheet to improve the strength, and hence can prevent such an inconvenience that the coloring material-receiving layer peels from the transparent sheet.

[1-9-2] Coloring Material-Receiving Layer:

The coloring material-receiving layer is obtained by: mixing at least the inorganic fine particles, the water-soluble resin, and the cationic resin with a proper medium to prepare a coating liquid for a coloring material-receiving layer; applying the liquid to the surface of the transparent sheet; and drying the liquid to form the coloring material-receiving layer.

An aqueous medium is preferably used as a medium for the coating liquid. Examples of the aqueous medium can include: water; and a mixed solvent of water and a water-soluble organic solvent. Examples of the water-soluble organic solvent can include: alcohols, such as methanol, ethanol, and propanol; lower alkyl ethers of polyhydric alcohols, such as ethylene glycol monomethyl ether and ethylene glycol dimethyl ether; ketones, such as acetone and methyl ethyl ketone; and ethers, such as tetrahydrofuran.

A coating liquid further containing a thermofusible resin is preferably used as the coating liquid. A material to be listed in the section of the primer layer, in particular, a thermoplastic resin having a glass transition temperature of from 60° C. to 160° C. is preferably used as the thermofusible resin. In addition, a polyolefin resin or the like is preferably incorporated into the coating liquid for improving the wettability of the coating liquid and improving its binding property. Of the polyolefin resins, polyethylene is preferably incorporated. Examples of the polyethylene can include low-density polyethylene (LDPE) and high-density polyethylene (HDPE). However, linear low-density polyethylene (LLDPE), polypropylene, or the like can also be used.

Various additives can each be incorporated into the coating liquid as long as the effects of the present invention are not impaired. When a dye ink is used as the ink with which the reverse image is recorded, a dye-sticking agent is preferably incorporated. The dye-sticking agent bonds to an anionic group of a dye molecule to form a salt, thereby making the dye insoluble in water. Thus, the migration of the dye can be prevented.

Examples of the other additives can include a surfactant, a pigment dispersant, a thickener, an antifoaming agent, an ink-fixing agent, a dot adjustor, a colorant, a fluorescent brightening agent, an antioxidant, a UV absorber, an antiseptic, and a pH adjustor.

The concentration of the inorganic fine particles in the coating liquid only needs to be appropriately determined in consideration of, for example, the applicability of the coating liquid, and is not particularly limited. However, the concentration is preferably set to from 10 mass % to 30 mass % with respect to the total mass of the coating liquid.

[1-9-2-1] Application:

The coloring material-receiving layer is formed by, for example, applying the coating liquid to the surface of the transparent sheet constituting the laminate of the base material sheet and the transparent sheet. After the application, the coating liquid is dried as required. Thus, the transfer material 1 having such a laminated structure in which the base material sheet 50, the transparent sheet 52, and the coloring material-receiving layer 53 are laminated in the stated order as illustrated in FIG. 2 can be obtained.

When a laminated sheet in which the anchor layer, the transparent sheet, the releasing layer, and the base material sheet are laminated in the stated order is used, the coating liquid needs only to be applied to the surface of the anchor layer constituting the laminated sheet. Thus, the transfer material 1 having such a laminated structure in which the coloring material-receiving layer 53, the anchor layer 59, the transparent sheet 52, the releasing layer 51, and the base material sheet 50 are laminated in the stated order as illustrated in FIG. 3 can be obtained.

A conventionally known application method can be used as an application method. Examples thereof can include a blade coating method, an air knife coating method, a curtain coating method, a slot die coating method, a bar coating method, a gravure coating method, and a roll coating method.

The coating weight of the coating liquid for a coloring material-receiving layer is preferably set to from 10 $g/m^2$ to 40 $g/m^2$ in terms of a solid content. Setting the coating weight to preferably 10 $g/m^2$ or more, more preferably 15 $g/m^2$ or more enables the formation of a coloring material-receiving layer excellent in absorbability of water in the ink. Therefore, an inconvenience such as the flow of the ink in a recorded reverse image or the bleeding of the reverse image can be suppressed. Meanwhile, when the coating weight is set to preferably 40 $g/m^2$ or less, more preferably 20 $g/m^2$ or less, the curling of the transfer material hardly occurs upon drying of the applied layer. In addition, the thickness of the recorded matter to be finally formed can be reduced by reducing the thickness of the coloring material-receiving layer. When the image support is a plastic card, such as a credit card, it is effective to adopt the coating weight because the thickness of the card is strictly specified by Japanese Industrial Standards (JIS-X-6305).

[1-9-2-2] Drying at Time of Formation of Coloring Material-Receiving Layer:

When the drying step is provided at the time of the application of the coating liquid for a coloring material-receiving layer, a drying temperature needs to be set to less than the glass transition temperature Tg2 of the emulsion E2. The drying step at the time of the formation of the transparent sheet causes the emulsion E1 to form a film and brings the emulsion E2 into a particle state at the time of the application of the coating liquid for a coloring material-receiving layer. However, when the drying temperature at the time of the application for the coloring material-receiving layer becomes the Tg2 or more, the emulsion E2 forms a film, and hence both the emulsions E1 and E2 are brought into states of turning into films in the entirety of the transparent sheet. Accordingly, when the transfer material is transferred, a crack hardly occurs and hence the cutting property of the end portion reduces.

When the coating liquid for a coloring material-receiving layer is applied onto the transparent sheet, in the course of the drying and shrinkage of the coating liquid, the transparent sheet cannot completely resist the shrinkage and hence cracks in some cases. When the ratio E1/E2 serving as a ratio between the emulsion E1 and the emulsion E2 in the transparent sheet satisfies the following expression (1), the cracking can be prevented. The ratio (E1/E2) of the emulsion E1 to the emulsion E2 preferably satisfies the following expression (1), more preferably satisfies a relationship of $5.0 \leq E1/E2 \leq 50.0$, and still more preferably satisfies a relationship of $10.0 \leq E1/E2 \leq 35.0$. Setting the ratio E1/E2 to preferably 65.0 or less, more preferably 50.0 or less, still more preferably 35.0 or less increases the amount of the emulsion E2. As the amount of a particle component increases, the difference in film strength between the emulsion that is incorporated into the transparent sheet portion 980 of the portion 963 where the image support 55 and the coloring material-receiving layer are bonded to each other, and that melts and softens with the heat at the time of the heat transfer to be brought into the film state, and the emulsion in the particle state incorporated into the transparent sheet portion 981 of the portion 964 where the image support and the coloring material-receiving layer are not bonded to each other enlarges. Thus, a crack easily occurs in the boundary portion 982, and hence no burr occurs in the end portion and its foil-cutting property can be improved. Meanwhile, setting the ratio E1/E2 to preferably 3.0 or more, more preferably 5.0 or more, still more preferably 10.0 or more increases the amount of the emulsion E1. As the amount of a film-forming component increases, the film strength increases. Further, an area of contact with the coloring material-receiving layer increases, and hence the adhesive property between the coloring material-receiving layer and the transparent sheet can be improved. In particular, setting the ratio E1/E2 within the range of from 10.0 to 35.0 can achieve all of the adhesive property, the cutting property of the end portion, and the prevention of the cracking at high levels. When the ratio E1/E2 becomes more than 65.0, the amount of the particle component reduces and the state is brought close to a film state, and hence a crack hardly occurs and the foil-cutting property is not obtained. In addition, when the ratio E1/E2 becomes less than 3.0, the amount of the emulsion E1 serving as a binder for the emulsion E2 reduces. Accordingly, the peeling or dusting of an emulsion of the transparent sheet may occur at the time of the formation of the coloring material-receiving layer, and the coloring material-receiving layer cannot be uniformly formed. Further, the amount of the film-forming component reduces, and hence the adhesive property with the coloring material-receiving layer reduces and the peeling of the transparent sheet is liable to occur.

$$3.0 \leq E1/E2 \leq 65.0 \quad (1)$$

Figure 4:
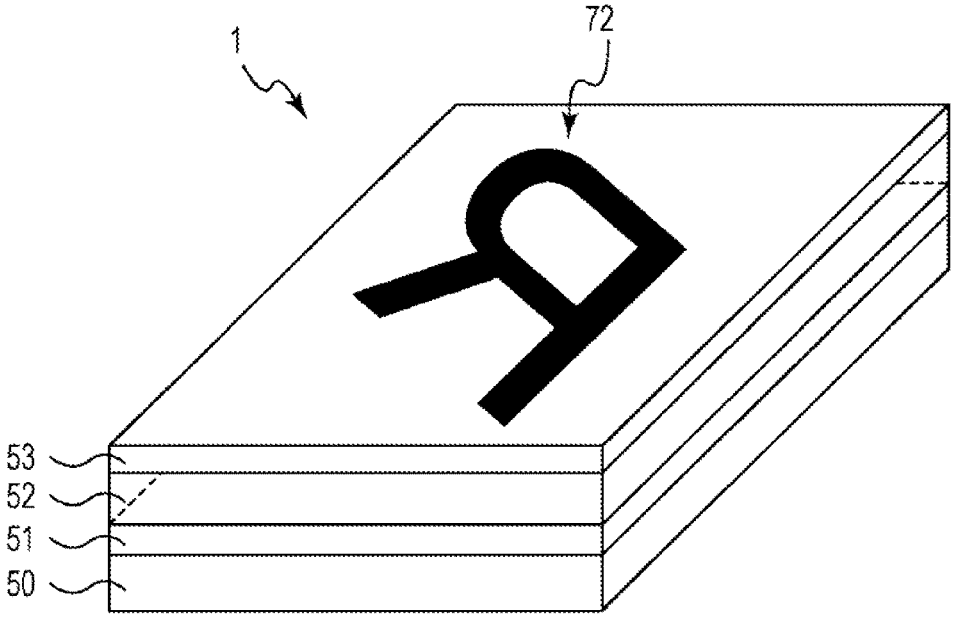
FIG. 4 is a perspective view for schematically illustrating one embodiment of the transfer material of the present invention.

[1-10] Image:

FIG. 4 is a perspective view for schematically illustrating the transfer material. The transfer material is preferably such that an image is formed on the coloring material-receiving layer. The reverse image 72 having the following characteristic is particularly preferably recorded on the coloring material-receiving layer 53 like the transfer material 1 illustrated in FIG. 4: the image becomes a mirror image when viewed from a side closer to the coloring material-receiving layer 53, and becomes a normal image when viewed from a side closer to the transparent sheet 52.

In the transfer material of this embodiment, the reverse image 72 is recorded on the surface of the coloring material-receiving layer 53 where the transparent sheet 52 is not laminated like the transfer material 1 illustrated in FIG. 4. In particular, an image recorded by an inkjet recording system can improve the productivity and information security of a recorded matter, and can reduce a recording cost as compared to a conventional heat transfer system.

In the transfer material of this embodiment, the image may be an image formed with a dye ink, or may be an image formed with a pigment ink. However, the image is preferably an image formed with the pigment ink. When the reverse image is formed with the pigment ink, water and a solvent in the ink hardly remain on the surface of the coloring material-receiving layer (i.e., drying becomes easy). Accordingly, a bonding failure between the image support and the transfer material (specifically the coloring material-receiving layer), and migration (movement of the ink) resulting from the water or the solvent can be effectively prevented. Further, the formation of the reverse image with the pigment ink can improve the light fastness of the reverse image.

Figure 5:
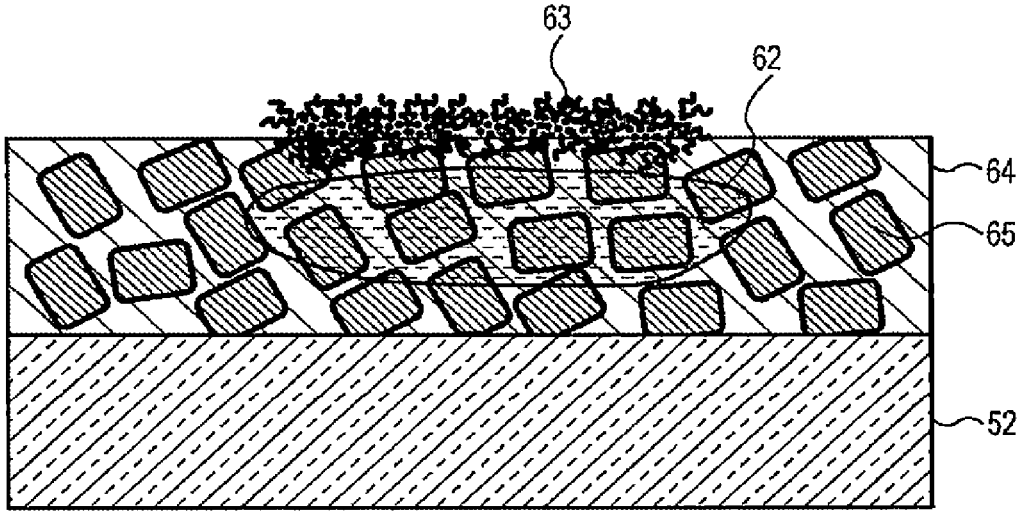
FIG. 5 is a sectional view for illustrating a state in which a pigment ink is fixed to a gap absorption-type coloring material-receiving layer.
Figure 6:
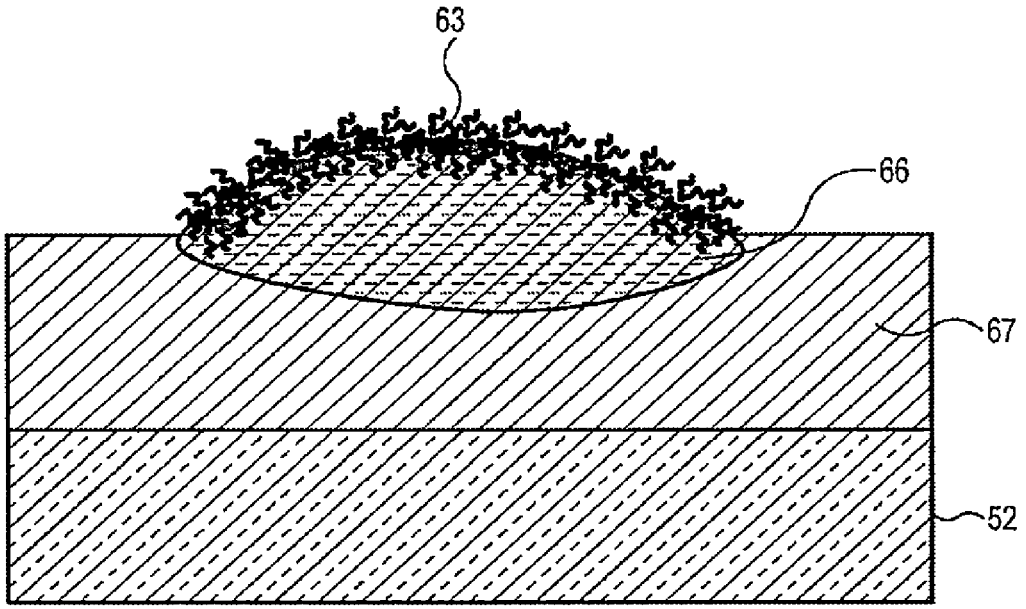
FIG. 6 is a sectional view for illustrating the swollen state of a swelling absorption-type coloring material-receiving layer after the fixation of the ink to the coloring material-receiving layer.

The foregoing contents are described in more detail. As illustrated in FIG. 5, the pigment ink has the following characteristic in a gap absorption-type coloring material-receiving layer 64: a pigment component 63 in the pigment ink has a large particle diameter. Accordingly, the pigment component 63 does not permeate the insides of pores formed of inorganic fine particles 65 forming the coloring material-receiving layer 64, but is fixed to the recording surface of the coloring material-receiving layer 64. Further, unlike a swelling absorption-type coloring material-receiving layer, the gap absorption-type coloring material-receiving layer 64 does not swell and hence the coloring material-receiving layer 64 is kept smooth. On the other hand, in the case of the swelling absorption-type coloring material-receiving layer, as illustrated in FIG. 6, a coloring material-receiving layer 67 swells owing to water in the ink, and hence unevenness occurs on the surface of the coloring material-receiving layer 67. Accordingly, its adhesive property with the image support reduces. In addition, the remaining water and solvent in the ink remain on the surface of the coloring material-receiving layer 66. Accordingly, there is a risk in that adhesiveness between the image support and the coloring material-receiving layer becomes insufficient owing to the vaporization of the remaining water and solvent in an adhering step, which is not preferred.

Figure 7:
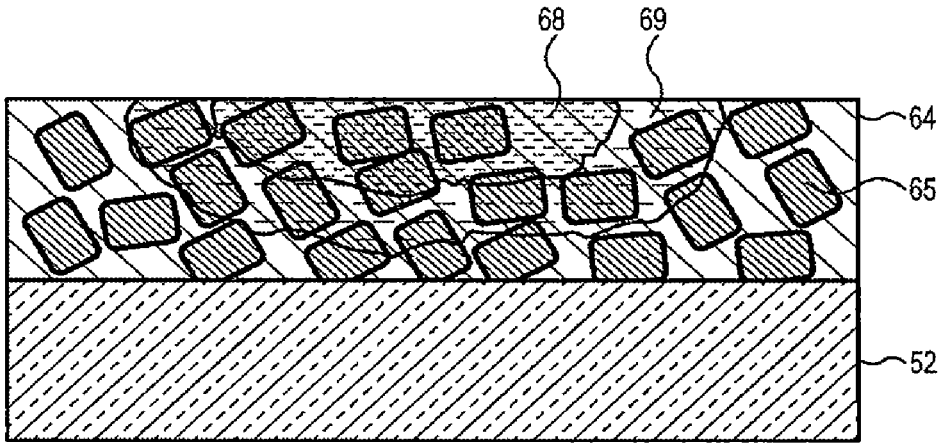
FIG. 7 is a sectional view for illustrating a state in which a dye ink migrates after the fixation of the dye ink to the gap absorption-type coloring material-receiving layer.

In addition, in the gap absorption-type coloring material-receiving layer 64, the pigment component 63 in the pigment ink is fixed to the surface of the coloring material-receiving layer 64. Meanwhile, a water and solvent component 62 in the ink permeate the inside of the coloring material-receiving layer 64 to undergo separation (solid-liquid separation) from the pigment component 63 on the surface. Thus, at the time of the transfer, the surface of the pigment is brought into a dry state, and hence the bonding failure due to the vaporization of the water is prevented, and the adhesive property can be improved. In addition, the remaining water and solvent component 62 remain in the coloring material-receiving layer 64, and hence the pigment component 63 is not brought into contact with the remaining water and solvent component 62 again. Accordingly, the movement (migration) of the ink can be prevented. On the other hand, in the dye ink, as illustrated in FIG. 7, a dye component 68 moves (migrates) like a dye component 69 owing to an influence of the remaining water, and hence bleeding occurs.

In addition, a self-dispersible pigment that can be dispersed in water without any dispersant by being subjected to a surface treatment for bonding at least one kind of functional group selected from a carbonyl group, a carboxyl group, a hydroxyl group, and a sulfone group, or a salt thereof, or a resin dispersion-type pigment component obtained by covering the peripheries of pigment particles with a resin can be used as the pigment component in the pigment ink. In particular, when the coloring material-receiving layer of the transfer material contains a cationic resin, the pigment particles that are in general negatively charged electrostatically bond to the cationic resin to strengthen an adhesive property between the coloring material-receiving layer and the pigment ink. It should be noted that the resin dispersion-type pigment obtained by covering the peripheries of the pigment particles with the resin is preferably used because it improves the transfer performance in comparison with the self-dispersible pigment. The use of the resin dispersion-type pigment can increase a binding force between the pigment particles after the separation of an ink medium. Thus, water on the surface of a pigment film is substantially blocked from the water of a lower layer in the coloring material-receiving layer by the pigment film, and water supply from the lower layer is brought into a state of being substantially blocked by the film. Therefore, when the amount of the water on the surface of the pigment film is small, it can be sufficiently dried by natural drying. In addition, an acrylic resin, such as a (meth)acrylate copolymer, is preferably used as the resin.

In addition, the SP value of the dispersing resin is close to the SP value of, for example, a polyvinyl alcohol serving as the water-soluble resin of the coloring material-receiving layer. Accordingly, when the dispersing resin and the water-soluble resin melt with heat at the time of the transfer, compatibility between both the resins improves and hence the resin dispersion-type pigment is strongly bonded to the coloring material-receiving layer. Accordingly, even when the surface of the recorded image is covered with the pigment film, the binding property with the coloring material-receiving layer can be improved. Further, the SP value of the dispersing resin is close to the SP values of, for example, the PVC and PET-G of the image support. Accordingly, when the dispersing resin and constituent components (e.g., the PVC and the PET-G) for the surface of the image support melt with the heat at the time of the transfer, compatibility between the resin and the components improves, and hence the resin dispersion-type pigment is strongly bonded to the image support. Thus, even when the surface of the recorded image on a side closer to the coloring material-receiving layer is covered with the pigment film, the binding property with the image support can be improved. Accordingly, the transfer performance of the coloring material-receiving layer onto the image support can be improved.

The resin for covering the peripheries of the pigment particles is preferably a (meth)acrylate-based copolymer having an acid value of from 100 mgKOH/g to 160 mgKOH/g. Setting the acid value to 100 mgKOH/g or more improves ejection stability in an inkjet recording system in which the ink is ejected by a thermal system. Meanwhile, setting the acid value to 160 mgKOH/g or less causes the resin to have hydrophobicity relative to the pigment particles, thereby improving the fixability and bleeding resistance of the ink. Therefore, the resin is suitable for the high-speed fixation and high-speed recording of the ink.

Herein, the acid value is the amount (mg) of KOH needed for neutralizing 1 g of a resin, and can be an indicator representing the hydrophilicity of the resin. It should be noted that the acid value in this case can be determined from a composition ratio between the respective monomers forming a resin dispersant by calculation. With regard to a specific method of measuring the acid value of a pigment dispersion, however, the acid value can be determined by potentiometric titration or can be measured with, for example, Titrino (manufactured by Metrohm).

A resin to be used in the pigment dispersion preferably has a dispersing function of satisfactorily dispersing a hydrophobic pigment in an aqueous liquid medium, and a random copolymer is used. A resin except the random copolymer, such as a block copolymer, is not preferred because the hydrophilicity of the pigment often becomes high and the water resistance of a printed image often becomes poor. An ordinary method, e.g., a method disclosed in Japanese Patent No. 4956917 can be used as a method of producing the resin to be used in the pigment dispersion. It should be noted that the respective components of the pigment ink and preferred ranges of their physical properties are described in, for example, Japanese Patent Application Laid-Open No. 2015-110321.

The pigment ink is the so-called aqueous pigment ink. In the aqueous pigment ink, the pigment is dispersed in a water-soluble medium. In addition, the aqueous pigment ink is of a type called a pigment-resin dispersion type, and is obtained by causing a (meth)acrylate-based copolymer having a random structure to adsorb to the surface and dispersing in an aqueous medium. With regard to its manufacturing method, the aqueous pigment ink can be obtained by an ordinary method, e.g., a method disclosed in Japanese Patent No. 4956917.

[1-10-1] Pigment:

Examples of the pigment can include carbon black and an organic pigment. One kind of the various pigments can be used alone, or two or more kinds thereof can be used in combination.

Specific examples of the carbon black include carbon black pigments, such as furnace black, lamp black, acetylene black, and channel black. For example, there can be used carbon black having brand names such as Raven (manufactured by Aditya Birla), Black Pearls L, Regal, Mogul L, Monarch, and Valcan (each of which is manufactured by Cabot Corporation), Color Black, Printex, and Special Black (each of which is manufactured by Evonik), and MITSUBISHI Carbon Black (manufactured by Mitsubishi Chemical Corporation) as trade names. As a matter of course, the pigment is not limited thereto and conventionally known carbon black can also be used. Carbon black having the following physical properties is preferred: a primary particle diameter of from 10 nm to 40 nm, a specific surface area by a BET method of from 50 $m^2/g$ to 400 $m^2/g$, a oil absorption of from 40 ml/100 g to 200 ml/100 g, a volatile content of from 0.5% to 10%, and a pH of from 2 to 9. It should be noted that the DBP absorption is measured by the JIS K 6221 A method.

Specific examples of the organic pigment can include: insoluble azo pigments, such as Toluidine Red, Toluidine Maroon, Hamza Yellow, Benzidine Yellow, and Pyrazolone Red; soluble azo pigments, such as Lithol Red, Helio Bordeaux, Pigment Scarlet, and Permanent Red 2B; derivatives of vat dyes, such as alizarin, indanthrone, and Thioindigo Maroon; phthalocyanine-based pigments, such as Phthalocyanine Blue and Phthalocyanine Green; quinacridone-based pigments, such as Quinacridone Red and Quinacridone Magenta; perylene-based pigments, such as Perylene Red and Perylene Scarlet; isoindolinone-based pigments, such as Isoindolinone Yellow and Isoindolinone Orange; imidazolone-based pigments, such as Benzimidazolone Yellow, Benzimidazolone Orange, and Benzimidazolone Red; pyranthrone-based pigments, such as Pyranthrone Red and Pyranthrone Orange; indigo-based pigments; condensed azo-based pigments; thioindigo-based pigments; and other pigments, such as Flavanthrone Yellow, Acylamide Yellow, Quinophthalone Yellow, Nickel Azo Yellow, Copper Azomethine Yellow, Perinone Orange, Anthrone Orange, Dianthraquinonyl Red, and Dioxazine Violet.

In addition, the following organic pigments can be given as examples of the organic pigments with color index (C.I.) numbers. As a matter of course, conventionally known organic pigments as well as the following organic pigments can be used.

C.I. Pigment Yellow 12, 13, 14, 17, 20, 24, 74, 83, 86, 93, 109, 110, 117, 120, 125, 128, 137, 138, 147, 148, 151, 153, 154, 166, or 168.

C.I. Pigment Orange 16, 36, 43, 51, 55, 59, or 61.

C.I. Pigment Red 9, 48, 49, 52, 53, 57, 97, 122, 123, 149, 168, 175, 176, 177, 180, 192, 215, 216, 217, 220, 223, 224, 226, 227, 228, 238, or 240.

C.I. Pigment Violet 19, 23, 29, 30, 37, 40, or 50.

C.I. Pigment Blue 15, 15:1, 15:3, 15:4, 15:6, 22, 60, or 64.

C.I. Pigment Green 7 or 36.

C.I. Pigment Brown 23, 25, or 26.

[1-10-2] Resin:

The resin to be used in the pigment dispersion preferably has a dispersing function of satisfactorily dispersing a hydrophobic pigment in an aqueous liquid medium, and a random copolymer is used. A resin except the random copolymer, such as a block copolymer, is not preferred because the resin often raises the hydrophilicity of the pigment and is often poor in water resistance of a printed image.

For example, a (meth)acrylate-based copolymer is preferably used as the random copolymer. The (meth)acrylate-based copolymer can be obtained by copolymerizing (meth) acrylic acid, a (meth)acrylate, and a monoethylenically unsaturated monomer capable of copolymerizing with these compounds. (Meth)acrylic acid is, for example, acrylic acid or methacrylic acid. Of those, (meth)acrylic acid is preferably used in consideration of the fact that the coexistence range of its electrically neutral state and its anion state can be controlled to be wide.

Examples of the (meth)acrylate can include: alkyl (meth) acrylates, such as methyl (meth)acrylate, n-butyl (meth) acrylate, 2-ethylhexyl (meth) acrylate, n-octyl (meth)acrylate, dodecyl (meth)acrylate, octadecyl (meth)acrylate, cyclohexyl (meth)acrylate, and isobornyl (meth)acrylate; hydroxyalkyl (meth)acrylates, such as 2-hydroxyethyl (meth)acrylate, 2-hydroxypropyl (meth)acrylate, and 3-hydroxypropyl (meth)acrylate; alkylene glycol mono(meth) acrylates, such as diethylene glycol mono(meth)acrylate, triethylene glycol mono(meth)acrylate, polyethylene glycol mono(meth)acrylate, propylene glycol mono(meth)acrylate, dipropylene glycol mono(meth)acrylate, tripropylene glycol mono(meth)acrylate, tetramethylene ether glucol mono (meth)acrylate, a mono(meth)acrylate of polyethylene oxide-polypropylene oxide random polymer glycol or polyethylene oxide-polypropylene oxide block polymer glycol, and a mono(meth)acrylate of polyethylene oxide-polytetramethylene ether random polymer glycol or polyethylene oxide-polytetramethylene ether block polymer glycol; glycidyl (meth)acrylate; and benzyl (meth)acrylate.

In addition to the (meth)acrylic acid, the (meth)acrylate, and the monoethylenically unsaturated monomer, a styrene-based monomer can also be incorporated into the (meth) acrylate-based copolymer. Examples of the styrene-based monomer in this case can include styrene, α-methylstyrene, o-methylstyrene, m-methylstyrene, p-methylstyrene, p-t-butylstyrene, 4-methoxystyrene, and 4-chlorostyrene. That is, the (meth)acrylate-based copolymer is preferably a styrene-(meth)acrylic acid-based copolymer having the styrene-based monomer.

With regard to the weight-average molecular weight of the (meth)acrylate-based copolymer, the weight-average molecular weight (Mw) in terms of styrene preferably falls within the range of from 6,000 to 12,000, and more preferably falls within the range of from 7,000 to 9,000. When the weight-average molecular weight is set to fall within the range, the dispersion stability of the pigment dispersion is improved and its viscosity can be set to a low value. In addition, the kogation of the ink in a heater portion is suppressed and hence printing can be stably performed for a long time period. A weight-average molecular weight of less than 6,000 is not preferred because the dispersion stability of the aqueous pigment dispersion itself reduces. In addition, a weight-average molecular weight of more than 12,000 is not preferred because of the following reason. There is a tendency that the viscosity of the aqueous pigment dispersion increases and its dispersibility reduces. Further, the kogation on the heater portion becomes severe, which is responsible for the occurrence of the non-ejection of an ink droplet from a nozzle tip of an inkjet printer of a thermal system.

[1-10-3] Pigment Dispersion:

The pigment dispersion is prepared by covering the pigment with the (meth)acrylate-based copolymer.

With regard to the average particle diameter of the pigment dispersion, a value determined by a dynamic light scattering method in the liquid is preferably from 70 nm to 150 nm, more preferably from 80 nm to 120 nm. An average particle diameter of more than 150 nm is not preferred because the sedimentation of the ink is accelerated and hence the long-term dispersion stability is impaired. On the other hand, an average particle diameter of less than 70 nm is not preferred because color developability sufficient for the formation of an image and sufficient weatherability of the resultant image cannot be obtained.

With regard to a specific method of measuring the average particle diameter, the average particle diameter can be measured by using, for example, FPAR-1000 (manufactured by Otsuka Electronics Co., Ltd., analysis by a cumulant method) or Nanotrac UPA 150EX (manufactured by Nikkiso Co., Ltd., a 50% integrated value is adopted) utilizing the scattering of laser light.

The amount of the pigment dispersion to be added to the ink is preferably from 0.5 mass % to 10 mass %, more preferably from 1.0 mass % to 8.0 mass %, particularly preferably from 1.5 mass % to 6.0 mass % with respect to the total amount of the ink. When the pigment concentration is less than 0.5 mass %, color developability sufficient for the formation of an image cannot be obtained. In addition, an addition amount of more than 10.0 mass % is not preferred because the viscosity of the aqueous pigment ink increases and hence it becomes difficult to eject the ink.

In the aqueous pigment dispersion, from the viewpoints of maintaining the dispersibility of the dispersion and keeping the viscosity of the pigment ink at a low value, a ratio between the pigment and the (meth)acrylate-based copolymer is preferably as follows: the amount of the (meth) acrylate-based copolymer falls within the range of from 0.2 part to 1.0 part with respect to 1 part of the pigment in terms of mass.

Upon covering of the pigment with the (meth)acrylate-based copolymer, an acid precipitation step is preferably incorporated. Acid precipitation is to precipitate the (meth) acrylate-based copolymer by the following procedure: an acidic substance is added to a liquid medium containing the pigment and the (meth)acrylate-based copolymer dissolved in an aqueous solution of a basic substance to acidify the medium, thereby returning an anionic group in the (meth) acrylate-based copolymer to a functional group before neutralization.

In such acid precipitation step, a base and a salt are formed by acidifying the aqueous dispersion, which has been obtained through a dispersing step and a distilling step to be performed as required, through the addition of an acid, such as hydrochloric acid, sulfuric acid, or acetic acid. Thus, the (meth)acrylate-based copolymer in a dissolved state is precipitated on the surface of each pigment particle. The performance of the step can additionally improve an interaction between the pigment and the (meth)acrylate-based copolymer. As a result, the pigment dispersion can be caused to take such a form that microcapsule-type composite particles are dispersed in an aqueous dispersion medium. In addition, the aqueous pigment dispersion can be caused to fully exhibit additionally excellent effects in terms of physical properties, such as a level attained by dispersion, a time required for the dispersion, and dispersion stability, and in terms of use suitability, such as solvent resistance.

A filtering step of separating the precipitate, which has been obtained by improving the interaction as described above, by filtration is performed. More preferably, after the completion of the filtering step, a free polymer present in the pigment dispersion without adsorbing thereto is removed by performing a washing step of washing the precipitate. Then, a redispersing step of dispersing the residue in the aqueous medium together with the basic substance again is performed, whereby an aqueous pigment dispersion additionally excellent in dispersion stability can be obtained.

[1-10-4] Water-Soluble Compound:

The pigment ink is obtained by dispersing the pigment dispersion in at least a water-soluble compound. The kind of the water-soluble compound of this embodiment is not particularly limited, but the water-soluble compound is preferably at least one kind selected from the group consisting of a water-soluble organic solvent and a water-soluble compound that is solid at 25° C.

The term "water-soluble compound" as used herein means a compound that freely mixes with water or has a solubility (25° C.) in water of 20 g/100 g or more. The water-soluble compound is at least one kind selected from the group consisting of the water-soluble organic solvent and the water-soluble compound that is solid at 25° C. The incorporation of the water-soluble compound can prevent the vaporization of water and hence can prevent the sticking of the ink due to drying.

Various water-soluble organic solvents including such alcohols, polyhydric alcohols, glycol ethers, carboxylic acid amides, heterocycles, ketones, and alkanolamines as listed below can each be used as the water-soluble compound. In addition, the water-soluble compound that is solid at 25° C. such as urea, ethylene urea, or trimethylolpropane can be used.

(1) Alcohols:

Linear alcohols each having 1 to 5 carbon atoms, such as methanol, ethanol, n-propyl alcohol, isopropyl alcohol, n-butyl alcohol, sec-butyl alcohol, isobutyl alcohol, tert-butyl alcohol, and n-pentyl alcohol.

(2) Polyhydric Alcohols:

Alkanediols, such as ethylene glycol (ethanediol), propanediol (1,2- or 1,3-), butanediol (1,2-, 1,3-, or 1,4-), 1,5-pentanediol, and 1,2-hexanediol; condensates of alkanediols, such as diethylene glycol, triethylene glycol, tetraethylene glycol, dipropylene glycol, tripropylene glycol, polyethylene glycol, and polypropylene glycol; and polyhydric alcohols except the alkanediols, such as glycerin, trimethylolpropane, 1,2,6-hexanetriol, and thiodiglycol.

(3) Glycol Ethers:

A monomethyl ether of ethylene glycol; a monomethyl ether and a monoethyl ether of diethylene glycol; a monomethyl ether, a monoethyl ether, a monobutyl ether, a dimethyl ether, and a diethyl ether of triethylene glycol; and a dimethyl ether and a diethyl ether of tetraethylene glycol.

(4) Carboxylic Acid Amides:

N,N-Dimethylformamide and N,N-dimethylacetamide.

(5) Heterocycles:

Cyclic ethers, such as tetrahydrofuran and dioxane; nitrogen-containing heterocycles, such as 2-pyrrolidone, N-methyl-2-pyrrolidone, and N-methylmorpholine; and sulfur-containing heterocycles, such as sulfolane.

(6) Ureas:

Ureas, such as urea, ethyleneurea, and 1,3-dimethyl-2-imidazolidinone (N,N'-dimethylethyleneurea).

(7) Ketones:

Ketones, such as acetone and methyl ethyl ketone; and keto alcohols, such as 4-hydroxy-4-methyl-2-pentanone (diacetone alcohol).

(8) Alkanolamines:

Monoethanolamine, diethanolamine, and triethanolamine.

(9) Others:

Sulfur-containing compounds, such as dimethyl sulfoxide and bishydroxyethyl sulfone.

Of the water-soluble organic solvents, polyhydric alcohols are preferred and glycerin is more preferred. Glycerin is preferred because glycerin hardly volatilizes and has an excellent preventing effect on the sticking of the ink. In addition, one kind of the water-soluble organic solvents may be used alone, or two or more kinds thereof may be used as a mixture. For example, it is also preferred to use glycerin, and a polyhydric alcohol except glycerin or a nitrogen-containing heterocycle in combination. At this time, triethylene glycol or the like can be used as the polyhydric alcohol except glycerin, and 2-pyrrolidone or the like can be used as the nitrogen-containing heterocycle. Such mixed solvent is preferred because of its high preventing effect on the thickening of the ink.

The content of the water-soluble organic solvent is not particularly limited. However, the content is set to preferably 5 mass % or more, more preferably 10 mass % or more, particularly preferably 15 mass % or more with respect to the total mass of the ink in order to obtain the following effect: the vaporization of the aqueous medium is prevented and hence the sticking of the ink due to drying is prevented. Meanwhile, from the viewpoints of allowing the ink to correspond to a high drive frequency and preventing the occurrence of a mold, the content is set to preferably 50 mass % or less, more preferably 40 mass % or less, particularly preferably 30 mass % or less with respect to the total mass of the ink.

Urea, ethylene urea, or the like is preferably used as the water-soluble compound that is solid at 25° C., and ethylene urea is more preferably used. The content of the water-soluble compound that is solid at 25° C. is not particularly limited. However, the content is set to preferably 5 mass % or more, more preferably 9 mass % or more with respect to the total mass of the ink in order to obtain the following effect: the vaporization of the aqueous medium is prevented and hence the sticking of the ink due to drying is prevented. Meanwhile, in order to prevent an inconvenience due to excessive addition of the compound, the content is set to preferably 40 mass % or less, more preferably 30 mass % or less, particularly preferably 15 mass % or less with respect to the total mass of the ink.

[1-10-5] Surfactant:

In this embodiment, a surfactant may be incorporated into the ink as required for the purpose of controlling the surface tension of the ink to arbitrarily control the bleeding degree or permeability of the ink in an image recording medium, or for the purpose of improving the wettability of the ink in a head to prevent the kogation of the ink on a heater surface and to improve the ejection of the ink.

Such surfactant is not particularly limited, but the following surfactants can each be suitably used. It should be noted that one of the surfactants may be used alone, or two or more thereof may be used in combination.

[Nonionic Surfactant]

A polyoxyethylene alkyl ether, a polyoxyethylene fatty acid ester, a polyoxyethylene alkylphenyl ether, a polyoxyethylene/polyoxypropylene block copolymer, and the like. A fatty acid diethanolamide, an acetylene glycol ethylene oxide adduct, an acetylene glycol-based surfactant, and the like.

[Anionic Surfactant]

A polyoxyethylene alkyl ether sulfuric acid ester salt, a polyoxyethylene alkyl ether sulfonate salt, a polyoxyethylene alkylphenyl ether sulfuric acid ester salt, a polyoxyethylene alkylphenyl ether sulfonate salt, and the like. An α-sulfofatty acid ester salt, an alkylbenzenesulfonate salt, an alkylphenolsulfonate salt, an alkylnaphthalenesulfonate salt, an alkyltetralinsulfonate salt, a dialkylsulfosuccinate salt, and the like.

[Cationic Surfactant]

An alkyltrimethylammonium salt, a dialkyldimethylammonium chloride, and the like.

[Amphoteric Surfactant]

An alkylcarboxybetaine and the like.

Of those, an acetylene glycol-based surfactant, a polyoxyethylene alkyl ether, or the like is particularly preferably used because the ejection stability of the ink can be improved.

A compound represented by the following general formula (11) (ethylene oxide adduct of 2,4,7,9-tetramethyl-5-decyne-4,7-diol) is used as the acetylene glycol-based surfactant.

General Formula (11)

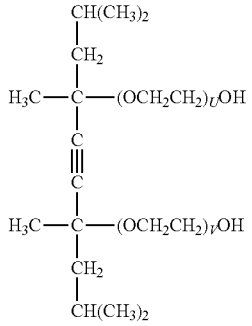

(In the general formula (11), U and V each independently represent an integer of 1 or more and U+V is an integer of from 2 to 20.)

[1-10-6] Water:

Deionized water (ion-exchanged water) is preferably used as water. The content of the water is not particularly limited. However, the content is preferably from 30 mass % to 90 mass %, more preferably from 40 mass % to 85 mass %, particularly preferably from 50 mass % to 80 mass % with respect to the total mass of the ink. When the content is set to 30 mass % or more, the pigment and the water-soluble compound can be hydrated, and hence the agglomeration of the pigment and the water-soluble compound can be prevented. Meanwhile, when the content is set to 90 mass % or less, the amount of the water-soluble organic compound relatively increases. In addition, even when a volatile component (such as water) in the aqueous medium volatilizes, the dispersed state of the pigment can be maintained, and hence the precipitation and solidification of the pigment can be prevented.

[1-10-7] Other Additives:

The ink may contain an additive except the surfactant depending on the purpose. Examples of such additive can include a pH adjustor, a rust inhibitor, an antiseptic, an antimold agent, an antioxidant, a reduction-preventing agent, and a salt.

[1-10-8] Viscosity:

A viscosity $\eta$ of the ink is preferably from 1.5 mPa·s to 5.0 mPa·s, more preferably from 1.6 mPa·s to 3.5 mPa·s, particularly preferably from 1.7 mPa·s to 3.0 mPa·s. Setting the viscosity to 1.5 mPa·s or more enables the formation of a satisfactory ink droplet. Meanwhile, setting the viscosity to 5.0 mPa·s or less improves the flowability of the ink and hence improves the property by which the ink is supplied to a nozzle, and by extension, the ejection stability of the ink.

The viscosity of the ink means a value measured in conformity with JIS Z 8803 under the condition of a temperature of 25° C. with an E-type viscometer (e.g., "RE-80L Viscometer" manufactured by Toki Sangyo Co., Ltd.). The viscosity of the ink can be adjusted by, for example, the kind or amount of the water-soluble organic solvent as well as the kind or amount of the surfactant.

[1-10-9] Surface Tension:

A surface tension $\gamma$ of the ink is preferably from 25 mN/m to 45 mN/m. Setting the surface tension to 25 mN/m or more can maintain the meniscus of an ink ejection orifice and hence can prevent such an inconvenience that the ink flows out of the ink ejection orifice. In addition, setting the surface tension to 45 mN/m or less can optimize the rate at which the ink is absorbed in the image recording medium, and hence can prevent the inconvenience of a fixation failure due to insufficient absorption of the ink.

The surface tension of the ink means a value measured at a temperature of 25° C. with an automatic surface tension meter (e.g., "Model CBVP-Z" manufactured by Kyowa Interface Science Co., Ltd.) by a plate method involving using a platinum plate. The surface tension of the ink can be adjusted by, for example, the addition amount of the surfactant, and the kind and content of the water-soluble organic solvent.

[1-10-10] pH:

The pH of the ink is preferably from 7.5 to 10.0, more preferably from 8.5 to 9.5. A pH of less than 7.5 is not preferred because the dispersion stability of the pigment particles deteriorates and hence the agglomeration of the pigment particles is liable to occur. On the other hand, a pH of more than 10.0 is not preferred because of the following reason. The pH of the ink is so high that some members of an apparatus to be used are brought into contact with the ink to cause chemical attack. Thus, organic matter or inorganic matter is eluted in the ink, with the result that an ejection failure occurs.

The viscosity of the ink means a value measured under the condition of a temperature of 25° C. with a pH meter (e.g., D-51 manufactured by Horiba, Ltd.).

[1-11] Recording of Image:

Next, an image is recorded on the surface of the coloring material-receiving layer in the transfer material where the transparent sheet is not laminated. In particular, a reverse image having the following characteristic is recorded: the image becomes a mirror image when viewed from a side closer to the coloring material-receiving layer, and becomes a normal image when viewed from a side closer to the transparent sheet. Thus, as illustrated in FIG. 4, the reverse image 72 is recorded on the coloring material-receiving layer 53 of the transfer material 1.

The inkjet recording system is a system involving ejecting the ink (ink droplets) from a plurality of nozzles formed on a recording head onto a transfer material to record an image. The kind of the inkjet recording system is not particularly limited. However, a thermal inkjet recording system involving applying a thermal energy in accordance with a driving pulse to the ink in the nozzles to form air bubbles through film boiling, and ejecting the ink droplets from the nozzles with the air bubbles is preferred.

The inkjet recording system can be performed with an inkjet recording apparatus (inkjet printer). The inkjet printer is preferred because the recording head and the transfer material are not brought into contact with each other at the time of the image recording, and hence the printer can perform extremely stable image recording. The kind of the inkjet printer is not particularly limited. However, there is preferably used a full-line-type inkjet printer including a line head obtained by arraying many multi-nozzle heads, which are each obtained by integrating a plurality of nozzles each formed of, for example, an ink ejection orifice and an ink channel, so that the heads may be perpendicular to the conveying direction of the transfer material. The full-line-type inkjet printer simultaneously ejects the ink droplets from the ink ejection orifices of the plurality of nozzles in accordance with the conveyance of the transfer material to record an image. Accordingly, the printer can record a high-quality and high-resolution image at high speed. That is why the printer is preferred.

The ejection amount of the ink of the recording head is preferably 20 pl or less. Setting the ejection amount of the ink to preferably 20 pl or less, more preferably 10 pl or less, particularly preferably 5 pl or less can control the water content of the ink in the step of thermally pressure-bonding the transfer material and the image support to a proper level. In addition, reducing the ejection amount can suppress the spread of the ink in the coloring material-receiving layer, and hence can record a thick reverse image having a sufficient density. Further, the reduction can reduce the thickness of an image layer (ink layer).

In addition, in this embodiment, a serial head-type inkjet recording system involving sequentially conveying the transfer materials while causing the recording head to move and scan relative to a recording surface may be used. The serial head-type inkjet recording system has sufficient superiority over a heat transfer system in recording speed and can reduce a liquid droplet in size, and hence can easily produce a high-quality image.

In addition, the image is preferably printed so as to have a size larger than that of the image support. Thus, borderless printing can be performed and hence a satisfactory image can be obtained. In particular, when an inkjet system is used, directly performing the borderless printing on the image support leads to the absorption of the ink in an edge portion, thereby deteriorating the image quality of the edge portion. However, in this embodiment, satisfactory printing of the edge portion can be performed even by the inkjet system.

Figure 8:
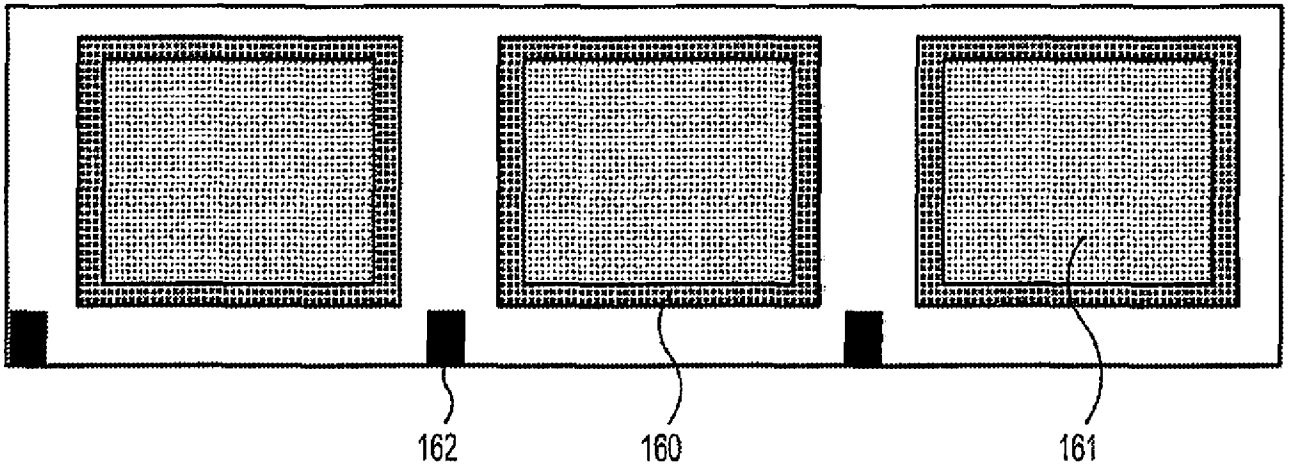
FIG. 8 is an explanatory view for illustrating a state in which a marking is printed on the transfer material.
Figure 9:
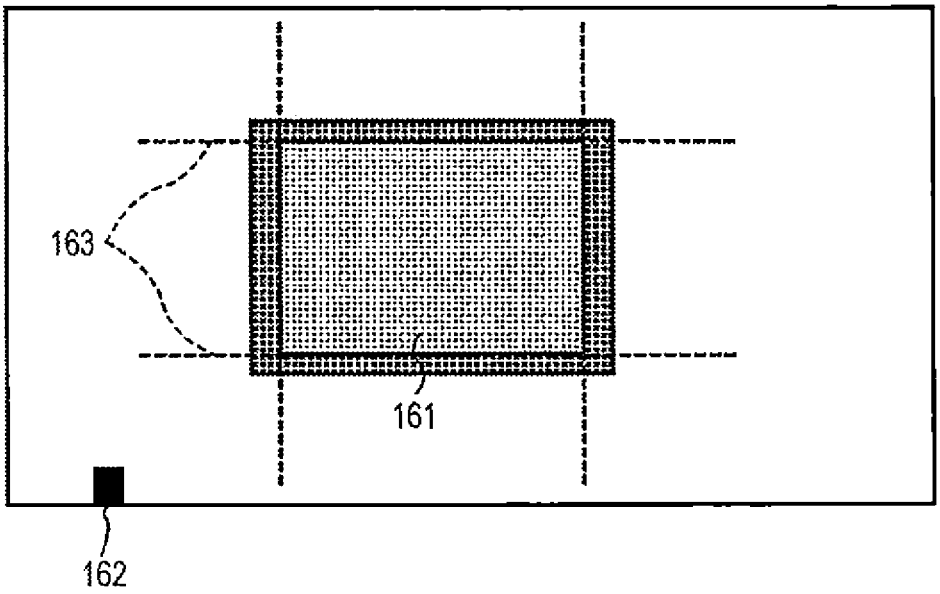
FIG. 9 is an explanatory view for illustrating a state in which attachment guides are printed on the transfer material.

[1-11-1] Marking Treatment:

In addition, upon printing of the image, as illustrated in FIG. 8, a marking 162 for registration can be printed outside an image formation region 161 or a printing region 160 for the registration of an automatic laminating machine in the transferring step. When the marking is read with a transmission- and reflection-type sensor, an attachment position is accurate at the time of the transfer. In addition, in the case where the transfer material has a cut sheet shape as illustrated in FIG. 9, when attachment guides 163 are printed outside the image formation region 161 in addition to the marking 162, the attachment position at the time of the transfer can be easily adjusted.

[1-11-2] Drying of Ink:

In the transfer material of this embodiment, an ink for inkjet recording with which an image is formed is preferably dried until its water content becomes 70 mass % or less with respect to the total input amount of the ink. Setting the water content of the ink to preferably 70 mass % or less, more preferably 50 mass % or less suppresses abrupt vaporization of an ink component upon thermal pressure bonding of the image support and the transfer material. In addition, inconveniences such as a reduction in adhesive strength between the image support and the transfer material, and the remaining of air bubbles in the coloring material-receiving layer can be prevented. It should be noted that the term "water content" as used herein means the total amount of, for example, water and a nonvolatile solvent except a coloring material.

The total input amount of the ink can be adjusted by the ink ejection amount from a recording head. The input amount may be limited by, for example, thinning down the number of dots at the time of image recording in advance so that the control of the water content can be easily performed.

The drying can be performed with, for example, a heater (heat source), such as a halogen heater, or an exhaust apparatus, such as a fan. However, natural drying may be promoted by causing a conveying path having a sufficient length to convey the image without arranging a special drying unit, such as a heater.

Figure 10:
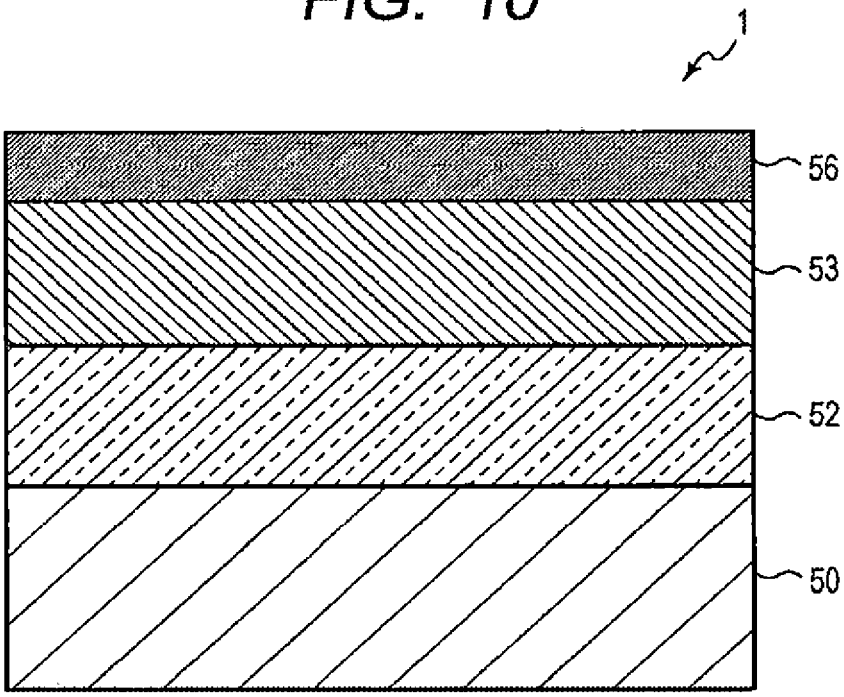
FIG. 10 is a sectional view for schematically illustrating another embodiment of the transfer material.

[1-12] Primer Layer:

In this embodiment, as illustrated in FIG. 10, the transfer material 1 after the printing preferably further includes a primer layer 56 on the surface of the coloring material-receiving layer 53. The primer layer 56 is a layer having an adhesive property and is arranged on the surface of the coloring material-receiving layer. In this case, a layer in contact with the image support is the primer layer. When the transfer material includes the primer layer, the adhesive property and adhesive strength between the image support and the transfer material can be improved, and hence the following inconvenience can be suppressed: the transfer material peels from the image support owing to an insufficient adhesive strength therebetween. Arranging the primer layer can control a difference SP2 between the SP value of the primer layer and the SP value of the image support to the range represented by the following general expression (12), and hence can improve the adhesive property and the adhesive strength. Accordingly, the following inconvenience can be suppressed: the coloring material-receiving layer peels from the image support. In particular, in this embodiment, when a PET base material except a PVC and a PET-G is used as the image support, it is effective to arrange the primer layer. The primer layer is not particularly limited, but a primer layer described in Japanese Patent Application Laid-Open No. 2015-110321 can be preferably used.

$$0 \leq SP2 \leq 1.0 \quad (12)$$

[2] Recorded Matter:

A recorded matter is a recorded matter in which an image support, a coloring material-receiving layer having recorded thereon an image, and a transparent sheet are laminated, and the coloring material-receiving layer having recorded thereon the image and the transparent sheet are transferred from the transfer material described in the section [1].

Specifically, the recorded matter of this embodiment includes the image support 55, the coloring material-receiving layer having recorded thereon the image, and the transparent sheet like a recorded matter 73 illustrated in FIG. 1. In addition, the coloring material-receiving layer and the transparent sheet are obtained by recording the image on the coloring material-receiving layer 53 of the transfer material of this embodiment and peeling a base material sheet. Further, the recorded matter 73 has a laminated structure in which the image support 55, the coloring material-receiving layer 53, and the transparent sheet 52 are laminated in the stated order, the coloring material-receiving layer 53 contains inorganic fine particles and a water-soluble resin, the transparent sheet 52 contains the emulsion E1 and the emulsion E2, the emulsion E1 has a glass transition temperature Tg1 of more than 50° C. and less than 90° C., the emulsion E2 has a glass transition temperature Tg2 of 90° C. or more and 120° C. or less, the emulsion E1 is in a state of forming a film, and the emulsion E2 is in a state of remaining as particles. Thus, an improvement in cutting property of an end portion of the recorded matter, an improvement in adhesive property between the coloring material-receiving layer and the transparent sheet, an improvement in chemical resistance of the transparent sheet, and the prevention of the stickiness can be achieved.

[3] Method of Manufacturing Recorded Matter:

A method of manufacturing a recorded matter is a method of manufacturing a recorded matter in which an image support, a coloring material-receiving layer having recorded thereon an image, and a transparent sheet are laminated, the method including: a step 1 of recording the image on the coloring material-receiving layer of the transfer material described in the section [1]; a step 2 of thermally pressure-bonding the transfer material in which the image has been recorded on the coloring material-receiving layer onto the image support from a side closer to the coloring material-receiving layer; and a step 3 of peeling a base material sheet from the transfer material to provide the recorded matter in which the image support, the coloring material-receiving layer having recorded thereon the image, and the transparent sheet are laminated in the stated order.

The method of manufacturing a recorded matter of this embodiment (the step 2 and the step 3) is specifically described below.

Figure 11:
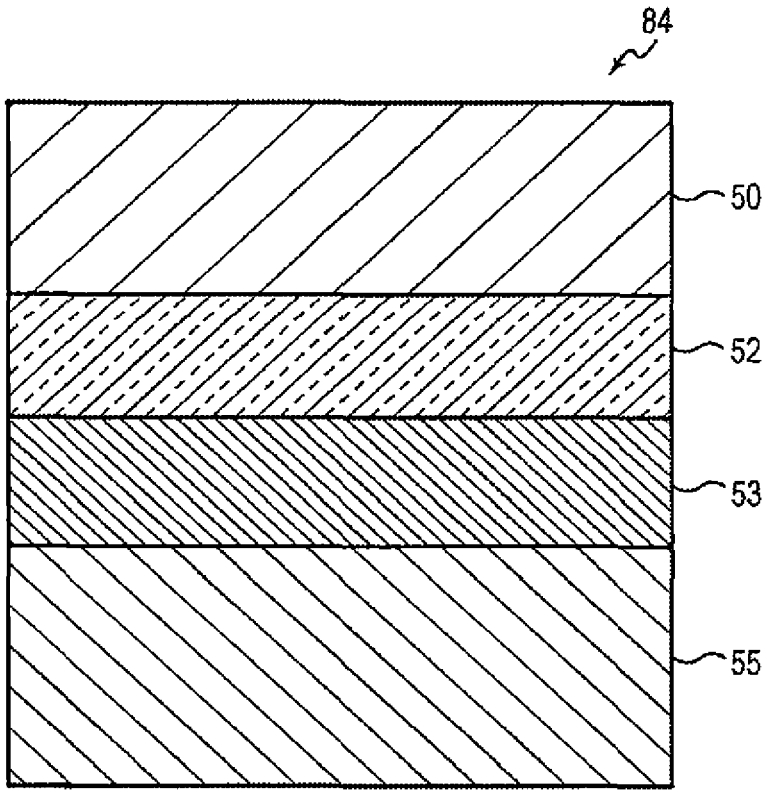
FIG. 11 is a sectional view for illustrating the case where a laminate is cut in its thickness direction in a state in which the transfer material is attached to an image support.
Figure 12:
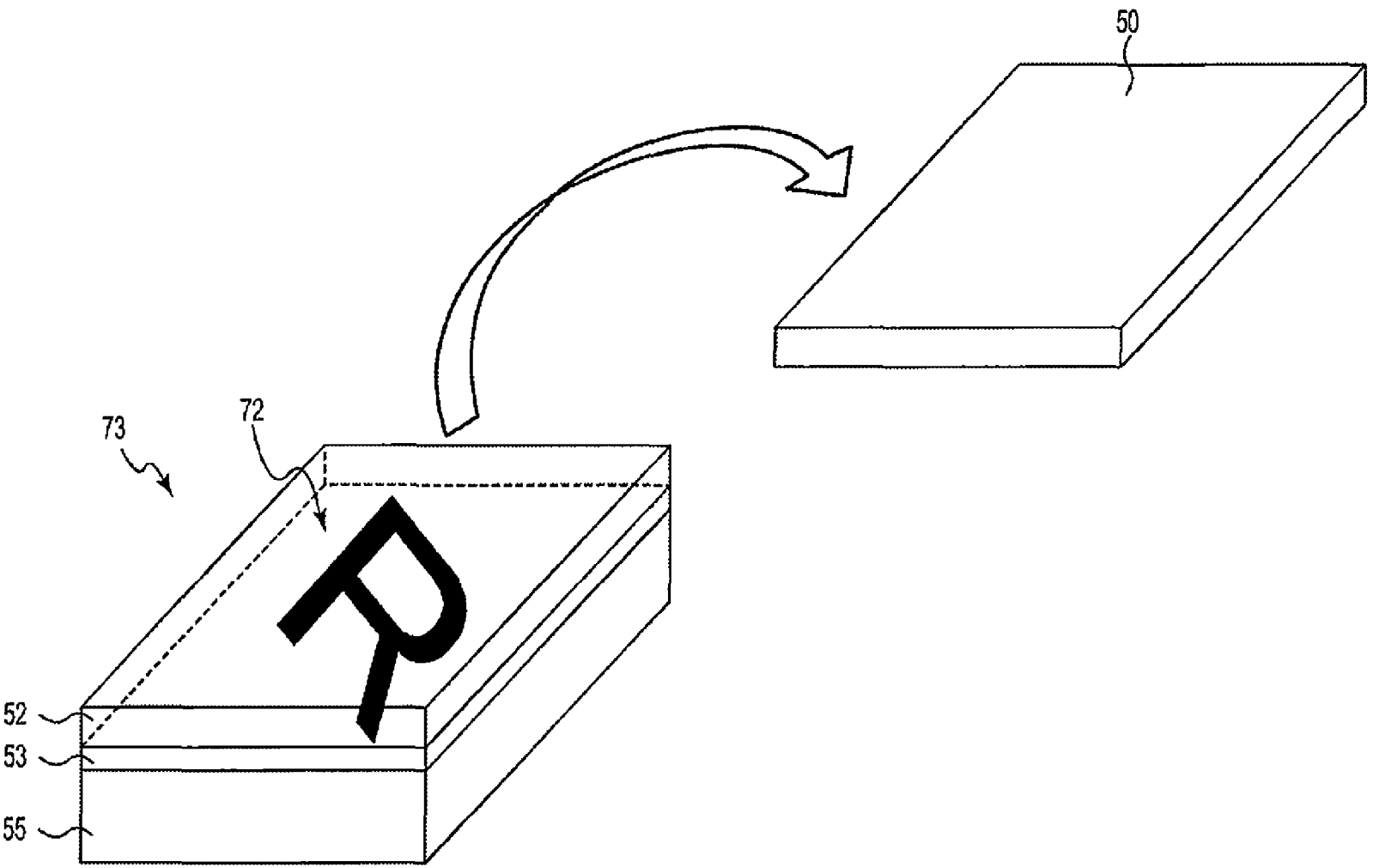
FIG. 12 is a perspective view for schematically illustrating a state in which the recorded matter is formed by attaching the transfer material to the image support.

FIG. 11 is a sectional view for schematically illustrating a laminate 84 obtained by attaching the transfer material of this embodiment to the image support 55, and FIG. 12 is a perspective view for schematically illustrating the step of peeling the base material sheet 50 from the laminate 84 illustrated in FIG. 11 to provide the recorded matter 73.

As illustrated in FIG. 11, the transfer material of this embodiment is used by being attached to the image support 55 so that the coloring material-receiving layer 53 may face the image support 55. Thus, the laminate 84 in which the image support 55, the coloring material-receiving layer 53, and the transparent sheet 52 are laminated in the stated order is formed. Thus, the reverse image recorded on the coloring material-receiving layer 53 of the transfer material is attached to the image support 55.

After that, the recorded matter 73 can be obtained by peeling the base material sheet 50 from the laminate as illustrated in FIG. 12.

[3-1] Image Support:

The image support is an object on which the image of the transfer material is supported. The construction of the image support is not particularly limited. Examples thereof can include an image support using a resin as a constituent material (resin-based support) and an image support using paper as a constituent material (paper-based support). Examples of the resin-based support can include cards made of resins, such as a credit card and an IC card. Examples of the paper-based support can include a booklet made of paper, such as a passport, and a card made of paper.

[3-1-1] Resin-Based Support:

The resin constituting the resin-based support may be appropriately selected depending on the application of the image support and is not particularly limited. Examples thereof can include: polyester resins, such as polyethylene terephthalate, polybutylene terephthalate, and a polyethylene terephthalate/isophthalate copolymer; polyolefin resins, such as polyethylene, polypropylene, and polymethylpentene; polyfluoroethylene-based resins, such as polyvinyl fluoride, polyvinylidene fluoride, polytetrafluoroethylene, and an ethylene-tetrafluoroethylene copolymer; aliphatic polyamide resins, such as nylon 6 and nylon 6,6; vinyl polymer resins, such as polyvinyl chloride, a vinyl chloride/vinyl acetate copolymer, an ethylene/vinyl acetate copolymer, an ethylene/vinyl alcohol copolymer, polyvinyl alcohol, and vinylon; cellulose-based resins, such as cellulose triacetate and cellophane; acrylic resins, such as polymethyl methacrylate, polyethyl methacrylate, polyethyl acrylate, and polybutyl acrylate; and other synthetic resins, such as polystyrene, polycarbonate, polyarylate, and polyimide.

Examples of the resin constituting the resin-based support may also include biodegradable resins, such as aliphatic polyester, polycarbonate, polylactic acid, polyvinyl alcohol, cellulose acetate, and polycaprolactone. In addition, the resin-based support needs only to contain a resin as a main constituent material, and may contain, for example, a material except the resin, such as a metal foil.

[3-1-2] Paper-Based Support:

The kind of the paper constituting the paper-based support is not particularly limited. Examples thereof can include condenser paper, glassine paper, parchment paper, paper having a high sizing degree, synthetic paper (polyolefin-based or polystyrene-based synthetic paper), woodfree paper, art paper, coated paper, cast-coated paper, wallpaper, lining paper, synthetic resin- or emulsion-impregnated paper, synthetic rubber latex-impregnated paper, paper to which a synthetic resin is internally added, cardboard, and cellulose-fiber paper.

[3-1-3] Others:

The resin-based support and the paper-based support may each include, for example, embossing, a sign, an IC memory (IC chip), an optical memory, a magnetic recording layer, a recording layer for preventing forgery and falsification (such as a pearl pigment layer, a watermark recording layer, or a microcharacter), an emboss recording layer, or an IC chip-concealing layer as required.

In addition, the resin-based support and the paper-based support may each be formed as a single-layer body formed of any such material as described above, or may each be formed as a multilayer body obtained by attaching two or more sheets or films different from each other in material or thickness.

Further, the thickness of the entirety of the image support is preferably from 30 μm to 800 μm. The thickness of the image support is set to preferably 30 μm or more, more preferably 500 μm or more, particularly preferably 650 μm or more. Meanwhile, the thickness of the image support is set to preferably 800 μm or less, more preferably 770 μm or less. When a plastic card is used as the image support, the thickness of the entirety of the recorded matter can be controlled to a total thickness of from 0.68 mm to 0.84 mm, which is described in JIS 6301.

[3-2] Laminated Structure:

The recorded matter of this embodiment has a laminated structure in which the image support 55, the coloring material-receiving layer 53, and the transparent sheet 52 are laminated in the stated order like the recorded matter 73 illustrated in each of FIG. 1 and FIG. 12.

[3-3] Thermal Pressure Bonding of Transfer Material and Image Support:

The image support and the transfer material are thermally pressure-bonded in a state of being brought into abutment with each other so that the image support, the coloring material-receiving layer, and the transparent sheet may be laminated in the stated order. Thus, the recorded matter having a laminated structure in which the image support, the coloring material-receiving layer, and the transparent sheet are laminated in the stated order is obtained.

A temperature at the time of the thermal pressure bonding is controlled to preferably from 90° C. to 160° C., more preferably from 120° C. to 160° C. Setting the thermal pressure bonding temperature to preferably 90° C. or more melts the resins in the coloring material-receiving layer, such as the cationic resin and the water-soluble resin, and a thermoplastic resin in the primer layer (or the anchor layer) to an extent sufficient for the bonding, and hence can pressure-bond the image support and the transfer material. Setting the temperature to 90° C. or more can turn the emulsion E1 in the transparent sheet into a film to improve the transferability. Further, setting the temperature to 120°

C. or more turns the emulsion E2 in the transparent sheet into a film to strengthen its bonding force with the emulsion E1 that has already been turned into a film, and hence can improve the foil-cutting property. Meanwhile, setting the thermal pressure bonding temperature to preferably 160° C. or less suppresses abrupt vaporization of an ink component upon thermal pressure bonding of the image support and the transfer material. In addition, the setting can prevent inconveniences, such as a reduction in adhesive strength between the image support and the transfer material, and the remaining of air bubbles in the coloring material-receiving layer. In addition, controlling the temperature within the temperature range can prevent the yellowing of the coloring material-receiving layer because the coloring material-receiving layer starts to yellow owing to heating at about 180° C.

It should be noted that as illustrated in FIGS. 23A to 23C, the film states of the transparent sheet portion 980 of the portion 963 where the image support 55 and the coloring material-receiving layer are bonded to each other, and the transparent sheet portion 981 of the portion 964 where the image support and the coloring material-receiving layer are not bonded to each other are preferably controlled to differ from each other at the time of the thermal pressure bonding. That is, at the time of the thermal pressure bonding, the transparent sheet portion 980 is brought into contact with the image support, and hence the heat of a heat roll is easily transferred to the portion. Accordingly, a state in which part of the emulsion E2 turns into a film and part of its particles remain (FIG. 23B), or a state in which the emulsion E2 of the transparent sheet completely turns into a film (FIG. 23C) is established. At this time, a bonding force between the emulsion E2 that has partially or completely turned into a film and the emulsion E1 that has turned into a film in advance is strengthened, and hence the film strength of the transparent sheet can be strengthened. On the other hand, the heat of the heat roll is not transferred to the transparent sheet portion 981, and hence the emulsion E2 can be kept in a particle state. The film states of the transparent sheet portion 980 and the transparent sheet portion 981 differ from each other, and hence in the peeling step, a crack easily occurs with the boundary portion 982 as a starting point. The foil-cutting property is improved by using the two kinds of emulsions and changing the film state of the emulsion E2 through the utilization of the temperature at the time of the thermal pressure bonding.

Figure 21:
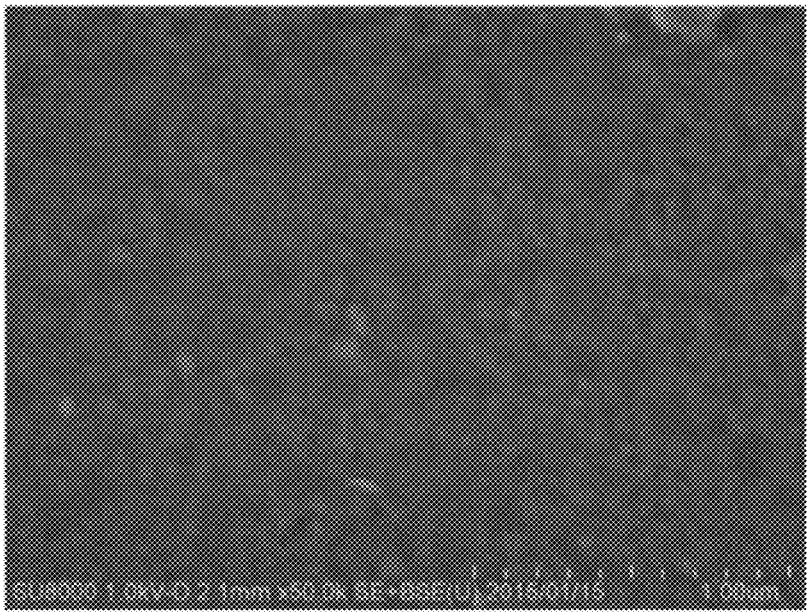
FIG. 21 is an explanatory view for illustrating the surface state of a transparent sheet, the figure being an illustration of a state in which one of the emulsions forms a film and the other remains as particles.

It should be noted that the transfer temperature is preferably set to the vicinity of the glass transition temperature Tg2 of the emulsion E2. Controlling the surface temperature of the coloring material-receiving layer at the time of the thermal pressure bonding to the vicinity of the glass transition temperature Tg2 of the emulsion E2 can produce a recorded matter in a state in which the emulsion E2 turns into a film in part of the transparent sheet and part of its particles remain as illustrated in FIG. 21. A state in which the particles remain in part of the transparent sheet is preferably left because of the following reason: an area of contact between the base material and the transparent sheet reduces to improve its peelability from the base material, and hence its transferability can be improved. Further, also in the state of the recorded matter, the particle state of the emulsion is preferably maintained in the transparent sheet. Thereby, the stickiness at the time of a touch with a hand is prevented and hence its texture can be improved.

Figure 22:
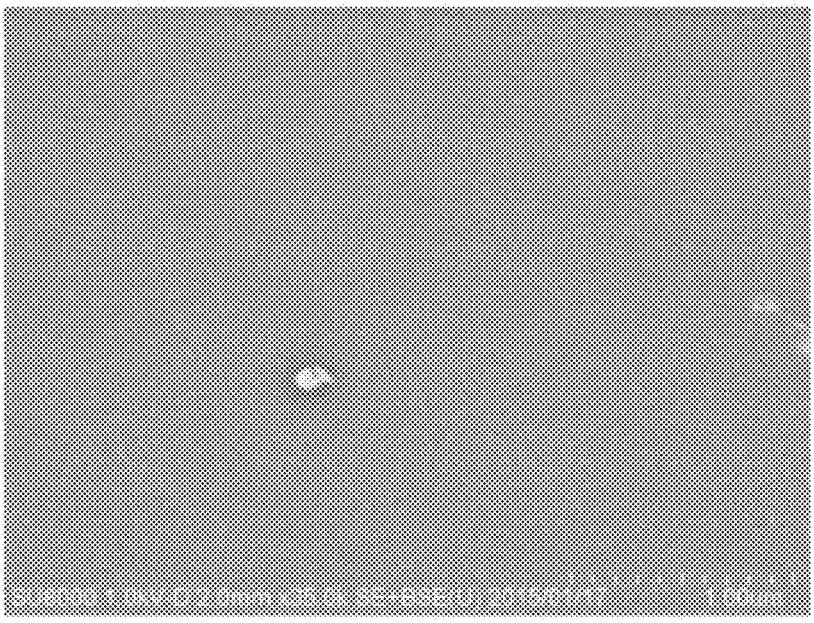
FIG. 22 is an explanatory view for illustrating the surface state of the transparent sheet, the figure being an illustration of a state in which all the emulsions each form a film.

The emulsion E2 can be transferred in a state of completely turning into a film as illustrated in FIG. 22 by adjusting its transfer temperature or transfer speed so that the temperature of the coloring material-receiving layer at the time of the transfer may significantly exceed the glass transition temperature of the emulsion E2. Bringing the emulsion E2 of the transparent sheet into a state of completely turning into a film improves the film strength and transparency, and hence can prevent the breakage of the recorded matter due to a scratch and the lackluster of its image. A state in which the emulsion E2 remains as particles (FIG. 23A) and a state in which the emulsion turns into a film (FIG. 23B or FIG. 23C) can each be properly used in accordance with performance required by a user, and but the transfer peeling step is preferably performed in a state in which the emulsion E2 is completely brought into a film state (FIG. 23C) at the time of the thermal pressure bonding because the foil-cutting property can be improved.

A method for the thermal pressure bonding is not particularly limited. For example, the following method is given: a laminate is obtained by laminating the transfer material on the image support, and the laminate is interposed between a pair of heat rolls and subjected to thermal pressure bonding. At this time, the surface temperature of each of the heat rolls is preferably set to from 100° C. to 180° C. Thus, even when the speed at which the laminate is conveyed is so high that a heating time cannot be sufficiently secured, the laminate can be heated to from 60° C. to 160° C. Setting the temperature within the temperature range establishes a state in which part of the emulsion E2 turns into a film and part of its particles remain, or a state in which the emulsion E2 of the transparent sheet completely turns into a film. A bonding force between the emulsion E2 that has partially or completely turned into a film and the emulsion E1 that has turned into a film in advance is strengthened, and hence the film strength of the transparent sheet can be strengthened.

Figure 16:
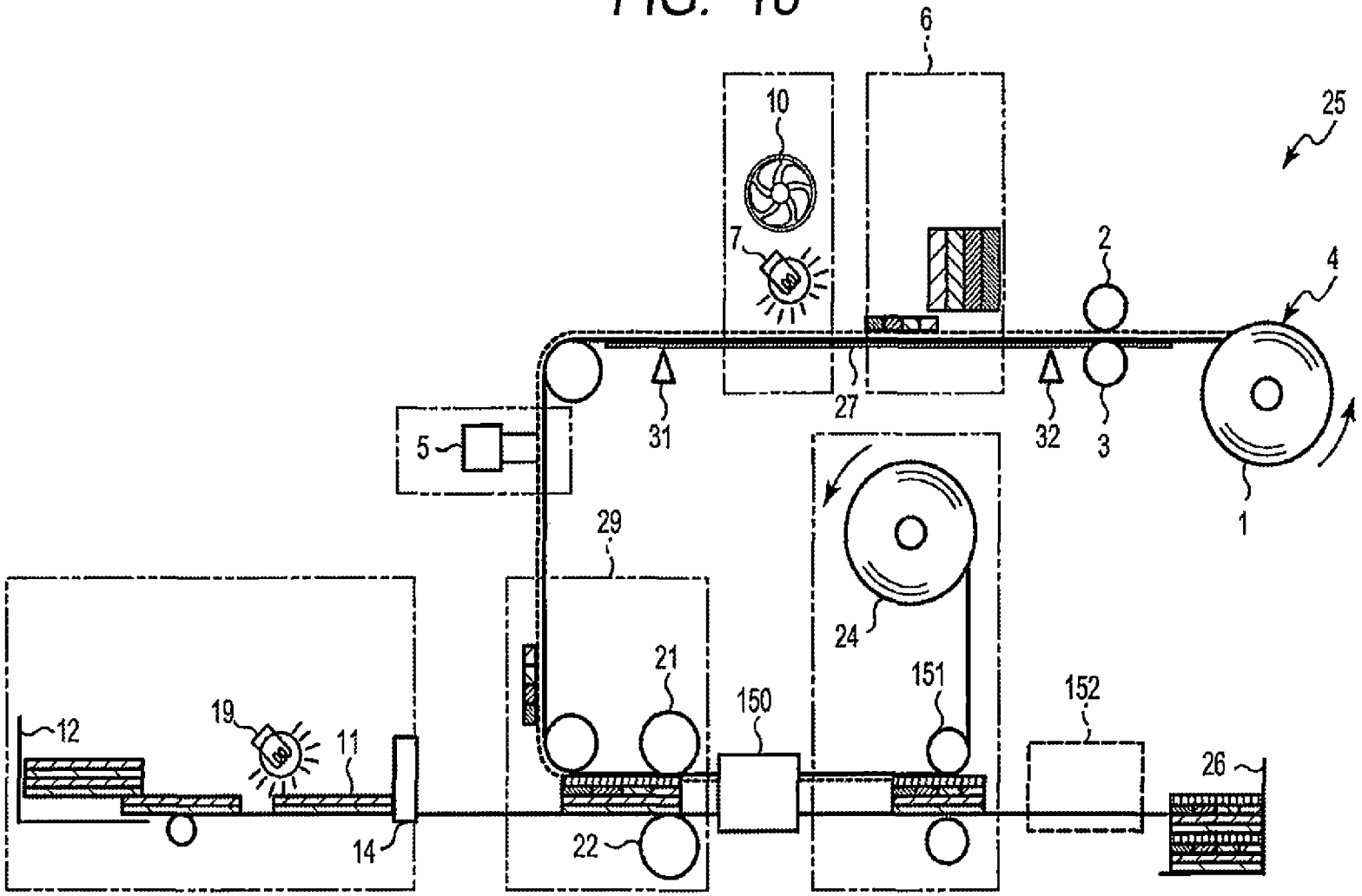
FIG. 16 is an explanatory view for schematically illustrating a first construction example of a manufacturing apparatus configured to manufacture a recorded matter.

At this time, when such a manufacturing apparatus 25 as illustrated in FIG. 16 is used, a silicone roll is preferably used as a heat roll 22 in contact with a side closer to an image support 11. With such construction, the SP value of the silicone roll becomes around 8.7, and hence the coloring material-receiving layer is hardly adhered to the heat roll 22 even by the thermal pressure bonding of the heat roll 21 configured to heat the coloring material-receiving layer from a side closer to the base material sheet, and hence the transfer of the coloring material-receiving layer can be prevented.

[3-4] Peeling of Base Material Sheet and Releasing Layer:

Finally, as illustrated in FIG. 12, the base material sheet 50 of the resultant recorded matter is peeled, whereby the recorded matter 73 having a structure in which the image support 55, the coloring material-receiving layer 53, and the transparent sheet 52 are laminated in the stated order is obtained. In the recorded matter 73, the transparent sheet 52 is positioned in the uppermost layer to protect the reverse image 72 recorded on the coloring material-receiving layer 53 positioned on a lower layer side thereof. It should be noted that when a primer layer is used, the image support 55 is sufficiently fixed by adhesion to the coloring material-receiving layer 53 through intermediation of the primer layer.

Figure 13:
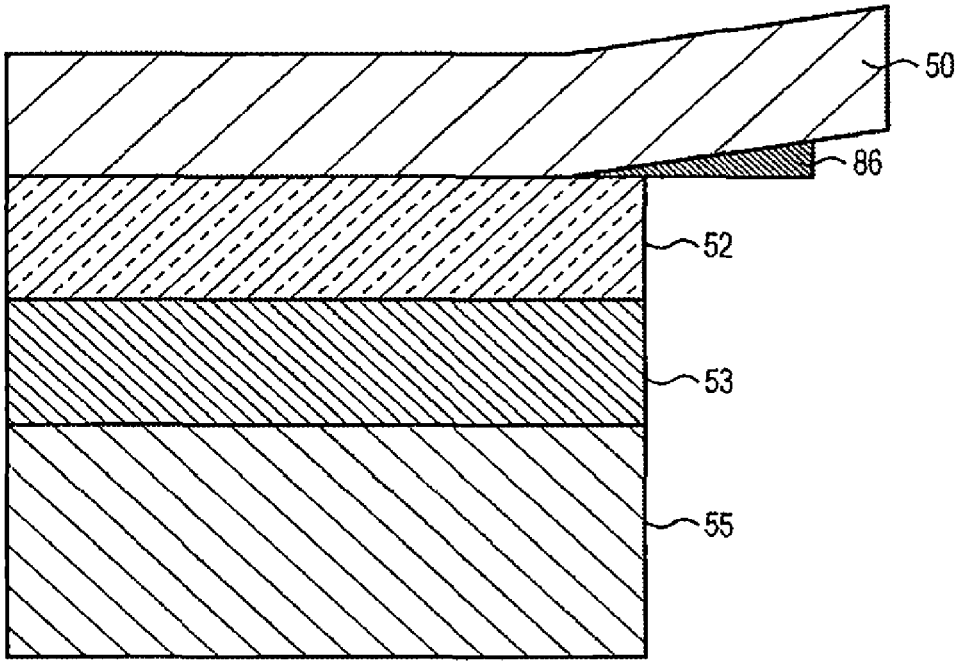
FIG. 13 is a sectional view for schematically illustrating the step of peeling a base material sheet from the laminate of the transfer material and the image support with a separation claw.

Upon peeling of the base material sheet, when the transfer material is of a hot peeling type, it is preferred that the peeling be immediately performed before the temperature of the laminate reduces after the thermal pressure bonding. In the case of such hot peeling type, the peeling is preferably performed by a peeling mechanism based on the separation claw 86 illustrated in FIG. 13 or by the peeling roll 88 illustrated in FIG. 14. The hot peeling type is suitable in terms of productivity when the supply of the transfer material in the transferring step is performed by a "roll-to-roll" process.

Figure 14:
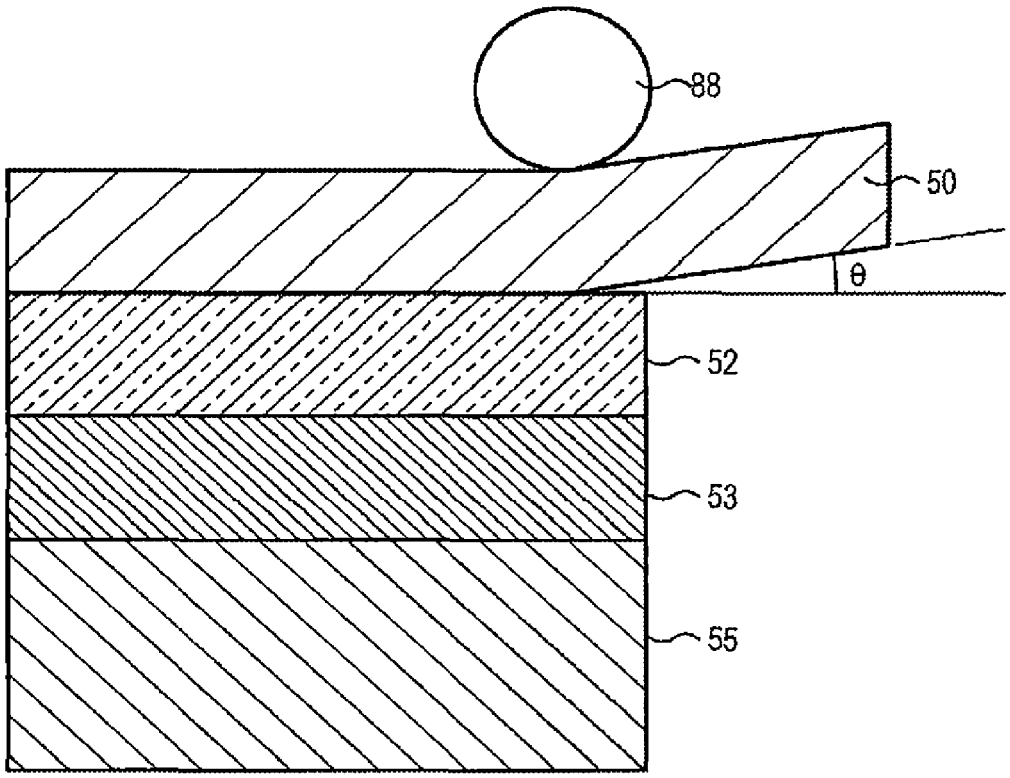
FIG. 14 is a sectional view for schematically illustrating the step of peeling the base material sheet from the laminate of the transfer material and the image support with a peeling roll.

On the other hand, when the transfer material is of a cold peeling type, the peeling can be performed even after the temperature has reduced. In such case, not only the peeling by the roll or the peeling mechanism but also manual peeling is available. Accordingly, the cold peeling type can be suitably used particularly when a transfer material processed into a cut sheet shape is used. It should be noted that the peeling angle θ when performing the peeling by the "roll-to-roll" process is preferably from 0° to 165°, more preferably from 0° to 90°. Setting the peeling angle θ as described above can prevent a patch portion separated by the precut process of the transfer material in the precut treatment portion from peeling or being turned up casually during the running of a printer. In FIG. 14, the peeling angle θ is an angle illustrated in the figure but is not limited thereto.

It should be noted that in the thermal pressure bonding and the peeling step, known laminating machines of a two-roll type and a four-roll type may be used. A laminating machine of a four-roll type is preferably used because as compared to a laminating machine of a two-roll type, heat at the time of the thermal pressure bonding can be easily transferred, and hence the transferring and peeling steps can be easily performed.

Figure 15:
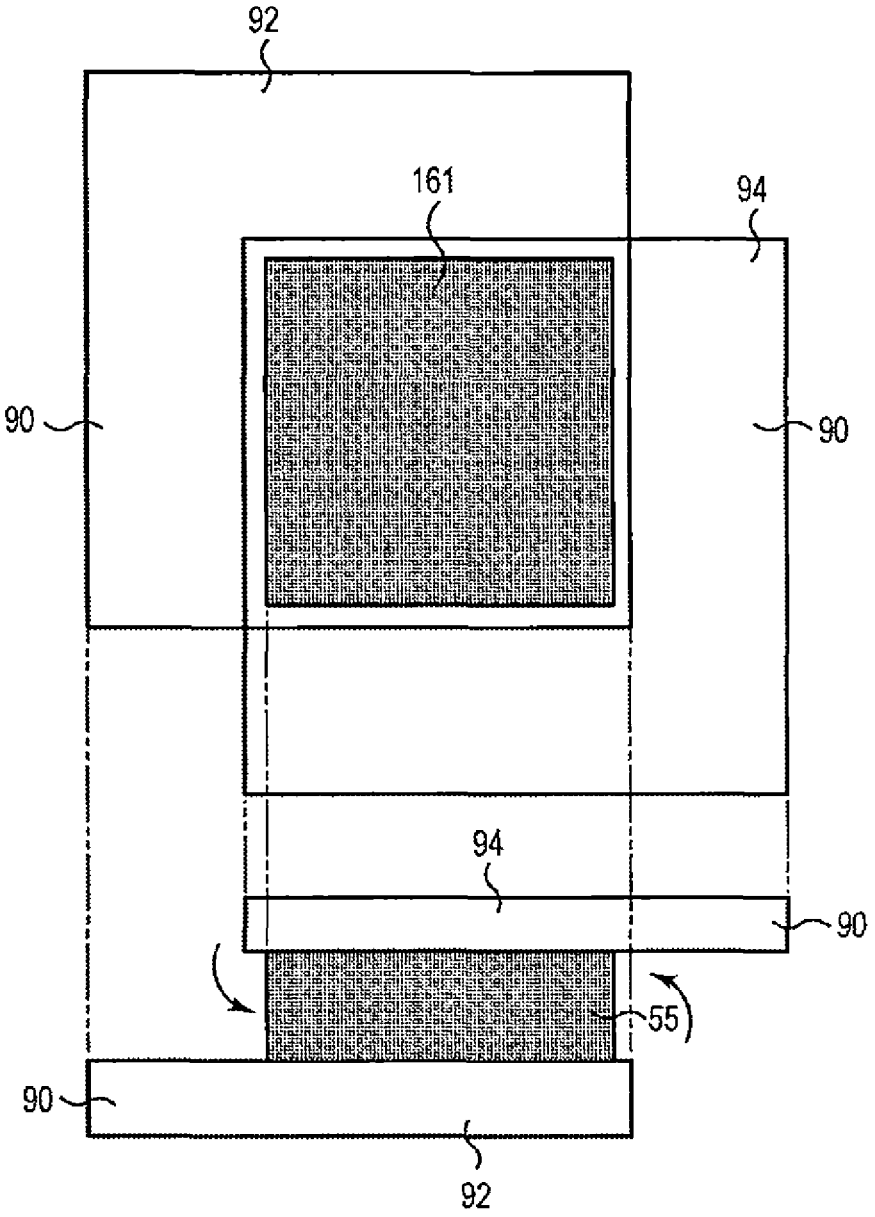
FIG. 15 are a top view and a side view for schematically illustrating a state in which the transfer material is attached to each of both surfaces of the image support.

[3-5] Double-Sided Simultaneous Peeling:

It should be noted that when printed matters are simultaneously transferred onto both surfaces of the image support, the printing positions of a lower-surface transfer material 92 and an upper-surface transfer material 94 on a film are preferably shifted from each other as illustrated in FIG. 15. With this construction, bonding between coloring material-receiving layers having the same SP value in heat roll transfer can be prevented, and hence the printed matters can be simultaneously transferred onto the front and back surfaces of the image support. In addition, the base material sheet can be easily peeled with a peeling portion 90.

[4] Image-Recording Apparatus:

An image-recording apparatus includes: a supplying portion configured to feed the transfer material described in the section [1] to a conveying path; and a recording portion configured to apply a coloring material to the coloring material-receiving layer of the transfer material fed to the conveying path to record an image.

[5] Apparatus for Manufacturing Recorded Matter:

An apparatus for manufacturing a recorded matter is an apparatus for manufacturing the recorded matter described in the section [2], the apparatus including: the image-recording apparatus described in the section [4]; an image support-supplying portion configured to feed an image support to a conveying path; an adhering portion configured to allow a transfer material to adhere to the image support fed to the conveying path; and a peeling portion configured to peel a base material sheet from the transfer material.

[5-1] Manufacturing Apparatus:

FIG. 16 is a side view for schematically illustrating a construction example of a manufacturing apparatus for manufacturing the recorded matter of this embodiment (hereinafter sometimes referred to as "manufacturing apparatus").

[5-1-1] Main Construction:

The manufacturing apparatus 25 includes: a supplying portion 4 configured to feed the transfer material 1 that has a roll shape and is rolled so that its coloring material-receiving layer may be arranged on its outer surface to a conveying path; and a recording portion 6 configured to directly eject an aqueous ink containing, for example, a coloring material, water, and a nonvolatile organic solvent onto the transfer material 1 fed to the conveying path to record a reverse image.

In addition, the manufacturing apparatus 25 includes: a drying portion 7 configured to vaporize water in the transfer material 1 having applied thereto the ink to improve its adhesiveness to the image support 11; a fan configured to prevent dew condensation in the machine due to the vaporized water; and a precut treatment portion 5 configured to perform a precut treatment on the transfer material 1 having recorded thereon the reverse image in the recording portion 6.

Further, the manufacturing apparatus 25 includes: a preheating portion 19 configured to heat the image support 11 to improve its adhesiveness to the transfer material 1; an adhesion portion 29 configured to allow the coloring material-receiving layer having recorded thereon the reverse image and a transparent sheet to adhere to the image support 11; a decurling portion 150 configured to correct the curling of the image support 11 after the adhesion; a peeling portion 151 configured to peel a base material sheet; an image-reversing portion 152 configured to reverse the image support 11 upon performance of duplex printing; and a discharge portion 26 configured to accumulate the discharged image support 11 having recorded thereon the reverse image.

[5-1-2] Operation:

The supplying portion 4 rotates the transfer material 1 that has a roll shape and is rolled so that the coloring material-receiving layer may be arranged on its outer surface in a direction indicated by the arrow in the figure, and feeds the transfer material 1 to the recording portion 6. At that time, the transfer material 1 is guided by a guide plate 27, and is sandwiched between a grip roller 3 and a nip roller 2, and is hence conveyed in a flat state to the recording portion 6.

When the conveyance of the transfer material 1 from the supplying portion 4 is started, the recording portion 6 records the reverse image on the coloring material-receiving layer of the transfer material 1. After that, the transfer material 1 passes the drying portion 7. The drying portion 7 vaporizes, for example, water in the ink forming the reverse image and the fan 10 exhausts the vaporized water. Thus, the transfer material 1 in which the reverse image has been recorded on the coloring material-receiving layer is obtained. At this time, marking printing is also performed. Next, the transfer material 1 is subjected to the detection of the position of a marking by a sensor portion 31, and is subjected to the precut treatment in the precut treatment portion 5.

Meanwhile, the image support-supplying portion 12 is configured to supply the image support 11 to the preheating portion 19 one by one.

The preheating portion 19 is configured to heat the image support 11 for improving the adhesiveness to the transfer material 1. Further, the registration guide 14 performs registration between the image support 11 and the transfer material 1. After that, the image support 11 is laminated on the transfer material 1.

The laminate of the image support 11 and the transfer material 1 is conveyed to the adhesion portion 29. The adhesion portion 29 includes the pair of heat rolls 21 and 22. The image support 11 and the transfer material 1 are thermally pressure-bonded upon passage of the laminate through the pair of heat rolls 21 and 22.

After that, the laminate of the image support 11 and the transfer material 1 is conveyed to the decurling portion 150, and its curling is corrected. Further, the base material sheet and the releasing layer constituting the transfer material 1 are peeled in the peeling portion 151, and are rolled around a take-up roll 24. In addition, upon performance of the duplex printing, the image support is reversed by the image-reversing portion 152 and the image support is fed back to the registration guide 14. In addition, a back surface image is similarly printed on the coloring material-receiving layer transferred onto the image support that has been fed back. After that, back surface printing is performed through the steps in the adhesion portion 29, the decurling portion 150, and the peeling portion 151 as in front surface printing. Through such operations, the recorded matter in which the transfer material 1 has been thermally pressure-bonded onto the image support 11 can be obtained.

Figure 17:
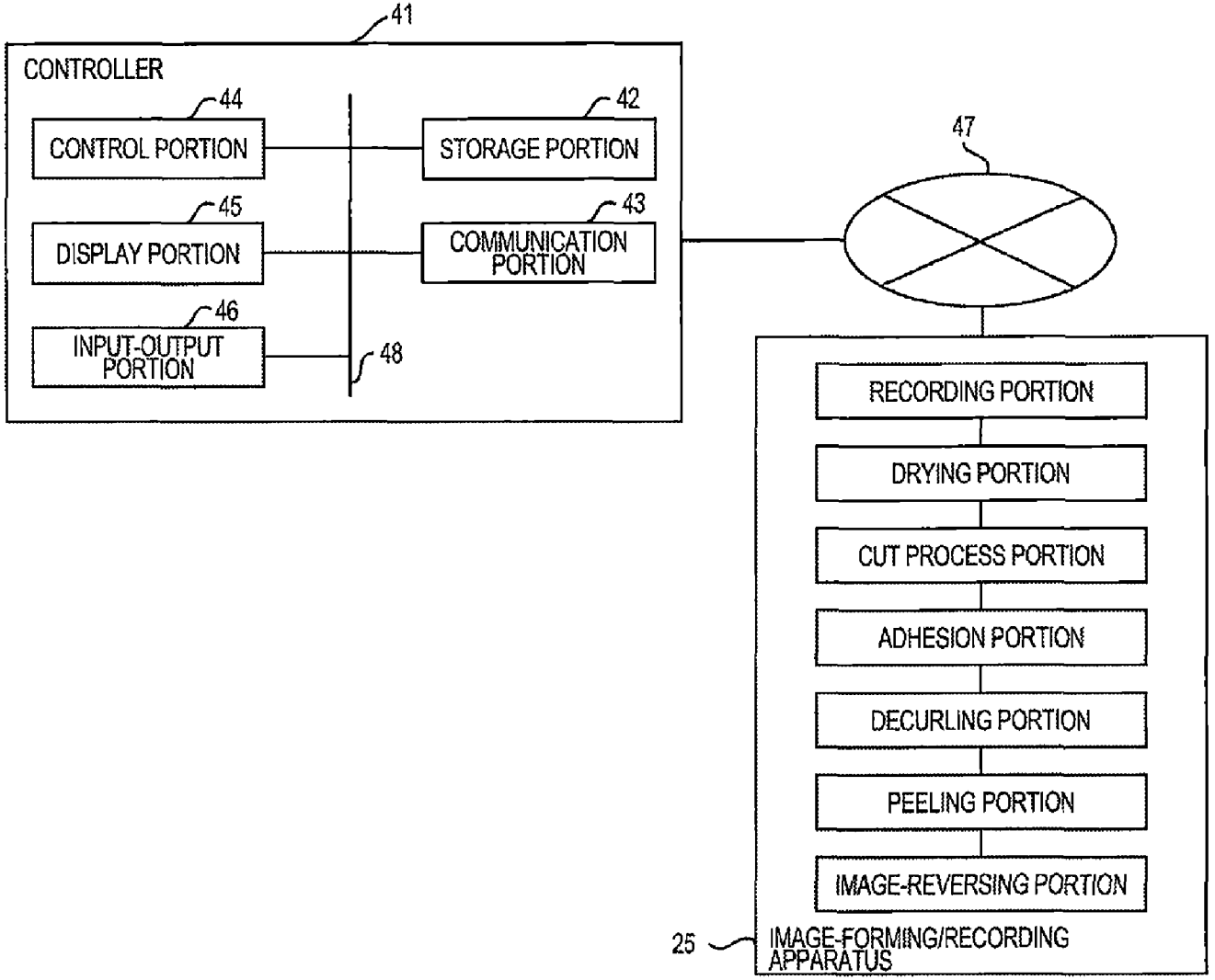
FIG. 17 is a block diagram for illustrating the state of connection between the manufacturing apparatus and a controller.

[5-1-3] Connection between Manufacturing Apparatus and Controller:

As illustrated in FIG. 17, a manufacturing apparatus (image-forming/recording apparatus) is connected to a controller 41 through a network 47. However, the manufacturing apparatus 25 can be connected to the controller 41 not through the network 47 but through, for example, a serial port, a parallel port, or a USB port. The manufacturing apparatus 25 includes, for example, the recording portion, the drying portion, the precut treatment portion, the adhesion portion, the decurling portion, the peeling portion, and the image-reversing portion. In addition, a CPU is included in the recording portion, and is connected to the recording portion, the drying portion, the precut treatment portion, the preheating portion, the adhesion portion, the decurling portion, the peeling portion, and the image-reversing portion. In addition, the CPU is configured to control the operations of the recording portion, the drying portion, the precut treatment portion, the preheating portion, the adhesion portion, the decurling portion, the peeling portion, and the image-reversing portion.

The network 47 is a network such as the Internet or a local area network (LAN), and may be a wired network or a wireless network. The controller 41 is a computer configured to control the manufacturing apparatus 25. In the controller 41, a controlling portion 44, a display portion 45, an input-output portion 46, a storage portion 42, and a communication portion 43 are connected to one another through a system bus 48. In addition, for example, a digital camera and a drive apparatus configured to read image data or the like are connected to the controller 41 in some cases. Further, a plate-making apparatus or the like is connected to the controller 41 in some cases.

The controlling portion 44 includes, for example, a central processing unit (CPU), a random access memory (RAM), and a read only memory (ROM). The CPU calls a program stored in, for example, the recording portion or the ROM to a work memory region on the RAM and executes the program, and performs arithmetic processing and operation control to control the entire system. The ROM is a nonvolatile memory, and permanently holds a program, data, and the like. In addition, the RAM is a volatile memory, and temporarily holds a program, data, and the like.

The display portion 45 is, for example, a display apparatus including: a display device, such as a CRT monitor or a liquid crystal panel; and a logic circuit (such as a video adapter) for realizing the video function of a computer in cooperation with the display device.

The input-output portion 46 is a portion configured to perform the input and output of data. An input portion configured to perform the input of data, is, for example, a keyboard, a pointing device such as a mouse, or a ten key. An operating instruction, a movement directive, data input, maintenance, and the like can be performed by a user on the controller 41 through such input portion. In addition, the input-output portion 46 is connected to, for example, a scanner and a drive apparatus (not shown), and transmits data input from any such external apparatus to the controlling portion 44 or outputs data to the external apparatus.

The storage portion 42 is an apparatus configured to store data, and examples thereof include a magnetic disk, a memory, and an optical disk apparatus. The program to be executed by the controlling portion 44, data necessary for the execution of the program, an operating system (OS), and the like are stored in the storage portion 42. In addition, a pattern to be recorded by the recording portion 6 of the manufacturing apparatus 25 can be stored in the storage portion 42. The communication portion 43 is a communication interface configured to mediate communication between the controller 41 and the network 47, and includes, for example, a communication-controlling apparatus and a communication port. It should be noted that a personal computer or the like can be used instead of the controller 41.

Figure 18:
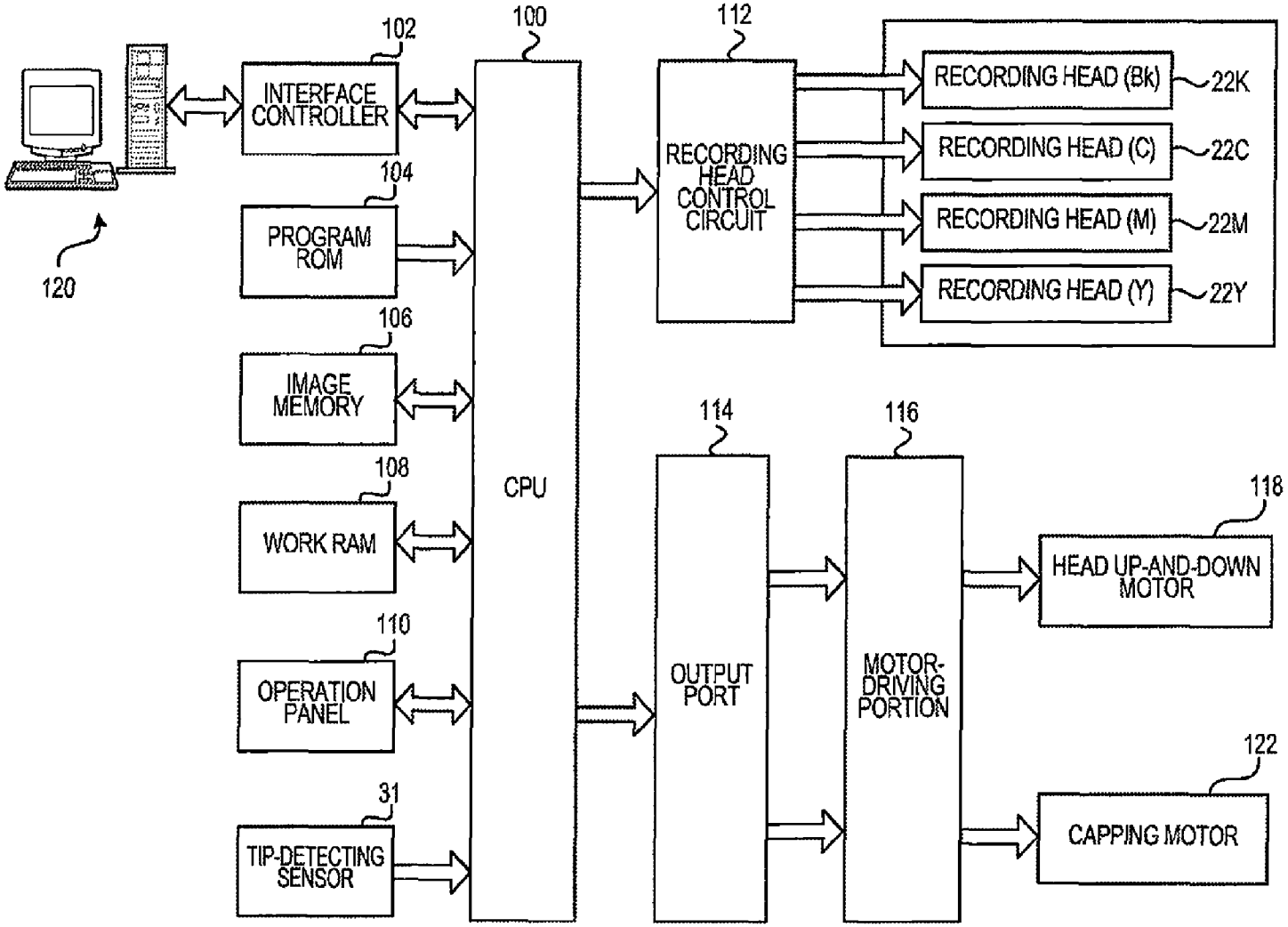
FIG. 18 is a block diagram for illustrating the construction of the control system of a recording portion illustrated in FIG. 17.

[5-1-4] Control System:

FIG. 18 is a block diagram for illustrating the construction of a control system arranged in the recording portion 6 illustrated in FIG. 16. Recorded data or a command transmitted from a host PC 120 is received by a CPU 100 through an interface controller 102. The CPU 100 is an arithmetic processing unit configured to govern general control, such as the reception of the recorded data of the recording portion, a recording operation, and the handling of a recording medium. After having analyzed the received command, the CPU 100 develops image data on each color component of the recorded data into a bit map in an image memory 106. As operation processing before recording, the CPU 100 drives a capping motor 122 and a head up-and-down motor 118 through an output port 114 and a motor-driving portion 116 so that the respective recording heads 22K, 22C, 22M, and 22Y may leave their capping positions (standby positions) to move to their recording positions (image-forming positions).

Subsequently, the position of the transfer material conveyed at a constant speed is detected by the sensor portion 31 (tip-detecting sensor) for determining the timing at which the ejection of an ink onto the transfer material is started (recording timing). After that, the CPU 100 sequentially reads out recorded data on the corresponding colors from the image memory 106 in synchronization with the conveyance of the transfer material, and transmits the data that has been read out to the respective recording heads 22K, 22C, 22M, and 22Y through a recording head-controlling circuit 112. Thus, ejection energy-generating elements arranged in the respective nozzles of the recording heads are driven in accordance with the recorded data, and ink droplets are ejected from the nozzles by the driven ejection energy-generating elements. The ejected ink droplets impinge on the coloring material-receiving layer (ink-receiving portion) of the transfer material at a position facing the recording heads to form dots. A desired image is formed by a set of the dots.

It should be noted that the operation of the CPU 100 is performed based on a processing program stored in the program ROM 104. A processing program, a table, and the like corresponding to a control flow are stored in the program ROM 104. In addition, the work RAM 108 is used as a working memory.

Figure 19:
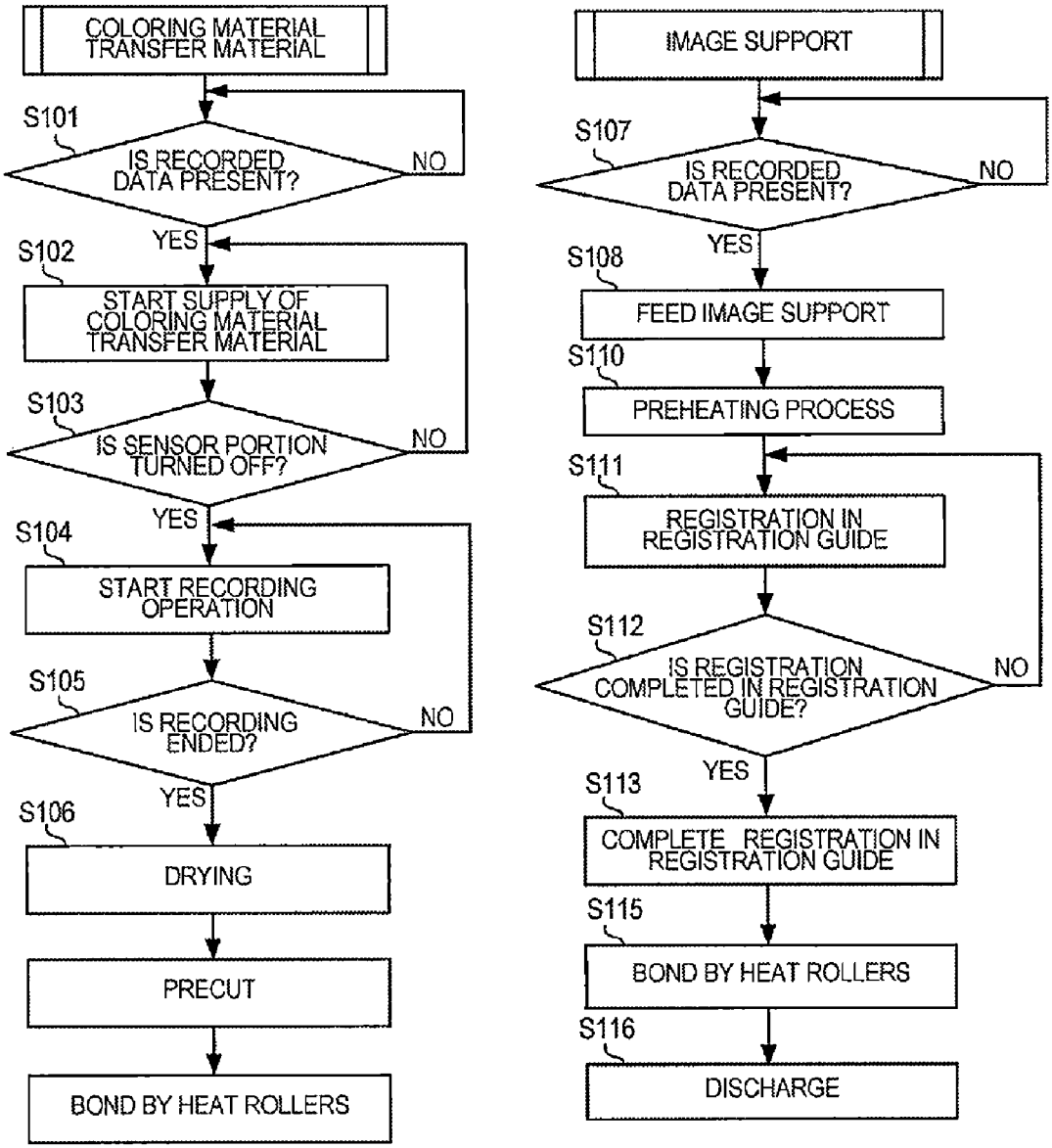
FIG. 19 is a flow chart for illustrating the operation flow of the manufacturing apparatus.

[5-1-5] Operation Flow of Manufacturing Apparatus:

Next, the operation flow of the manufacturing apparatus 25 illustrated in FIG. 16 is described in accordance with the flow chart of FIG. 19. The flow chart is performed by the CPU 100 illustrated in FIG. 18.

The CPU of the recording portion judges whether or not the recorded data is transmitted by the controller through the network or the various ports (Step S101). When it is judged that the recorded data is transmitted (YES of Step S101), the CPU starts the supply of an unrecorded transfer material from the supplying portion (Step S102). The sensor portion detects the transfer material. When the sensor portion does not detect the transfer material (is turned off (YES of Step S103)), a recording operation on the transfer material by the recording portion is started (Step S104). When the recording operation ends (YES of Step S105), the drying portion performs a drying treatment for vaporizing excess water from the transfer material recorded by the recording portion (Step S106). After that, the transfer material is conveyed to the precut treatment portion and is subjected to the precut treatment.

Meanwhile, when the recorded data is transmitted to the CPU (YES of Step S107), the image support is fed from the image support-supplying portion to the preheating portion (Step S108). After that, in order to improve the adhesiveness of the transfer material recorded by the recording portion, a preheating treatment by the preheating portion is performed (Step S110). The registration between the image support and the transfer material is started in the registration guide (Step S111), and the step proceeds to a subsequent step at the time point when the registration with the transfer material is completed (Step S113). At this time, judgement in Step S112 is YES, the image support is mounted on the transfer material, and the transfer material and the image support are bonded to each other by the adhesion portion (Step S115). After that, in association with the conveyance of the resultant to the peeling portion, the base material of the transfer material is peeled with a portion precut in the precut treatment portion as a starting point, whereby the recorded matter (final recorded matter) is mounted on the discharge portion (Step S116). The transparent sheet adheres to the recorded matter so as to sandwich the coloring material-receiving layer, and hence the recorded matter realizes excellent image quality and has a strong fastness property.

[5-1-6] Treatment performed by Manufacturing Apparatus:

[5-1-6-1] Position Detection and Precut Treatment of Transfer Material:

In the sensor portion 31 illustrated in FIG. 16, for the synchronization with the precut portion of the transfer material 1 and the adhesion portion, the position of the transfer material 1 is detected and each portion is controlled based on the result of the detection. A reflection- or transmission-type optical sensor is used in marking detection.

[5-1-6-2] Precut Treatment:

In the manufacture of the transfer material of this embodiment, after the formation of the coloring material-receiving layer, a precut treatment involving making a notch in part of the coloring material-receiving layer and the transparent sheet from a side closer to the coloring material-receiving layer may be performed. As a result of the precut treatment, after the reverse image has been recorded on the transfer material to provide a transfer material, and the transfer material and the image support have been bonded to each other, the transparent sheet can be beautifully cut with the notch as a starting point. Therefore, a strong protective layer formed of a transparent sheet having a uniform thickness can be formed, and hence sufficient durability is imparted to the reverse image formed on the coloring material-receiving layer. A preferred precut treatment is, for example, a method described in Japanese Patent Application Laid-Open No. 2015-110321.

[5-1-6-3] Recording Treatment:

An inkjet system image-forming apparatus (inkjet printer) configured to eject an ink (ink droplets) from a plurality of nozzles formed in a recording head onto a transfer material to form an image has been widely used. The following technology has been known as a technology for ejecting the ink droplets from the nozzles: a thermal energy according to a driving pulse is supplied to the ink in the nozzles to form air bubbles through film boiling, and the ink droplets are ejected from the nozzles with the air bubbles. A large number of ink droplets according to an image to be formed are ejected from the nozzles onto the transfer material, whereby the image is formed on the transfer material.

A full-line-type inkjet printer uses a line head obtained by arraying many multi-nozzle heads, which are each obtained by integrating a plurality of nozzles each formed of, for example, an ink ejection orifice and an ink channel, so that the heads may be perpendicular to the conveying direction of the transfer material in order to increase an image recording speed. The full-line-type inkjet printer simultaneously ejects the ink from the ink ejection orifices of the plurality of nozzles in accordance with the conveyance of the transfer material to record an image. Accordingly, the full-line-type inkjet printer can satisfy the following requirements which a current printer needs to satisfy: a high-resolution image in image-quality is formed at high speed and printing can be performed at the same speed as that at the time of the transfer. In addition, the inkjet printer has an advantage in that extremely stable image recording can be performed because each recording head and the transfer material are out of contact with each other at the time of the image recording.

In the manufacturing apparatus 25 illustrated in FIG. 16, the guide plate 27 is present in the course where the transfer material 1 is conveyed to the recording portion 6 while being sandwiched between the grip roller 3 and the nip roller 2. The transfer material 1 passes a portion above, and is guided by, the guide plate 27 to enter the recording portion 6. The recording portion 6 uses four recording heads formed of K, C, M, and Y inks as main constituent elements. The four recording heads eject the inks in accordance with image data, and eject ink droplets toward the coloring material-receiving layer arranged on the transfer material 1 to form an image.

[5-1-6-4] Water Vaporization Control:

When an ink remains on the surface of the receiving layer at the time of the transfer, its adhesion with the image support becomes insufficient. An inconvenience, such as insufficient adhesiveness or partial remaining of air bubbles in the receiving layer, may occur owing to abrupt vaporization of the ink component or the ink remaining on the surface layer of the receiving layer by heating at the time of the transfer. Accordingly, after the inkjet recording, predrying in which an effective twist is added to the conveying path of the transfer material may be needed before the transfer. Natural drying may be promoted as a construction including a conveying path having a sufficient length before the transfer without arranging any special drying unit, such as a heater. In addition, a unit configured to control or exhaust an air flow in the apparatus may be needed for the ink component that has vaporized at that time. As illustrated in FIG. 16, when the reverse image recorded on the coloring material-receiving layer on the transfer material 1 by the recording portion 6 is passed through a gap between the drying portion 7 and the guide plate 27, water serving as a main component for the ink in the image recorded on the receiving layer or a slight amount of a volatile solvent component in the ink is vaporized by the drying portion 7 having a vaporizing function by a heat source based on a halogen or a material equivalent thereto and wind, or a combination of the two. In addition, the air flow and an exhaust air are controlled by the fan 10 in order that a vaporized gas may be prevented from, for example, undergoing dew condensation in the machine. When the air flow control is used in combination, a saturated vapor pressure on the surface of the coloring material-receiving layer is improved, and hence the drying is accelerated in some cases.

At the time of the adhering step, the water content (total amount of, for example, water and a nonvolatile solvent except the coloring material) of the ink in the coloring material-receiving layer is controlled to preferably 70% or less, more preferably 50% or less with respect to the total input amount of the ink by water control. The case where the content of water remaining in the ink is more than 70% is not preferred because there is a risk in that an inconvenience, such as insufficient adhesiveness or partial remaining of air bubbles in the coloring material-receiving layer, occurs owing to abrupt vaporization of the ink component or the ink remaining on the surface layer of the receiving layer, though the risk varies depending on the thickness of the coloring material-receiving layer. In addition, the total input amount of the ink can be set to a proper input amount by, for example, limiting the input amount through, for example, the thinning-down of the number of dots at the time of the image formation in advance so that the water control may be appropriately performed, though the proper input amount varies depending on the ejection amount of a head.

[5-1-6-5] Adhering Step:

As illustrated in FIG. 16, the image is formed on the coloring material-receiving layer on the transfer material 1 in the recording portion 6, and then the transfer material 1 is guided to the portion above the guide plate 27 to move to the adhesion portion 29 including the two heat rolls 21 and 22. The image support 11 is placed in the form of a sheet-like sheet on the image support-supplying portion 12, its position is corrected by the registration guide 14, and the image support is supplied in accordance with the conveyance of the transfer material 1. The image support 11 is fed from a lower portion of the image support-supplying portion 12 in order to prevent the adhesion of dirt to the transfer surface of the image support 11 and the contamination of the image support 11 from a rubber roll at the time of its pickup.

The transfer material 1 and the image support 11 are conveyed to a gap between the heat rolls 21 and 22 while being superimposed on each other so that the coloring material-receiving layer of the transfer material 1 having formed thereon the image and the primer layer of the image support 11 may be brought into abutment with each other, followed by the heating of the transfer material and the image support. Thus, the image support 11 and the transfer material 1 having formed thereon the image bond to each other. After that, the base material sheet is peeled from the transfer material 1. Thus, a state in which the transparent sheet adheres onto the image support 11 together with the coloring material-receiving layer having formed thereon the image is established. In other words, on the image support 11, the transparent sheet is positioned as a protective film in the uppermost layer and the image is formed below the protective film.

In addition, the temperature at the time of the transfer is set to fall within the range of the vaporization temperature of the ink or less because the occurrence of abrupt vaporization of the water in the ink at the time of the transfer causes an adhesion failure, or partial remaining of air bubbles in the receiving layer. The heating of the coloring material-receiving layer at the time of the transfer is performed by thermal transfer not from the side of a thick image support, such as a plastic card, but mainly from the base material sheet side of the transfer material. The maximum temperature which the coloring material-receiving layer reaches at the time of the adhering step only needs to be controlled so as not to exceed the vaporization temperature of the water as a main component of the ink. In other words, the surface temperature of each heat roll upon bonding of the transfer material 1 and the image support 11 only needs to be such a temperature that air bubbles are not formed between the transfer material 1 and the image support 11 by the vaporization of the water. In addition, when the conveying speed or the like is so high that a time period for heating with a heat source cannot be sufficiently secured, a temperature difference can occur between the heat source and the receiving portion. Accordingly, the surface temperature of the heat roll can be controlled so as to be higher than the ordinary vaporization temperature of water, specifically to from 100° C. to 180° C. In addition, heating in a closed space causes an increase in boiling point due to an increase in pressure, and hence the vaporization temperature of water increases in the coloring material-receiving layer sandwiched between the primer layer and the transparent sheet layer. Accordingly, the surface temperature can be controlled to even higher temperature in consideration of the adhesive property and foil-cutting property.

[5-1-6-6] Preheating:

When the image support 11 is allowed to adhere to the transfer material 1 having recorded thereon the image while being registered therewith as illustrated in FIG. 16, the surface of the image support (a card or the like) is moderately heated in the preheating portion 19 before the adhesion of the transfer material 1. Thus, an excessive increase in temperature of the coloring material-receiving layer on the transfer material 1 due to heating can be controlled.

[5-1-6-7] Decurling:

As illustrated in FIG. 16, after the adhesion of the transfer material 1 to the image support 11, the curling of the image support 11 is corrected in the decurling portion 150, and the curling of the image support 11 is corrected to be flat. The correction of the curling of the image support can be performed by sandwiching the image support 11 between a heating plate and a supporting plate facing the heating plate while the image support 11 is hot.

[5-1-6-8] Peeling Treatment:

As illustrated in FIG. 16, the base material sheet portion of the transfer material 1 that has passed the adhesion portion 29 is rolled on the take-up roll 24 side after a region except the image-forming region has been peeled by the precut treatment, and the image supports 11 having formed thereon images are conveyed to the discharge portion 26 and accumulated one by one.

[5-1-6-9] Image-Reversing Apparatus:

Upon performance of the duplex printing, the manufacturing apparatus 25 preferably includes the image-reversing portion 152 as illustrated in FIG. 16. The recorded matter after the peeling is reversed by the reversing apparatus, and the reversed recorded matter is fed back to the registration guide 14 in order that back surface printing may be performed. Simultaneously with the foregoing, the transfer material is also fed back. After the feedback, the same treatments as those of front surface printing are performed in the recording portion, the adhesion portion, the decurling portion, and the peeling portion, whereby an image is formed on the back surface of the recorded matter as well.

FIG. 1 is an illustration of the construction of the recorded matter 73. As illustrated in FIG. 1, the recorded matter 73 brings together excellent image quality and a strong fastness property because the transparent sheet 52 adheres so that the coloring material-receiving layer 53 may be sandwiched between the image support 55 and the transparent sheet 52.

In addition to the foregoing, for example, an apparatus obtained by mounting the transfer material on a manufacturing apparatus described in Japanese Patent Application Laid-Open No. 2015-110321 can be used as the manufacturing apparatus. A construction in which a printer portion and a transferring portion are independent of each other is also permitted. A known apparatus may be used as each of the printer portion and the transferring portion.

As described above, according to the manufacturing apparatus, when a transfer material includes at least a transparent sheet and a coloring material-receiving layer on a base material, the control of the ink water content of the coloring material-receiving layer and temperature control at the time of adhesion are performed in the step of allowing the transfer material to adhere to an image support. Thus, the adhesive property between the transparent sheet of the transfer material and the image support is improved, and hence a recorded matter excellent in various kinds of durability, such as weatherability, water resistance, chemical resistance, and gas resistance, can be provided.

EXAMPLES

The present invention is hereinafter more specifically described by way of Examples and Comparative Examples. However, the present invention is by no means limited to Examples below. It should be noted that "part(s)" and "%" in the following description refer to "part(s) by mass" and "mass %", respectively, unless otherwise stated.

Example 1

A transparent sheet, a transfer material, and a recorded matter were manufactured by the following method.

[Synthesis of Emulsion Aqueous Solution 2]

A first reaction vessel made of glass was provided with a stirring machine, a reflux condenser, a temperature gauge, and a nitrogen gas-introducing tube. After that, 6 g of AQUALON RN-30 (manufactured by DKS Co., Ltd.) serving as a nonionic emulsifying agent, 6 g of an anionic emulsifying agent AQUALON HS-30 (manufactured by DKS Co., Ltd.), 130.0 g of methyl methacrylate, 5.0 g of ethyl acrylate, and 5.0 g of methacrylic acid were used, and these materials and 275 g of water were loaded into the reaction vessel and stirred to prepare a mixture having a total amount of 427.0 g. Next, 36 g of the mixture was removed and transferred to a second reaction vessel similar to the first reaction vessel. After that, the mixture was emulsified under the introduction of a nitrogen gas at 73° C. for 40 minutes. Next, 17 g of ammonium peroxodisulfate serving as a polymerization initiator was dissolved in 36 g of water, and the solution was added to the emulsified liquid. After that, the remainder of the mixture was removed from the first reaction vessel and gradually dropped to the second reaction vessel over 100 minutes, followed by polymerization at 73° C. After the completion of the dropping of the remainder of the mixture, stirring was continued at 73° C. for 80 minutes to synthesize an emulsion aqueous solution 2 (Tg: 101° C., resin solid content: 35.0%). The absolute value |ΔSP| of a difference between its SP value and the SP value of a coloring material-receiving layer was 0.2. Particles dispersed in the solution had an average particle diameter of 80 nm.

[Manufacture of Laminated Sheet]

90 Parts of J352D manufactured by Joncryl (Tg: 56° C., acrylic emulsion, concentration: 45%) and 10 parts of the emulsion aqueous solution 2 (Tg: 101° C.) were mixed, and the mixture was applied to the surface of a PET base material sheet (trade name: "Tetoron G2," thickness: 19 μm, manufactured by Teijin DuPont Films Japan Limited) and then dried. Thus, a laminated sheet was manufactured. The mixing ratio (E1/E2) of the emulsion E1 to the emulsion E2 was 11.6. The application was performed with a die coater at an application speed of 5 m/min so that a coating weight after the drying became 10 g/m$^2$. A drying temperature was set to 90° C.

[Preparation of Hydrated Alumina Dispersion Liquid]

20 Parts of a hydrated alumina A having a boehmite structure (pseudoboehmite structure) (trade name: "Disperal HP14," manufactured by Sasol) was added to pure water (79.6 parts), and 0.4 part of acetic acid was further added to perform a peptization treatment. Thus, a 20% hydrated alumina dispersion liquid was obtained. The average particle diameter of hydrated alumina fine particles in the hydrated alumina dispersion liquid was 140 nm. Next, 0.3 part of boric acid was added to the dispersion liquid to provide a boric acid-added hydrated alumina dispersion liquid.

[Preparation of Aqueous Solution of Polyvinyl Alcohol]

Polyvinyl alcohol (trade name: "PVA235," manufactured by KURARAY Co., Ltd.) was dissolved in ion-exchanged water to prepare an aqueous solution of polyvinyl alcohol having a solid matter content of 8%. It should be noted that the polyvinyl alcohol had a weight-average polymerization degree of 3,500, a saponification degree of from 87 mol % to 89 mol %, and a SP value of 9.4.

[Preparation of Coating Liquid for Forming Coloring Material-receiving Layer]

27.8 Parts of an aqueous solution of polyvinyl alcohol was added to 100 parts of a boric acid-added hydrated alumina dispersion liquid. Further, 3.0 parts of polyallylamine serving as a cationic resin was added to the mixture, and the contents were mixed with a static mixer to provide a coating liquid for forming a coloring material-receiving layer. A polyallylamine having a weight-average polymerization degree of 1,600 (trade name: "PAA-01", manufactured by Nitto Boseki Co., Ltd.) was used as the polyallylamine.

[Manufacture of Transfer Material]

Immediately after the mixing, the coating liquid was applied to the surface of a transparent sheet in a laminated sheet and dried. Thus, a transfer material of Example 1 including a gap absorption-type coloring material-receiving layer was manufactured. The coating liquid was applied with a die coater at an application speed of 5 m/min so that its coating weight after the drying became 10 g/m$^2$. A drying temperature was set to 60° C. The transfer material was turned into a roll-shaped transfer material by being rolled into a roll shape in which the coloring material-receiving layer was arranged on an outer side and the base material sheet was arranged on an inner side. The thickness of the coloring material-receiving layer was 10 μm.

60 Percent solid printing was performed on the resultant transfer material with a pigment ink by using the manufacturing apparatus (manufacturing apparatus 25 illustrated in the drawings). The transfer material was thermally pressure-bonded onto an image support, and then the base material sheet was peeled. Thus, a recorded matter of Example 1 was obtained. A method of preparing the pigment ink is described later. A print module having a line head mounted thereon (trade name: "PM-200Z", manufactured by Canon Finetech Inc.) was used as the recording portion 6 of the manufacturing apparatus 25, and a card made of vinyl chloride (trade name: "C-4002", manufactured by Evolis) was used as the image support. The thermal pressure bonding was performed under the conditions of a temperature of 160° C., a pressure of 3.9 kg/cm, and a conveying speed of 50 mm/sec. A peeling angle upon peeling of the base material sheet was set to 90°. The difference SP2 between the SP value of the coloring material-receiving layer and the SP value of the image support was 0.1.

[Preparation of Pigment Ink]

<Synthesis of (Meth)acrylate-based Copolymer>

Synthesis Example 1

1,000 Parts of methyl ethyl ketone was loaded into a reaction vessel provided with a stirring apparatus, a dropping apparatus, a temperature sensor, and a reflux apparatus including a nitrogen-introducing apparatus in an upper portion thereof, and the reaction vessel was purged with nitrogen while the methyl ethyl ketone was stirred. While a nitrogen atmosphere in the reaction vessel was maintained, a temperature in the vessel was increased to 80° C. After that, a mixed liquid obtained by mixing 63 parts of 2-hydroxyethyl methacrylate, 141 parts of methacrylic acid, 417 parts of styrene, 188 parts of benzyl methacrylate, 25 parts of glycidyl methacrylate, 33 parts of a polymerization degree adjustor (trade name: "BLEMMER TGL", manufactured by Nippon Oil & Fats Co., Ltd.), and 67 parts of t-butyl peroxy-2-ethylhexanoate was dropped from the dropping apparatus over 4 hours. After the completion of the dropping, a reaction was further continued at the temperature for 10 hours to provide a solution (resin content: 45.4%) of a (meth)acrylate-based copolymer (A-1) having an acid value of 110 mgKOH/g, a glass transition point (Tg) of 89° C., and a weight-average molecular weight of 8,000.

<Aqueous Pigment Dispersion Preparation 1>

1,000 Parts of a phthalocyanine-based blue pigment, the solution of the (meth)acrylate-based copolymer (A-1) obtained in Synthesis Example 1, a 25% aqueous solution of potassium hydroxide, and water were loaded into a mixing tank having a cooling function, and were stirred and mixed to provide a mixed liquid. It should be noted that the (meth)acrylate-based copolymer (A-1) was used in such an amount that its ratio with respect to the phthalocyanine-based blue pigment became 40% in terms of a nonvolatile content. In addition, the 25% aqueous solution of potassium hydroxide was used in an amount by which 100% of the (meth)acrylate-based copolymer (A-1) was neutralized. Further, water was used in an amount by which the nonvolatile content of the mixed liquid to be obtained was set to 27%. The resultant mixed liquid was passed through a dispersing apparatus filled with zirconia beads each having a diameter of 0.3 mm, and was dispersed for 4 hours by a circulation system. It should be noted that the temperature of the dispersion liquid was held at 40° C. or less.

After the dispersion liquid had been taken out from the mixing tank, a flow channel between the mixing tank and the dispersing apparatus was washed with 10,000 parts of water, and the washing liquid and the dispersion liquid were mixed to provide a diluted dispersion liquid. The resultant diluted dispersion liquid was loaded into a distilling apparatus, and the total amount of methyl ethyl ketone and part of water were removed by distillation. Thus, a concentrated dispersion liquid was obtained. While the concentrated dispersion liquid left standing to cool to room temperature was stirred, 2% hydrochloric acid was dropped to the dispersion liquid to adjust its pH to 4.5. After that, the solid matter of the resultant was filtered out with a Nutsche-type filtering apparatus and washed with water. The resultant solid matter (cake) was loaded into a container and water was added. After that, the mixture was redispersed with a dispersion stirring machine and the pH of the resultant was adjusted to 9.5 with a 25% aqueous solution of potassium hydroxide. After that, coarse particles were removed with a centrifugal separator at 6,000 G over 30 minutes, and then the nonvolatile content of the remainder was adjusted. Thus, an aqueous cyan pigment dispersion (pigment content: 14%, acid value: 110) was obtained.

An aqueous black pigment dispersion, an aqueous magenta pigment dispersion, or an aqueous yellow pigment dispersion was obtained in the same manner as in the aqueous cyan pigment dispersion except that the phthalocyanine-based blue pigment was changed to a carbon black-based black pigment, a quinacridone-based magenta pigment, or a diazo-based yellow pigment.

<Preparation of Ink>

An aqueous pigment dispersion and respective components shown in Table 3 were loaded into a container so as to achieve the composition shown in Table 3 (total: 100 parts), and were stirred with a propeller stirring machine for 30 minutes or more. After that, the mixture was filtered with a filter having a pore diameter of 0.2 μm (manufactured by Nihon Pall Ltd.) to prepare a pigment ink. It should be noted that the term "AE-100" in Table 3 represents an adduct of acetylene glycol with 10 mol of ethylene oxide (trade name: "Acetylenol E100", manufactured by Kawaken Fine Chemicals Co., Ltd.).

TABLE 3

| | Bk | C | M | Y |
|---|---|---|---|---|
| Acid value (mgKOH/g) | 110 | 110 | 110 | 110 |
| Pigment (part(s)) | 2.5 | 2.5 | 2.5 | 2.5 |
| Glycerin (part(s)) | 7 | 7 | 7 | 7 |
| Triethylene glycol (part(s)) | 5 | 5 | 5 | 5 |
| Ethyleneurea (part(s)) | 12 | 12 | 12 | 12 |
| AE-100 (part(s)) | 0.5 | 0.5 | 0.5 | 0.5 |
| Pure water (part(s)) | balance | balance | balance | balance |

Example 2

A transfer material and a recorded matter were obtained in the same manner as in Example 1 except that the ratio (E1/E2) of the emulsion E1 to the emulsion E2 was changed to 30.9.

Example 3

A transfer material and a recorded matter were obtained in the same manner as in Example 1 except that the emulsion aqueous solution 2 was changed to SUPERFLEX 130 manufactured by DKS Co., Ltd. (Tg: 101° C., resin solid content: 35.0%).

Example 4

[Synthesis of Emulsion Aqueous Solution 3]

An emulsion aqueous solution 3 (Tg: 40° C., resin solid content: 45.0%) was synthesized by exactly the same method as that of the emulsion aqueous solution 2 except that 55 g of 2-hydroxyethylhexyl acrylate, 30.0 g of methyl acrylate, 50.0 g of methyl methacrylate, and 10.0 g of acrylic acid were used. Particles dispersed in the solution had an average particle diameter of 80 nm. The |ΔSP| was 0.5.

[Synthesis of Emulsion Aqueous Solution 4]

An emulsion aqueous solution 4 (Tg: 78° C., resin solid content: 45.0%) was synthesized by exactly the same method as that of the emulsion aqueous solution 2 except that 100.0 g of methyl methacrylate, 20.0 g of ethyl acrylate, 10.0 g of 2-hydroxyethylhexyl acrylate, and 5.0 g of methacrylic acid were used. Particles dispersed in the solution had an average particle diameter of 80 nm. The |ΔSP| was 0.2.

[Synthesis of Emulsion Aqueous Solution 5]

An emulsion aqueous solution 5 (Tg: 51° C., resin solid content: 45.0%) was synthesized by exactly the same method as that of the emulsion aqueous solution 2 except that 50.0 g of methyl acrylate, 5.0 g of ethyl acrylate, 40.0 g of methyl methacrylate, and 5.0 g of methacrylic acid were used. Particles dispersed in the solution had an average particle diameter of 80 nm. The |ΔSP| was 0.4.

[Synthesis of Emulsion Aqueous Solution 6]

An emulsion aqueous solution 6 (Tg: 90° C., resin solid content: 35.0%) was synthesized by exactly the same method as that of the emulsion aqueous solution 2 except that 20.0 g of methyl acrylate, 115.0 g of ethyl acrylate, 5.0 g of 2-hydroxyl acrylate, and 10.0 g of methacrylic acid were used. Particles dispersed in the solution had an average particle diameter of 80 nm. The |ΔSP| was 0.3.

[Synthesis of Emulsion Aqueous Solution 7]

An emulsion aqueous solution 7 (Tg: 59° C., resin solid content: 45.0%) was synthesized by exactly the same method as that of the emulsion aqueous solution 2 except that 50.0 g of methyl methacrylate, 35.0 g of 2-hydroxyl acrylate, and 5.0 g of methacrylic acid were used. Particles dispersed in the solution had an average particle diameter of 80 nm. The |ΔSP| was 0.5.

[Synthesis of Transfer Material]

A transfer material and a recorded matter were obtained in the same manner as in Example 1 except that: the J352D was changed to the emulsion aqueous solution 5; and the ratio E1/E2 was changed to 3.0.

Example 5

A transfer material and a recorded matter were obtained in the same manner as in Example 1 except that: the J352D was changed to the emulsion aqueous solution 4; and the ratio E1/E2 was changed to 3.0.

Example 6

A transfer material and a recorded matter were obtained in the same manner as in Example 1 except that: the emulsion aqueous solution 2 was changed to the emulsion aqueous solution 6; and the ratio E1/E2 was changed to 3.0.

Example 7

A transfer material and a recorded matter were obtained in the same manner as in Example 1 except that: the J352D was changed to the emulsion aqueous solution 7; and the ratio E1/E2 was changed to 3.0.

Example 8

A transfer material and a recorded matter were obtained in the same manner as in Example 1 except that the ratio E1/E2 was changed to 3.0.

Example 9

A transfer material and a recorded matter were obtained in the same manner as in Example 1 except that the ratio E1/E2 was changed to 63.0.

Example 10

A transfer material and a recorded matter were obtained in the same manner as in Example 1 except that: the J352D was changed to VINYBLAN 603 manufactured by Nisshin Chemical Co., Ltd. (Tg: 60° C., vinyl chloride-based emulsion, |ΔSP|=0.2, resin solid content: 50%); and the ratio E1/E2 was changed to 3.0.

Example 11

A transfer material and a recorded matter were obtained in the same manner as in Example 1 except that: the J352D was changed to Vylonal MD 1245 manufactured by Toyobo Co., Ltd. (Tg: 61° C., polyester-based emulsion, |ΔSP|=1.3, resin solid content: 30%); and the ratio E1/E2 was changed to 3.0.

Example 12

A transfer material and a recorded matter were obtained in the same manner as in Example 1 except that the ratio E1/E2 was changed to 1.3.

Example 13

A transfer material and a recorded matter were obtained in the same manner as in Example 1 except that the ratio E1/E2 was changed to 127.3.

Example 14

A transfer material and a recorded matter were obtained in the same manner as in Example 1 except that the transfer temperature was changed to 95° C.

Example 15

A transfer material and a recorded matter were obtained in the same manner as in Example 1 except that 1 part of HYDRAN CP-7050 manufactured by DIC Corporation (Tg: 190° C., solid content concentration: 25 mass %) was added.

Comparative Example 1

A transfer material and a recorded matter were obtained in the same manner as in Example 1 except that a laminated sheet was produced by applying only the J352D.

Comparative Example 2

A transfer material and a recorded matter were obtained in the same manner as in Example 1 except that: a laminated sheet was produced by applying only the emulsion aqueous solution 2; and the drying temperature at the time of the formation of the transparent sheet and at the time of the formation of the coloring material-receiving layer was changed to 120° C.

Comparative Example 3

A transfer material and a recorded matter were obtained in the same manner as in Example 1 except that: the drying temperature at the time of the formation of the transparent sheet was changed to 120° C.; and the ratio E1/E2 was changed to 3.0.

Comparative Example 4

A transfer material and a recorded matter were obtained in the same manner as in Example 1 except that: the drying temperature at the time of the formation of the coloring material-receiving layer was changed to 120° C.; and the ratio E1/E2 was changed to 3.0.

Comparative Example 5

A transfer material and a recorded matter were obtained in the same manner as in Example 1 except that: the J352D was changed to the emulsion aqueous solution 3; and the ratio E1/E2 was changed to 3.0.

Comparative Example 6

A transfer material and a recorded matter were obtained in the same manner as in Example 1 except that: the J352D was changed to the emulsion aqueous solution 6; and the ratio E1/E2 was changed to 3.0.

Comparative Example 7

A transfer material and a recorded matter were obtained in the same manner as in Example 1 except that: the emulsion aqueous solution 2 was changed to the emulsion aqueous solution 4; and the ratio E1/E2 was changed to 3.0.

[Evaluation <Cutting Property>]

The state of an end portion of a recorded matter upon manufacture of the recorded matter through the transfer of the coloring material-receiving layer onto the image support with each of the transfer materials of Examples or Comparative Examples was evaluated. The evaluation was performed by visual observation. The results are shown in Table 4 to Table 6.

●: An unnecessary transferred layer protruding from the end portion is absent.

○: A small amount of a site (burr) where an unnecessary transferred layer protrudes from the end portion is present.

Δ: A site (burr) where an unnecessary transferred layer protrudes from the end portion is present.

×: A large amount of burrs occur over the entirety of the end portion of the recorded matter.

[Evaluation <Adhesive Property (Peelability)>]

An adhesive property test was performed by using each of the recorded matters of Examples or Comparative Examples.

The state of the transparent sheet was evaluated by visually observing the surface of the transferred recorded matter. A 5-millimeter square notch was made in the recorded matter with a cutter, Cellotape (trademark) was attached to the surface of the transparent sheet, and the state of the transparent sheet upon vigorous peeling of the tape while a load of 500 g/cm$^2$ was applied was evaluated. The results are shown in Table 4 to Table 6.

●: No peeling occurs.

○: The peeling of 5% or less of the entirety of the sheet occurs.

Δ: The peeling of 10% or less of the entirety of the sheet occurs.

×: The peeling of more than 10% of the entirety of the sheet occurs.

[Evaluation <Chemical Resistance>]

A chemical resistance test was performed by using each of the recorded matters of Examples or Comparative Examples. The recorded matter was immersed in 98% ethanol for 1 day and the state of the recorded matter was evaluated. The results are shown in Table 4 to Table 6.

●: No peeling occurs.

○: Fine cracking occurs.

Δ: The peeling of 10% or less of the entirety of the recorded matter occurs.

×: The peeling of more than 10% of the entirety of the recorded matter occurs.

[Evaluation <Sticking Property>]

A sticking property test was performed by using each of the recorded matters of Examples or Comparative Examples. The extent to which the recorded matter stuck to a hand when the recorded matter was touched with the hand was evaluated as the sticking property of the recorded matter. The results are shown in Table 4 to Table 6.

●: The ink-receiving layer is not sticky.

○: The ink-receiving layer is somewhat sticky but does not stick to the hand.

Δ: The ink-receiving layer is somewhat sticky and sticks to the hand.

×: The ink-receiving layer is severely sticky and sticks to the hand.

[Evaluation <Cracking>]

The cracking of the transparent sheet of each of the recorded matters of Examples or Comparative Examples was evaluated visually and with a microscope. The results are shown in Table 4 to Table 6.

●: No cracking of the transparent sheet occurs.

○: The cracking of the transparent sheet is not observed with the eyes but is observed in an extremely small amount with the microscope.

Δ: The cracking of the transparent sheet occurs but no peeling of the transparent sheet occurs.

×: The cracking of the transparent sheet occurs and the peeling of the transparent sheet occurs.

TABLE 4

| | | | Example 1 Coloring material transfer material 1 | Example 2 Coloring material transfer material 2 | Example 3 Coloring material transfer material 3 | Example 4 Coloring material transfer material 4 | Example 5 Coloring material transfer material 5 | Example 6 Coloring material transfer material 6 | Example 7 Coloring material transfer material 7 | Example 8 Coloring material transfer material 8 |
|---|---|---|---|---|---|---|---|---|---|---|
| Protective layer | E1 (Low Tg) | Brand | J352D | J352D | J352D | Emulsion aqueous solution 5 | Emulsion aqueous solution 4 | J352D | Emulsion aqueous solution 7 | J352D |
| | | Resin | Acrylic resin | Acrylic resin | Acrylic resin | Acrylic resin | Acrylic resin | Acrylic resin | Acrylic resin | Acrylic resin |
| | | tg1 | 56° C. | 56° C. | 56° C. | 51° C. | 78° C. | 56° C. | 59° C. | 56° C. |
| | | \|ΔSP\| | 0.2 | 0.2 | 0.2 | 0.4 | 0.2 | 0.2 | 0.5 | 0.2 |

TABLE 4-continued

| | | | Example 1 Coloring material transfer material 1 | Example 2 Coloring material transfer material 2 | Example 3 Coloring material transfer material 3 | Example 4 Coloring material transfer material 4 | Example 5 Coloring material transfer material 5 | Example 6 Coloring material transfer material 6 | Example 7 Coloring material transfer material 7 | Example 8 Coloring material transfer material 8 |
|---|---|---|---|---|---|---|---|---|---|---|
| | E2 (High Tg) | Brand | Emulsion aqueous solution 2 | Emulsion aqueous solution 2 | SUPERFLEX 130 | Emulsion aqueous solution 2 | Emulsion aqueous solution 2 | Emulsion aqueous solution 6 | Emulsion aqueous solution 2 | Emulsion aqueous solution 2 |
| | | Resin | Acrylic resin | Acrylic resin | Urethane-based resin | Acrylic resin | Acrylic resin | Acrylic resin | Acrylic resin | Acrylic resin |
| | | tg2 | 101° C. | 101° C. | 101° C. | 101° C. | 101° C. | 90° C. | 101° C. | 101° C. |
| | | Particle diameter | 80 nm | 80 nm | 30 nm | 80 nm | 80 nm | 80 nm | 80 nm | 80 nm |
| | | E1/E2 | 11.6 | 30.9 | 11.6 | 3.0 | 3.0 | 3.0 | 3.0 | 3.0 |
| | Others | Brand | | | | | | | | |
| | | Tg | | | | | | | | |
| Process | Drying temperature at time of formation of transparent sheet (° C.) | | 90 | 90 | 90 | 90 | 90 | 80 | 90 | 90 |
| | Drying temperature at time of formation of coloring material-receiving layer (° C.) | | 90 | 90 | 90 | 90 | 90 | 80 | 90 | 90 |
| | States of emulsions in transfer material (E1/E2) | | Film/ particle | Film/ particle | Film/ particle | Film/ particle | Film/ particle | Film/ particle | Film/ particle | Film/ particle |
| | Transfer temperature (° C.) | | 140 | 140 | 140 | 140 | 140 | 140 | 140 | 140 |
| | State of E2 in recorded matter | | Film | Film | Film | Film | Film | Film | Film | Film |
| Receiving layer | Inorganic fine particles | | HP-14 | HP-14 | HP-14 | HP-14 | HP-14 | HP-14 | HP-14 | HP-14 |
| | Water-soluble resin | | PVA235 | PVA235 | PVA235 | PVA235 | PVA235 | PVA235 | PVA235 | PVA235 |
| Evaluation | Cutting property | | ● | ● | ● | ○ | ○ | ○ | ○ | ○ |
| | Adhesive property | | ● | ● | ● | ○ | ○ | ○ | ○ | ○ |
| | Chemical resistance | | ○ | ○ | ● | ○ | ○ | ○ | ○ | ○ |
| | Stickiness | | ○ | ○ | ● | ○ | ○ | ○ | ○ | ○ |
| | Cracking | | ● | ● | ● | ○ | ○ | ○ | ○ | ○ |

TABLE 5

| | | | Example 9 Coloring material transfer material 9 | Example 10 Coloring material transfer material 10 | Example 11 Coloring material transfer material 11 | Example 12 Coloring material transfer material 12 | Example 13 Coloring material transfer material 13 | Example 14 Coloring material transfer material 14 | Example 15 Coloring material transfer material 15 |
|---|---|---|---|---|---|---|---|---|---|
| Protective layer | E1 (Low Tg) | Brand | J352D | Vinylbran 603 | MD-1245 | J352D | J352D | J352D | J352D |
| | | Resin | Acrylic resin | Vinyl chloride-based resin | Ester-based resin | Acrylic resin | Acrylic resin | Acrylic resin | Acrylic resin |
| | | tg1 | 56° C. | 60° C. | 61° C. | 56° C. | 56° C. | 56° C. | 56° C. |
| | | \|ΔSP\| | 0.2 | 0.2 | 1.3 | 0.2 | 0.2 | 0.2 | 0.2 |
| | E2 (High Tg) | Brand | Emulsion aqueous solution 2 | Emulsion aqueous solution 2 | Emulsion aqueous solution 2 | Emulsion aqueous solution 2 | Emulsion aqueous solution 2 | Emulsion aqueous solution 2 | Emulsion aqueous solution 2 |
| | | Resin | Acrylic resin | Acrylic resin | Acrylic resin | Acrylic resin | Acrylic resin | Acrylic resin | Acrylic resin |
| | | tg2 | 101° C. | 101° C. | 101° C. | 101° C. | 101° C. | 101° C. | 101° C. |
| | | Particle diameter | 80 nm | 80 nm | 80 nm | 80 nm | 80 nm | 80 nm | 80 nm |
| | | E1/E2 | 63.0 | 3.0 | 3.0 | 1.3 | 127.3 | 3.0 | 3.0 |
| | Others | Brand | | | | | | | CP 7050 |
| | | Tg | | | | | | | 190° C. |

TABLE 5-continued

| | | Example 9 Coloring material transfer material 9 | Example 10 Coloring material transfer material 10 | Example 11 Coloring material transfer material 11 | Example 12 Coloring material transfer material 12 | Example 13 Coloring material transfer material 13 | Example 14 Coloring material transfer material 14 | Example 15 Coloring material transfer material 15 |
|---|---|---|---|---|---|---|---|---|
| Process | Drying temperature at time of formation of transparent sheet (° C.) | 90 | 90 | 90 | 90 | 90 | 90 | 90 |
| | Drying temperature at time of formation of coloring material-receiving layer (° C.) | 90 | 90 | 90 | 90 | 90 | 90 | 90 |
| | States of emulsions in transfer material (E1/E2) | Film/particle | Film/particle | Film/particle | Film/particle | Film/particle | Film/particle | Film/particle |
| | Transfer temperature (° C.) | 140 | 140 | 140 | 140 | 140 | 95 | 140 |
| | State of E2 in recorded matter | Film | Film | Film | Film | Film | Particle | Film |
| Receiving layer | Inorganic fine particles | HP-14 | HP-14 | HP-14 | HP-14 | HP-14 | HP-14 | HP-14 |
| | Water-soluble resin | PVA235 | PVA235 | PVA235 | PVA235 | PVA235 | PVA235 | PVA235 |
| Evaluation | Cutting property | ○ | Δ | ○ | ○ | Δ | Δ | ○ |
| | Adhesive property | ○ | ○ | Δ | Δ | ○ | Δ | ○ |
| | Chemical resistance | ○ | ○ | ○ | ○ | ○ | ○ | ○ |
| | Stickiness | ○ | ○ | ○ | ○ | ○ | ○ | ○ |
| | Cracking | ○ | ○ | ○ | Δ | ○ | ○ | ○ |

TABLE 6

| | | | Comparative Example 1 Coloring material transfer material 16 | Comparative Example 2 Coloring material transfer material 17 | Comparative Example 3 Coloring material transfer material 18 | Comparative Example 4 Coloring material transfer material 19 | Comparative Example 5 Coloring material transfer material 20 | Comparative Example 6 Coloring material transfer material 21 | Comparative Example 7 Coloring material transfer material 22 |
|---|---|---|---|---|---|---|---|---|---|
| Protective layer | E1 (Low Tg) | Brand | J352D | | J352D | J352D | Emulsion aqueous solution 3 | Emulsion aqueous solution 6 | J352D |
| | | Resin | Acrylic resin | | Acrylic resin | Acrylic resin | Acrylic resin | Acrylic resin | Acrylic resin |
| | | tg1 | 56° C. | | 56° C. | 56° C. | 48° C. | 90° C. | 56° C. |
| | | \|ΔSP\| | 0.2 | | 0.2 | 0.2 | 0.4 | 0.3 | 0.2 |
| | E2 (High Tg) | Brand | | Emulsion aqueous solution 2 | Emulsion aqueous solution 2 | Emulsion aqueous solution 2 | Emulsion aqueous solution 2 | Emulsion aqueous solution 2 | Emulsion aqueous solution 4 |
| | | Resin | | Acrylic resin | Acrylic resin | Acrylic resin | Acrylic resin | Acrylic resin | Acrylic resin |
| | | tg2 | | 101° C. | 101° C. | 101° C. | 101° C. | 101° C. | 78° C. |
| | | Particle diameter | | 80 nm | 80 nm | 80 nm | 80 nm | 80 nm | 80 nm |
| | | E1/E2 | | | 3.0 | 3.0 | 3.0 | 3.0 | 3.0 |
| | Others | Brand | | | | | | | |
| | | Tg | | | | | | | |
| Process | Drying temperature at time of formation of transparent sheet (° C.) | | 90 | 120 | 120 | 90 | 90 | 90 | 90 |
| | Drying temperature at time of formation of coloring material-receiving layer (° C.) | | 90 | 120 | 90 | 120 | 90 | 90 | 90 |

TABLE 6-continued

| | | Comparative Example 1 Coloring material transfer material 16 | Comparative Example 2 Coloring material transfer material 17 | Comparative Example 3 Coloring material transfer material 18 | Comparative Example 4 Coloring material transfer material 19 | Comparative Example 5 Coloring material transfer material 20 | Comparative Example 6 Coloring material transfer material 21 | Comparative Example 7 Coloring material transfer material 22 |
|---|---|---|---|---|---|---|---|---|
| | States of emulsions in transfer material (E1/E2) | Film/— | —/film | Film/film | Film/film | Film/ particle | Film/ particle | Film/ particle |
| | Transfer temperature (° C.) | 140 | 140 | 140 | 140 | 140 | 140 | 140 |
| | State of E2 in recorded matter | | Film | Film | Film | Film | Film | Film |
| Receiving layer | Inorganic fine particles | HP-14 | HP-14 | HP-14 | HP-14 | HP-14 | HP-14 | HP-14 |
| | Water-soluble resin | PVA235 | PVA235 | PVA235 | PVA235 | PVA235 | PVA235 | PVA235 |
| Evaluation | Cutting property | x | x | x | x | ○ | ○ | ○ |
| | Adhesive property | ○ | ○ | ○ | ○ | ○ | x | ○ |
| | Chemical resistance | ○ | ○ | ○ | ○ | x | ○ | x |
| | Stickiness | ○ | ○ | ○ | ○ | x | ○ | x |
| | Cracking | ○ | ○ | ○ | ○ | ○ | ○ | ○ |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A recorded matter comprising:

an image support, a coloring material-receiving layer having an image recorded thereon, and a transparent sheet, which are laminated in stated order, wherein the image is recorded on a surface of the coloring material-receiving layer, and the surface is in contact with the image support, wherein the coloring material-receiving layer contains inorganic fine particles and a water-soluble resin, wherein the transparent sheet contains two kinds of resins including a resin E1 and a resin E2, wherein the resin E1 has a glass transition temperature Tg1 of more than 50° C. to less than 90° C., wherein the resin E2 has a glass transition temperature Tg2 of 90° C. to 120° C., and wherein at least the resin E1 is in a film state in the transparent sheet.

2. The recorded matter according to claim 1, wherein a part of or entirety of the resin E2 in the transparent sheet of the recorded matter is in a film state.

3. The recorded matter according to claim 1, wherein the image recorded on the coloring material-receiving layer is a reverse image.

4. The recorded matter according to claim 1, wherein the image recorded on the coloring material-receiving layer is formed with a pigment ink.

5. The recorded matter according to claim 1, wherein the image recorded on the coloring material-receiving layer is formed by an inkjet system.

6. The recorded matter according to claim 1, wherein a mass ratio (E1/E2) of the resin E1 to the resin E2 satisfies expression (1):

$$3.0 \leq E1/E2 \leq 65.0 \quad (1).$$

7. The recorded matter according to claim 1, wherein Tg2−Tg1≥10° C.

* * * * *